US009598272B2

(12) United States Patent
Ivanchenko

(10) Patent No.: US 9,598,272 B2
(45) Date of Patent: Mar. 21, 2017

(54) APPARATUS FOR TRANSPORTING A LOAD

(71) Applicant: Volodymyr Ivanchenko, Thornhill (CA)

(72) Inventor: Volodymyr Ivanchenko, Thornhill (CA)

(73) Assignee: 2336063 ONTARIO INC., Bolsover (CA)

( * ) Notice: Subject to any disclaimer, the term of this patent is extended or adjusted under 35 U.S.C. 154(b) by 26 days.

(21) Appl. No.: 14/574,757

(22) Filed: Dec. 18, 2014

(65) Prior Publication Data

US 2015/0175396 A1 Jun. 25, 2015

Related U.S. Application Data

(60) Provisional application No. 61/918,046, filed on Dec. 19, 2013, provisional application No. 61/918,335, filed on Dec. 19, 2013.

(51) Int. Cl.

| | |
|---|---|
| ***B66F 9/12*** | (2006.01) |
| ***B66F 9/065*** | (2006.01) |
| ***B66F 9/06*** | (2006.01) |

(52) U.S. Cl.

CPC ..... *B66F 9/065* (2013.01); *B66F 9/06* (2013.01); *B66F 9/122* (2013.01)

(58) Field of Classification Search

CPC ..... B66F 9/06; B62B 3/06; B65G 67/02

See application file for complete search history.

(56) References Cited

U.S. PATENT DOCUMENTS 3,865,262 A * 2/1975 Smith, Jr. ..... B62B 5/0003 254/124

4,061,237 A * 12/1977 Austin ..... B66F 9/07563 187/231

(Continued)

FOREIGN PATENT DOCUMENTS

| | | |
|---|---|---|
| DE | 202010016428 | 5/2012 |
| EP | 809600 | 11/1999 |
| FR | 2997365 | 5/2014 |

OTHER PUBLICATIONS

Patent Cooperation Treaty, Notification of Transmittal of the International Search Report and the Written Opinion of the International Searching Authority, or the Declaration, dated Mar. 26, 2015.

*Primary Examiner* — Saul Rodriguez
*Assistant Examiner* — Willie Berry, Jr.
(74) *Attorney, Agent, or Firm* — Bereskin & Parr LLP/S.E.N.C.R.L., s.r.l.

(57) ABSTRACT

An apparatus for transporting a load onto a raised surface includes: a frame; and rear, middle, and front wheel assemblies coupled to the frame. Each wheel assembly includes: at least one leg, at least one wheel rotatingly coupled to the leg for rollingly supporting the frame, and at least one actuator operatively coupled to the at least one leg. The front wheel assembly is configured to extend forwardly from, and retract rearwardly toward, the frame. The actuators are configured to independently raise and lower the at least one rear, middle, and front wheel. A load support member is located below the frame and moveable between a first position where the center of gravity of the load is located rearward of an axis defined by the at least one middle wheel, and a second position where the center of gravity of the load is located forward of the axis.

14 Claims, 45 Drawing Sheets

(56) References Cited

U.S. PATENT DOCUMENTS

| | | | | |
|---|---|---|---|---|
| 4,316,687 | A * | 2/1982 | Lindskog | B62B 5/0003 280/43 |
| 4,392,662 | A * | 7/1983 | Hoglinger | B65D 90/18 280/43.23 |
| 4,460,064 | A * | 7/1984 | Lutz | B60L 11/18 180/209 |
| 5,217,342 | A | 6/1993 | Grether | |
| 5,538,386 | A * | 7/1996 | Scheibel | B66F 9/06 414/347 |
| 6,409,186 | B2 * | 6/2002 | Bennington | 180/19.3 |
| 6,749,207 | B2 * | 6/2004 | Nadeau | B62B 5/0003 280/47.24 |
| 7,641,211 | B2 | 1/2010 | Ivanchenko | |
| 7,841,611 | B2 | 11/2010 | Ivanchenko | |
| 9,211,899 | B2 * | 12/2015 | Beauchamp | B62B 5/0003 |
| 2005/0042068 | A1 * | 2/2005 | Ehmen | B66F 9/10 414/661 |
| 2015/0098772 | A1 * | 4/2015 | Nelson | B66B 11/0005 414/222.08 |

* cited by examiner

APPARATUS FOR TRANSPORTING A LOAD

CROSS-REFERENCES TO RELATED APPLICATIONS

The present application claims priority from U.S. Provisional Patent Application No. 61/918,046, filed on Dec. 19, 2013, and from U.S. Provisional Patent Application No. 61/918,335, filed on Dec. 19, 2013, each of these applications being incorporated herein by reference in their entirety.

FIELD

Embodiments disclosed herein relate generally to an apparatus for transporting a load, and more particularly to an apparatus for transporting a load between surfaces of different heights.

INTRODUCTION

Machines, such as a pallet jack or forklift, are often used to transport loads supported on pallets. However, a pallet jack may not be able to transfer a load onto a raised surface without the use of a ramp or an elevator platform. While a forklift may be able to transfer a load to a raised surface without the use of a ramp or an elevator platform, a typical forklift may only be able to transfer the load to a location near the edge of the raised surface.

Accordingly, transporting a load onto or from a raised surface (e.g. the floor of a cargo trailer) typically requires a ramp and/or the use of multiple machines, which may be time consuming, inefficient, and/or expensive.

SUMMARY

In one broad aspect, there is provided an apparatus for transporting a load onto a raised surface, the load having a centre of gravity, the apparatus comprising: a) a frame; b) a rear wheel assembly coupled to the frame, the rear wheel assembly comprising: (i) at least one rear leg, (ii) at least one rear wheel rotatingly coupled to a distal end of the at least one rear leg for rollingly supporting the frame, and (iii) at least one rear actuator operatively coupled to the at least one rear leg and configured to raise and lower the at least one rear wheel; c) a middle wheel assembly coupled to the frame, the middle wheel assembly comprising: (i) at least one middle leg, (ii) at least one middle wheel rotatingly coupled to a distal end of the at least one middle leg for rollingly supporting the frame, the at least one middle wheel defining a middle axis, and (iii) at least one middle actuator operatively coupled to the at least one middle leg and configured to raise and lower the at least one middle wheel; d) a front wheel assembly coupled to the frame, the front wheel assembly being configured to extend forwardly from the frame and retract rearwardly toward the frame, the front wheel assembly comprising: (i) at least one front leg, (ii) at least one front wheel rotatingly coupled to a distal end of the at least one front leg for rollingly supporting the frame, and (iii) at least one front actuator operatively coupled to the at least one front leg and configured to raise and lower the at least one front wheel and to extend and retract the front wheel assembly; wherein the at least one rear actuator, the at least one middle actuator, and the at least one front actuator are configured to independently raise and lower the at least one rear wheel, the at least one middle wheel, and the at least one front wheel; and e) a load support member for supporting the load, the load support member operatively coupled to the at least one middle leg, the load support member located below the frame and moveable between a first position where the centre of gravity of the load is located rearward of the middle axis, and a second position where the centre of gravity of the load is located forward of the middle axis.

In some embodiments, the at least one middle leg comprises a pair of middle legs extending downwardly from the frame, each middle leg of the pair of middle legs comprising an upper middle leg and a lower middle leg, the upper middle leg having an upper end coupled to the frame, the lower middle leg having an upper end coupled to the upper middle leg, and the lower middle leg having a lower end coupled to the middle wheel.

In some embodiments, each upper middle leg comprises an elongate hollow member and each lower middle leg comprises an elongate member configured for telescoping movement within the hollow member, and wherein the at least one middle actuator is configured to move the lower middle leg relative to the upper middle leg.

In some embodiments, each of the at least one middle actuator comprises a worm drive driven by an electric motor.

In some embodiments, each of the at least one middle actuator comprises a hydraulic or pneumatic piston.

In some embodiments, the at least one rear leg comprises a pair of rear legs extending downwardly from the frame, wherein each rear leg in the pair of rear legs comprises an upper rear leg and a lower rear leg, the upper rear leg having an upper end coupled to the frame, the lower rear leg having an upper end coupled to the upper rear leg, and the lower rear leg having a lower end coupled to the rear wheel.

In some embodiments, each upper rear leg comprises an elongate hollow member and each lower rear leg comprises an elongate member configured for telescoping movement within the hollow member, and wherein the at least one rear actuator is configured to move the lower rear leg relative to the upper rear leg.

In some embodiments, each of the at least one rear actuator comprises a worm drive driven by an electric motor.

In some embodiments, each of the at least one rear actuator comprises a hydraulic or pneumatic piston.

In some embodiments, the apparatus further comprises at least one load support track, each of the at least one load support track extending between one of the pair of upper middle legs and one of the pair of upper rear legs, wherein the load support member is slidingly coupled to the at least one load support track.

In some embodiments, the apparatus further comprises at least one load support track, each of the at least one load support track extending between a front portion of the frame and a rear portion of the frame, wherein the load support member is slidingly coupled to the at least one load support track.

In some embodiments, the apparatus further comprises at least one load support actuator configured to selectively move the load support member between the first position and the second position.

In some embodiments, the apparatus further comprises at least one load support actuator configured to selectively move the load support member between the first position and the second position.

In some embodiments, the front wheel assembly comprises at least one extension member, and wherein the at least one front leg comprises a pair of front legs extending downwardly from the at least one extension member, wherein each front leg in the pair of front legs comprises an upper front leg and a lower front leg, the upper front leg having an upper end coupled to the at least one extension member, the lower front leg having an upper end coupled to the upper front leg, and the lower front leg having a lower end coupled to the front wheel.

In some embodiments, each upper front leg comprises an elongate hollow member and each lower front leg comprises an elongate member configured for telescoping movement within the hollow member, and wherein the at least one front actuator is configured to move the lower front leg relative to the upper front leg.

In some embodiments, each of the at least one front actuator comprises a worm drive driven by an electric motor.

In some embodiments, each of the at least one front actuator comprises a hydraulic or pneumatic piston.

In some embodiments, the load support member is configured to support a pallet.

In some embodiments, the load support member comprises at least two forks.

In some embodiments, the apparatus is self-propelled.

In some embodiments, when the load support member is in the first position, the load is located substantially within an area defined by the pair of rear legs, the pair of middle legs, and the frame.

In another broad aspect, there is provided an apparatus for transporting a load onto a raised surface, the load having a centre of gravity, the apparatus comprising: a) a frame; b) an adjustable rear wheel assembly coupled to the frame, the adjustable rear wheel assembly comprising: (i) at least one adjustable rear leg, (ii) at least one rear wheel rotatingly coupled to a distal end of the at least one adjustable rear leg for rollingly supporting the frame, and (iii) at least one rear actuator operatively coupled to the at least one adjustable rear leg and configured to raise and lower the at least one rear wheel; c) a support rear wheel assembly coupled to the frame, the support rear wheel assembly comprising at least one rear support wheel for rollingly supporting the frame, the at least one rear support wheel positioned forward of the at least one rear wheel, the at least one rear support wheel defining a rear support axis; d) an adjustable front wheel assembly coupled to the frame, the adjustable front wheel assembly comprising: (i) at least one adjustable front leg, (ii) at least one front wheel rotatingly coupled to a distal end of the at least one adjustable front leg for rollingly supporting the frame, the at least one front wheel positioned forward of the at least one rear support wheel, the at least one front wheel defining a front axis, and (iii) at least one front actuator operatively coupled to the at least one adjustable front leg and configured to raise and lower the at least one front wheel; e) a support front wheel assembly coupled to the frame, the support front wheel assembly comprising: (i) at least one front support leg, and (ii) at least one front support wheel rotatingly coupled to a distal end of the at least one front support leg for rollingly supporting the frame, the at least one front support wheel positioned forward of the at least one front wheel; and e) a load support member for supporting the load, the load support member operatively coupled to the frame and moveable between an upper and a lower load support position, the load support member located below the frame and positioned so that the centre of gravity of the load being supported is located forward of the rear support axis and rearward of the front axis.

In some embodiments, the at least one adjustable rear leg comprises a pair of adjustable rear legs extending downwardly from the frame, each adjustable rear leg of the pair of adjustable rear legs comprising an upper adjustable rear leg and a lower adjustable rear leg, the upper adjustable rear leg having an upper end coupled to the frame, the lower adjustable rear leg having an upper end coupled to the upper adjustable rear leg, and the lower adjustable rear leg having a lower end coupled to the rear wheel.

In some embodiments, each upper adjustable rear leg comprises an elongate hollow member and each lower adjustable rear leg comprises an elongate member configured for telescoping movement within the hollow member, and wherein the at least one rear actuator is configured to move the lower adjustable rear leg relative to the upper adjustable rear leg.

In some embodiments, each of the at least one rear actuator comprises a worm drive driven by an electric motor.

In some embodiments, each of the at least one rear actuator comprises a hydraulic or pneumatic piston.

In some embodiments, the at least one adjustable front leg comprises a pair of adjustable front legs extending downwardly from the frame, wherein each adjustable front leg in the pair of adjustable front legs comprises an upper adjustable front leg and a lower adjustable front leg, the upper adjustable front leg having an upper end coupled to the frame, the lower adjustable front leg having an upper end coupled to the upper adjustable front leg, and the lower adjustable front leg having a lower end coupled to the front wheel.

In some embodiments, each upper adjustable front leg comprises an elongate hollow member and each lower adjustable front leg comprises an elongate member configured for telescoping movement within the hollow member, and wherein the at least one front actuator is configured to move the lower adjustable front leg relative to the upper adjustable front leg.

In some embodiments, each of the at least one front actuator comprises a worm drive driven by an electric motor.

In some embodiments, each of the at least one front actuator comprises a hydraulic or pneumatic piston.

In some embodiments, the apparatus further comprises at least one load support track, wherein the load support member is slidingly coupled to the at least one load support track, and further comprises at least one load support actuator configured to selectively move the load support member between the upper load support position and the lower load support position.

In some embodiments, the load support member is configured to support a pallet.

In some embodiments, the load support member comprises at least two forks.

In some embodiments, the apparatus is self-propelled.

In some embodiments, when the load support member is in the upper load support position, the load is located substantially within an area defined by the pair of adjustable rear legs, the pair of adjustable front legs, and the frame.

These and other aspects and features of various embodiments will be described in greater detail below.

DRAWINGS

For a better understanding of embodiments of the systems and methods described herein, and to show more clearly how they may be carried into effect, reference will be made, by way of example, to the accompanying drawings in which.

Figure 1:
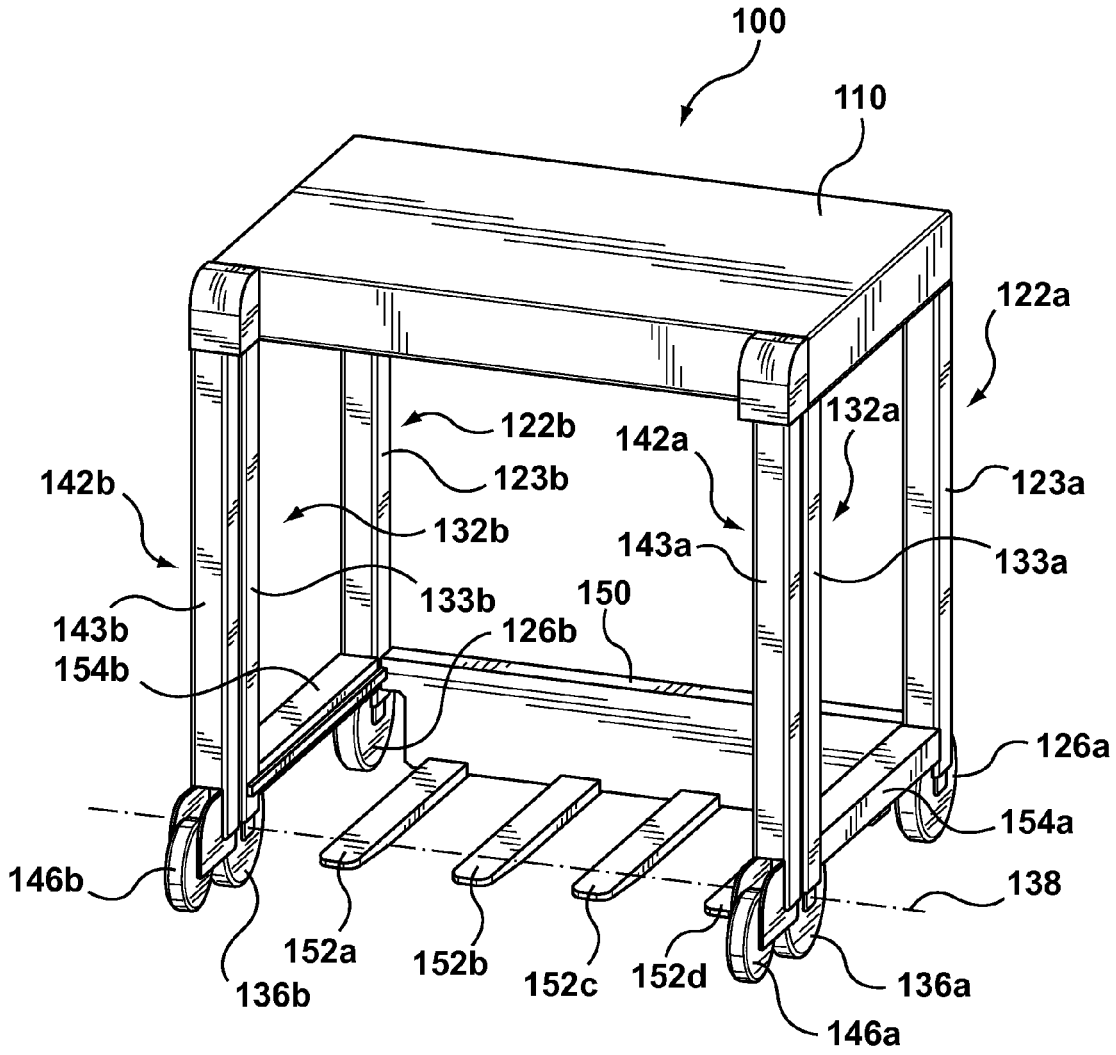
FIG. 1 is a front perspective view of an apparatus for transporting a load onto a raised surface in accordance with one embodiment.
Figure 10:
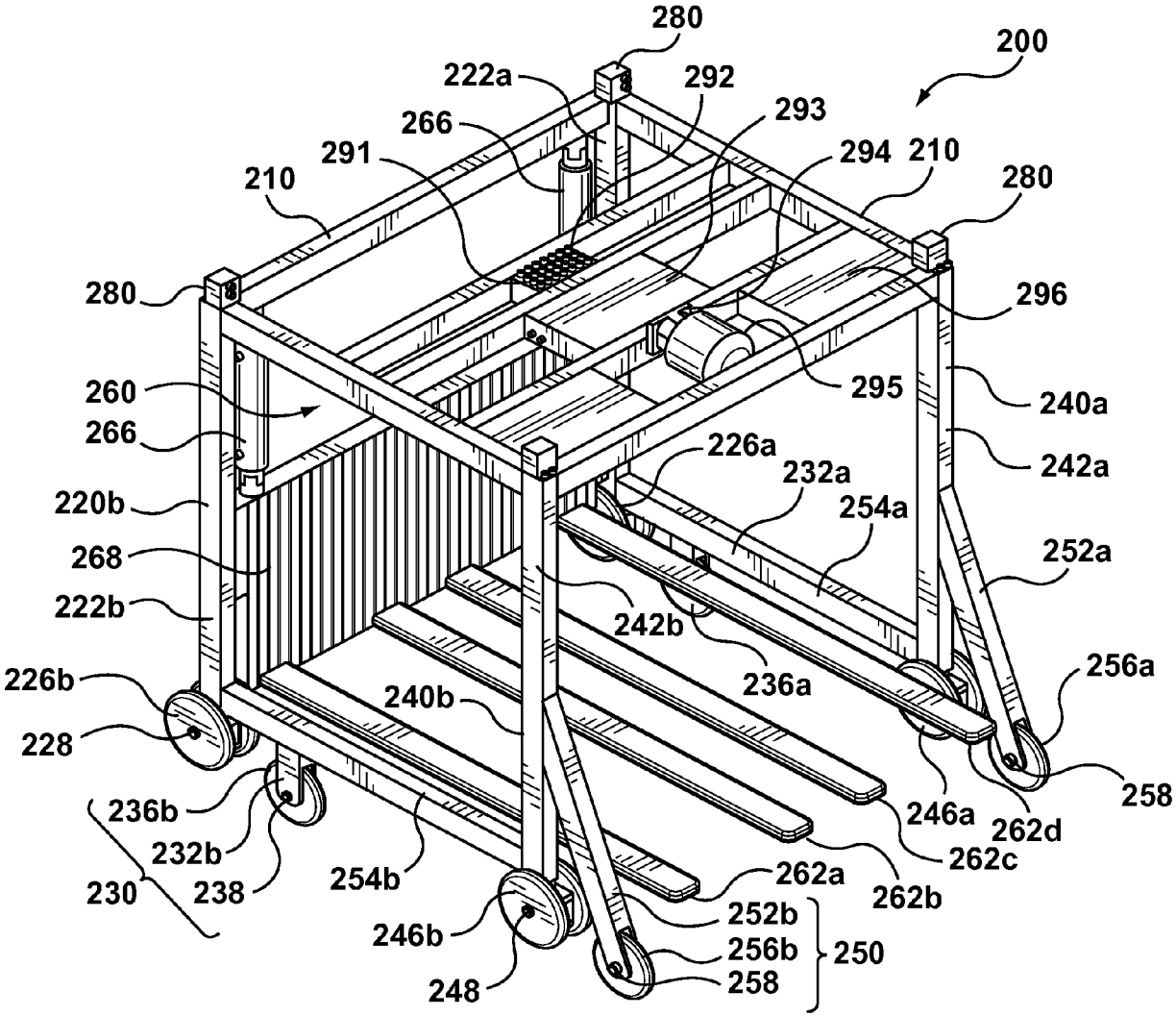
Figure 11:
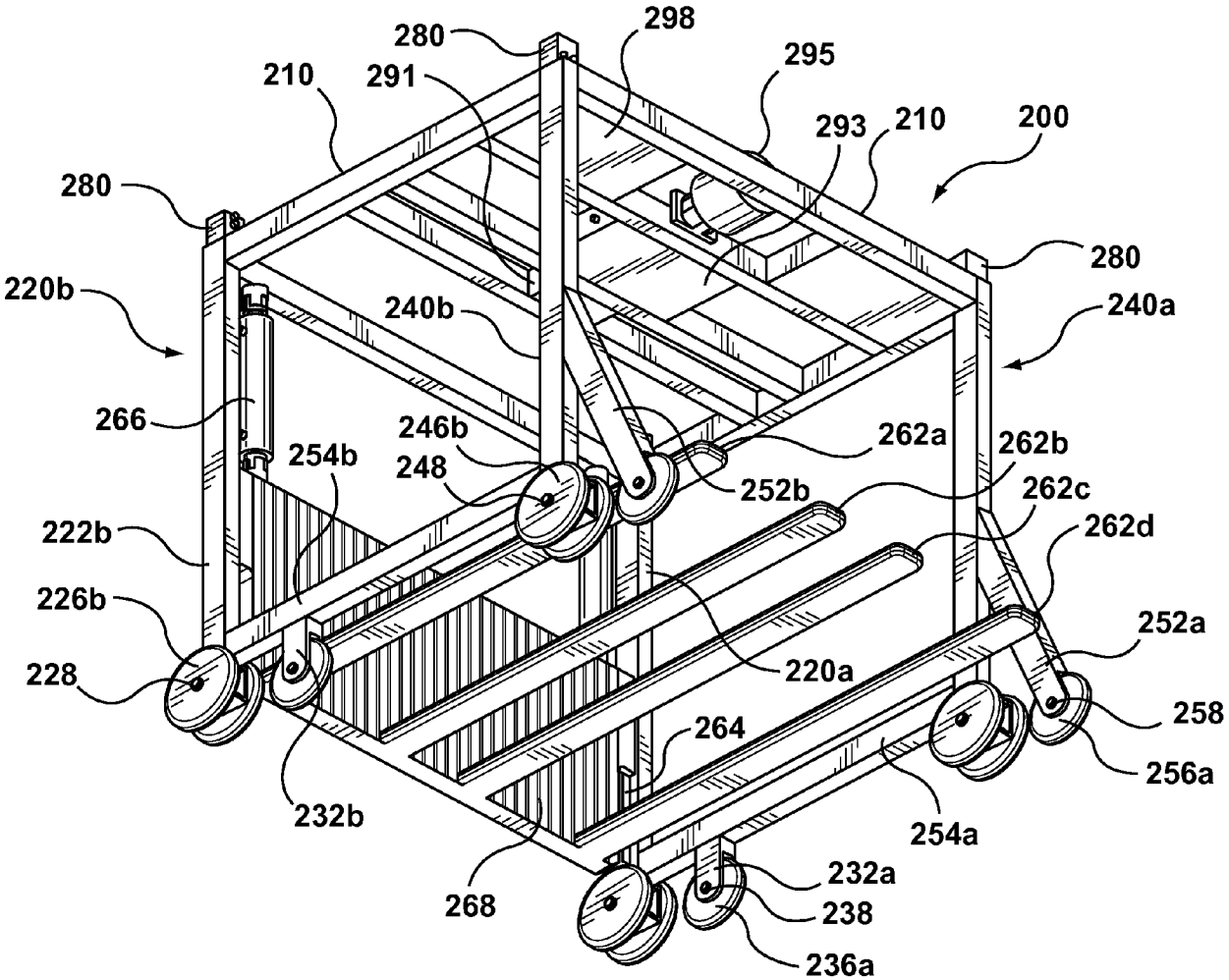
Figure 12:
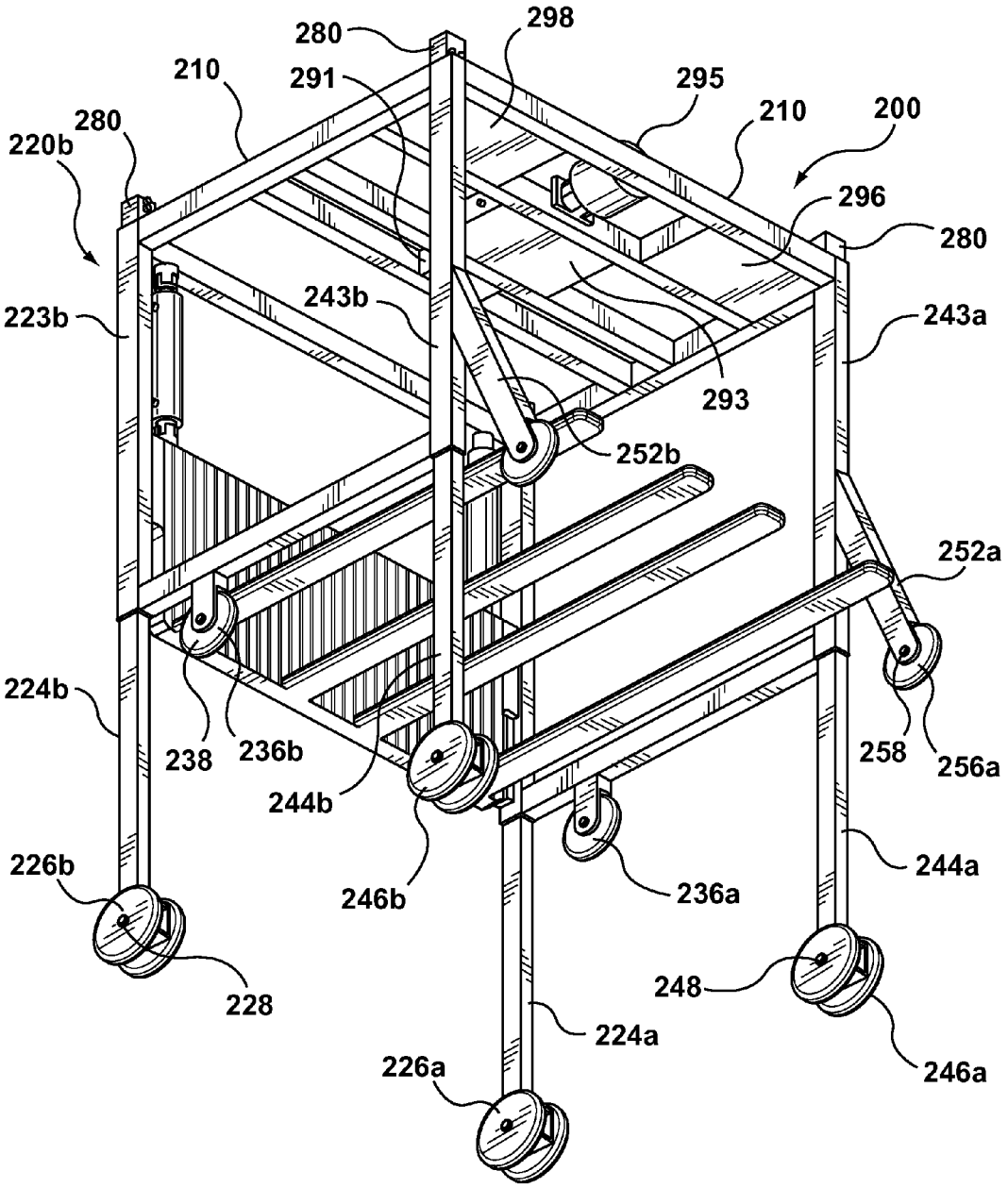
Figure 13:
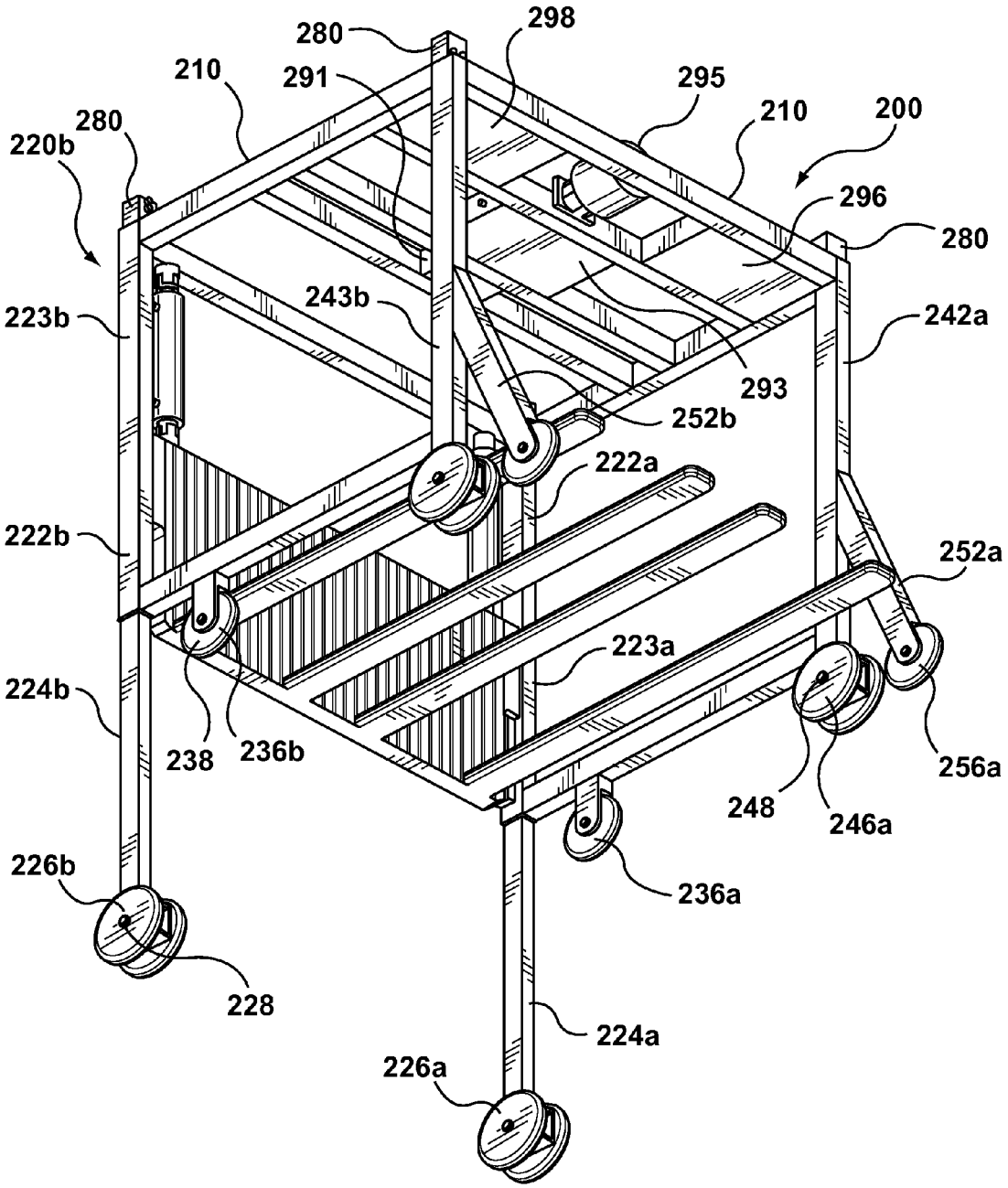
Figure 14:
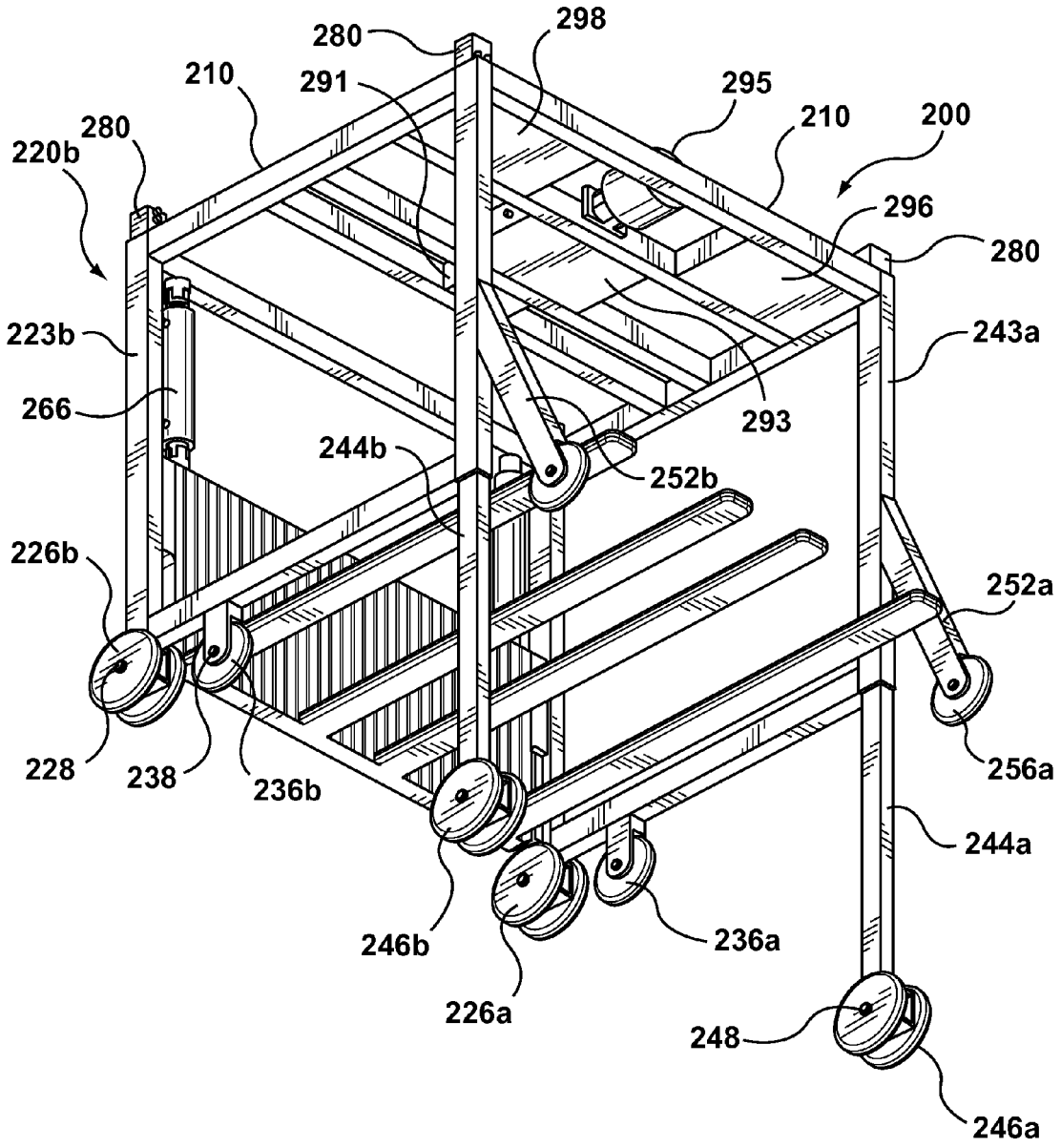
Figure 15:
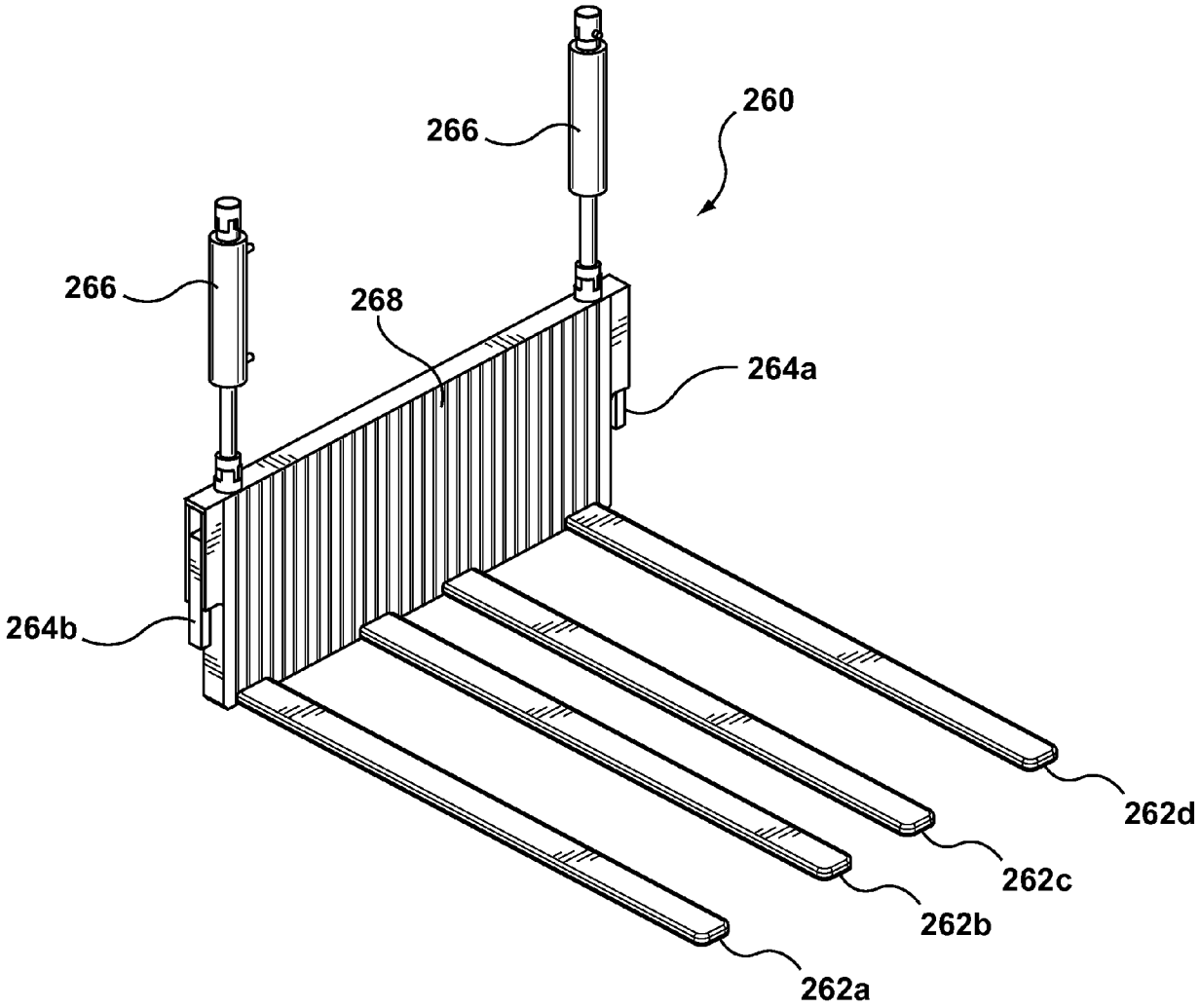
Figure 16:
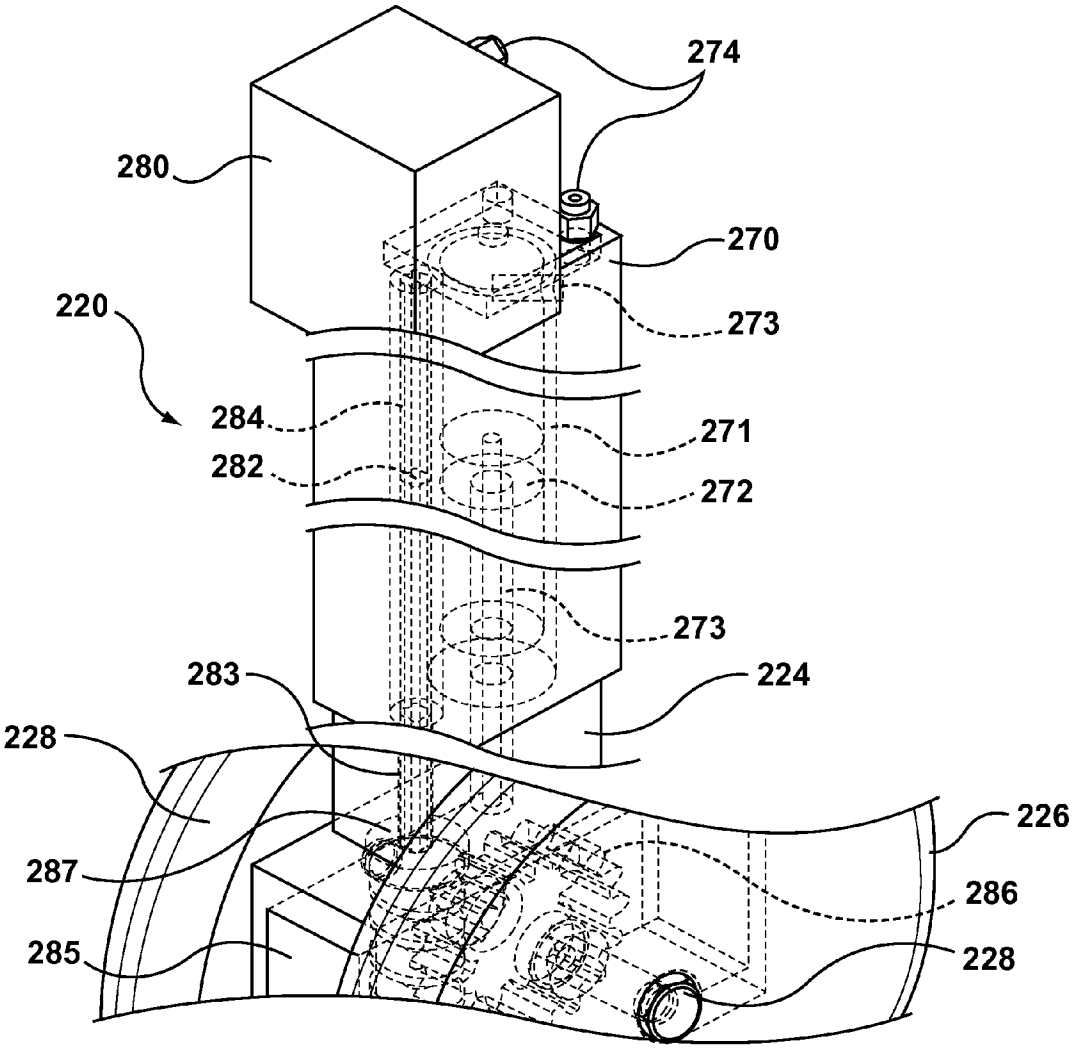

FIGS. 8A-L are a series of elevation views illustrating the apparatus of FIG. 1 being used to transport a load onto a raised surface;

FIGS. 9A-I are a series of elevation views illustrating the apparatus of FIG. 1 being used to transport a load from a raised surface;

FIG. 10 is a front perspective view of an apparatus for transporting a load onto a raised surface in accordance with another embodiment;

FIG. 11 is a perspective view of the underside of the apparatus of FIG. 10;

FIG. 12 is a perspective view of the underside of the apparatus of FIG. 10, with an adjustable rear wheel assembly in an extended position, and with an adjustable front wheel assembly in an extended position;

FIG. 13 is a perspective view of the underside of the apparatus of FIG. 10, with an adjustable rear wheel assembly in an extended position, and with an adjustable front wheel assembly in a retracted position;

FIG. 14 is a perspective view of the underside of the apparatus of FIG. 10, with an adjustable rear wheel assembly in a retracted position, and with an adjustable front wheel assembly in an extended position;

FIG. 15 is a front perspective view of the load support member of the apparatus of FIG. 10;

FIG. 16 is a perspective view of an adjustable leg, showing an embodiment of a telescopic actuator and a telescoping drive mechanism; and FIGS. 17A-J are a series of elevation views illustrating the apparatus of FIG. 10 being used to transport a load onto a raised surface.

The drawings included herewith are for illustrating various examples of articles, methods, and apparatuses of the teaching of the present specification and are not intended to limit the scope of what is taught in any way

DESCRIPTION OF VARIOUS EMBODIMENTS

Various embodiments will be described below to provide an example of each claimed invention. No example described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

Figure 2:
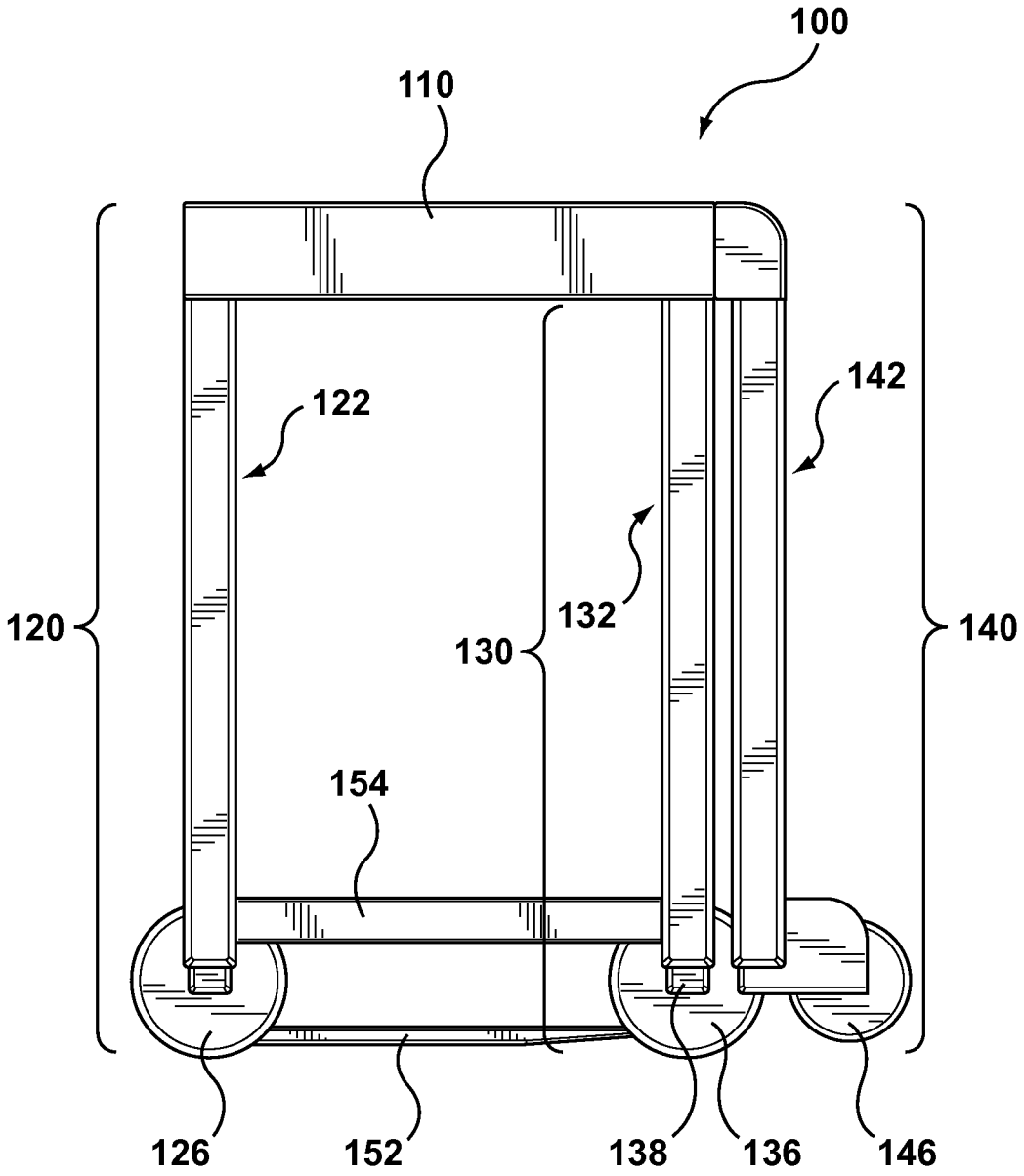
FIG. 2 is a side view of the apparatus of FIG. 1.
Figure 3:
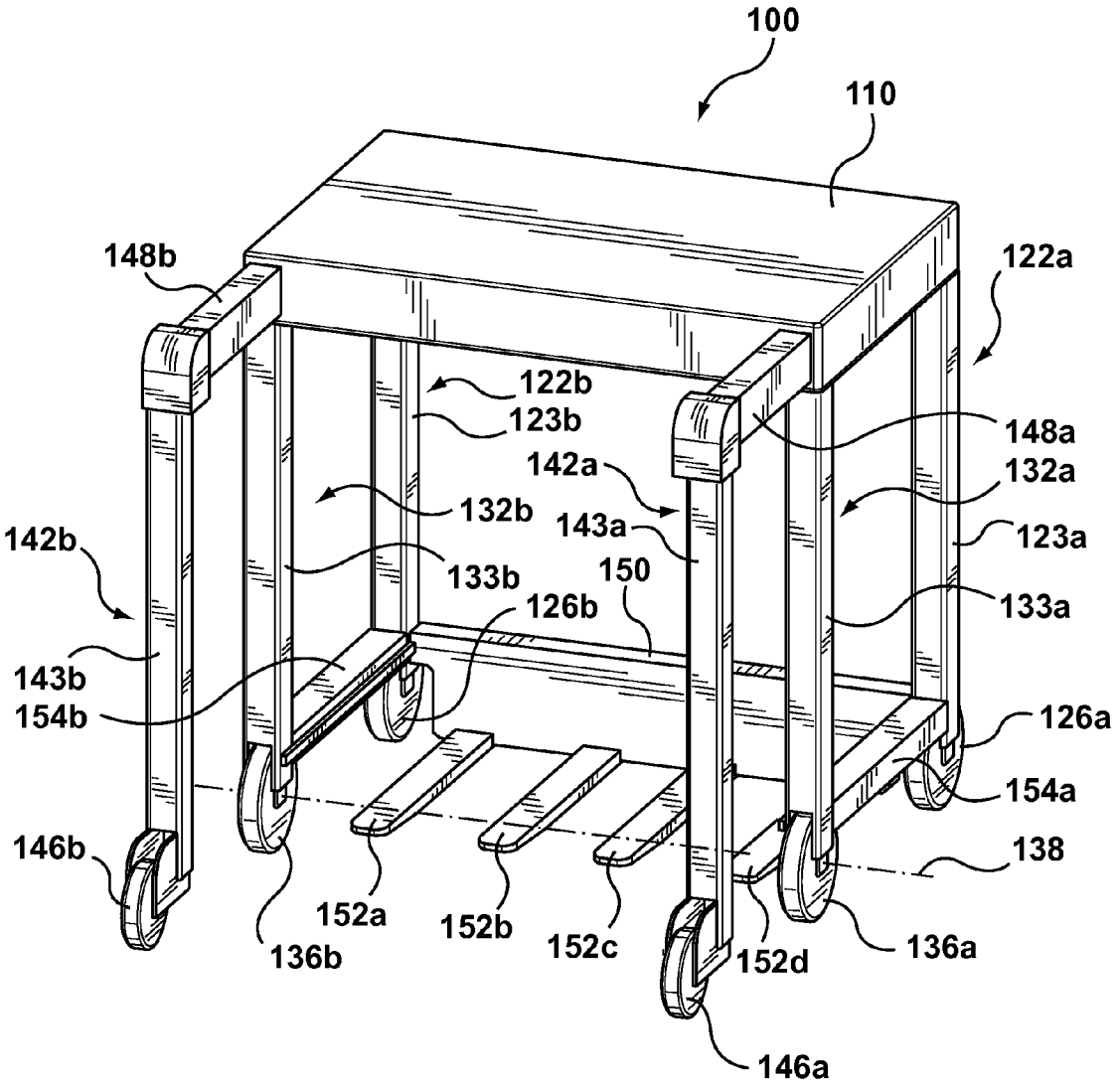
FIG. 3 is a front perspective view of the apparatus of FIG. 1, with a front wheel assembly in an extended position.
Figure 4:
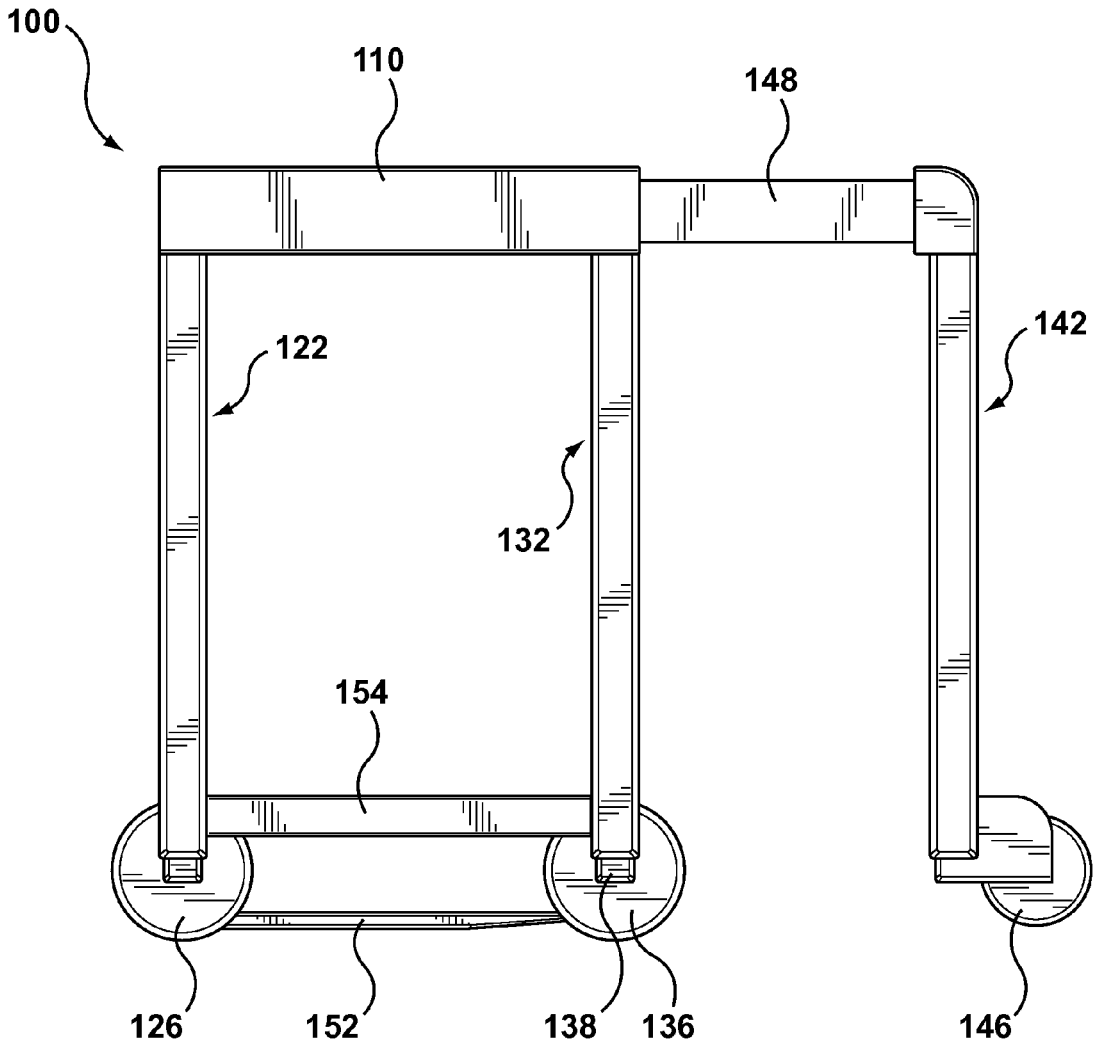
FIG. 4 is a side view of the apparatus of FIG. 1, with the front wheel assembly in an extended position.

FIGS. 1 to 7 show an apparatus 100 that can be used to transport a load onto a raised surface. Referring to FIGS. 1 and 2, the apparatus 100 includes a frame 110. A rear wheel assembly 120, a middle wheel assembly 130, and a front wheel assembly 140 support the frame 110. A load support member 150 is provided for supporting a load that is to be transported by the apparatus 100.

Rear wheel assembly 120 is coupled to the frame 110 and includes rear legs 122*a* and 122*b*. A first rear wheel 126*a* is coupled to the end of a first rear leg 122*a*, and a second rear wheel 126*b* is coupled to the end of a second rear leg 122*b*. Rear wheels 126*a-b* support the frame 110 via rear legs 122*a-b* so that apparatus 100 can roll on a surface.

While a pair of rear legs 122*a-b* are shown, it will be appreciated that more (or fewer) rear legs may be provided as part of rear wheel assembly 120. Also, while each rear leg is shown as having one rear wheel 126*a-b*, it will be appreciated that each rear leg may have more than one rear wheel coupled thereto. The number of rear legs and/or the number of rear wheels may be selected based on, for example, the expected mass of a load to be transported by apparatus 100, the type of surface apparatus 100 is expected to traverse (e.g. asphalt, concrete, gravel, etc.), and/or the rated power output of a motor used to drive the rear wheels (where provided).

Figure 6:
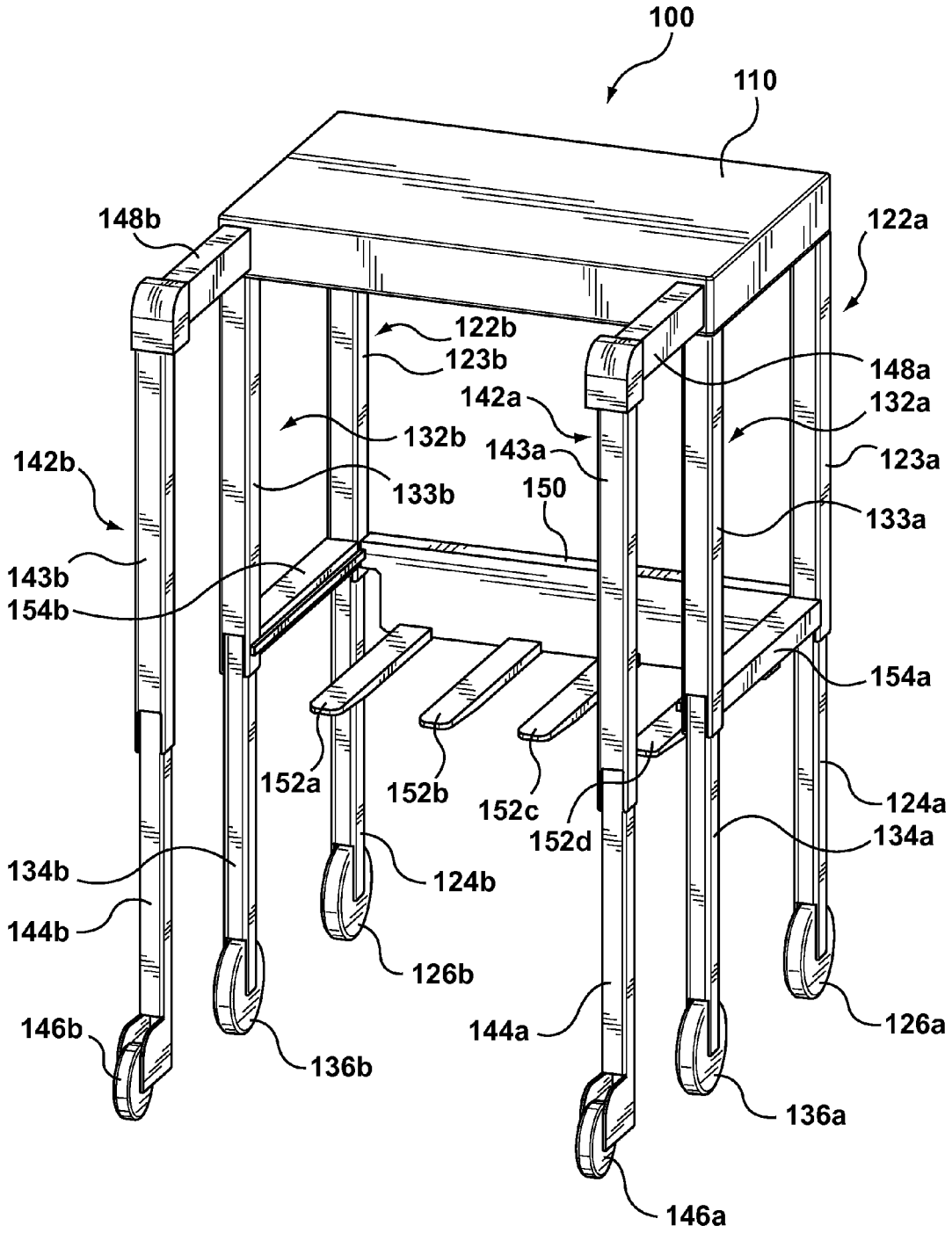
FIG. 6 is a front perspective view of the apparatus of FIG. 1, with the front wheel assembly in an extended position, the load support member in a rearward position, and with the front, middle, and rear wheels in a lowered position.
Figure 7:
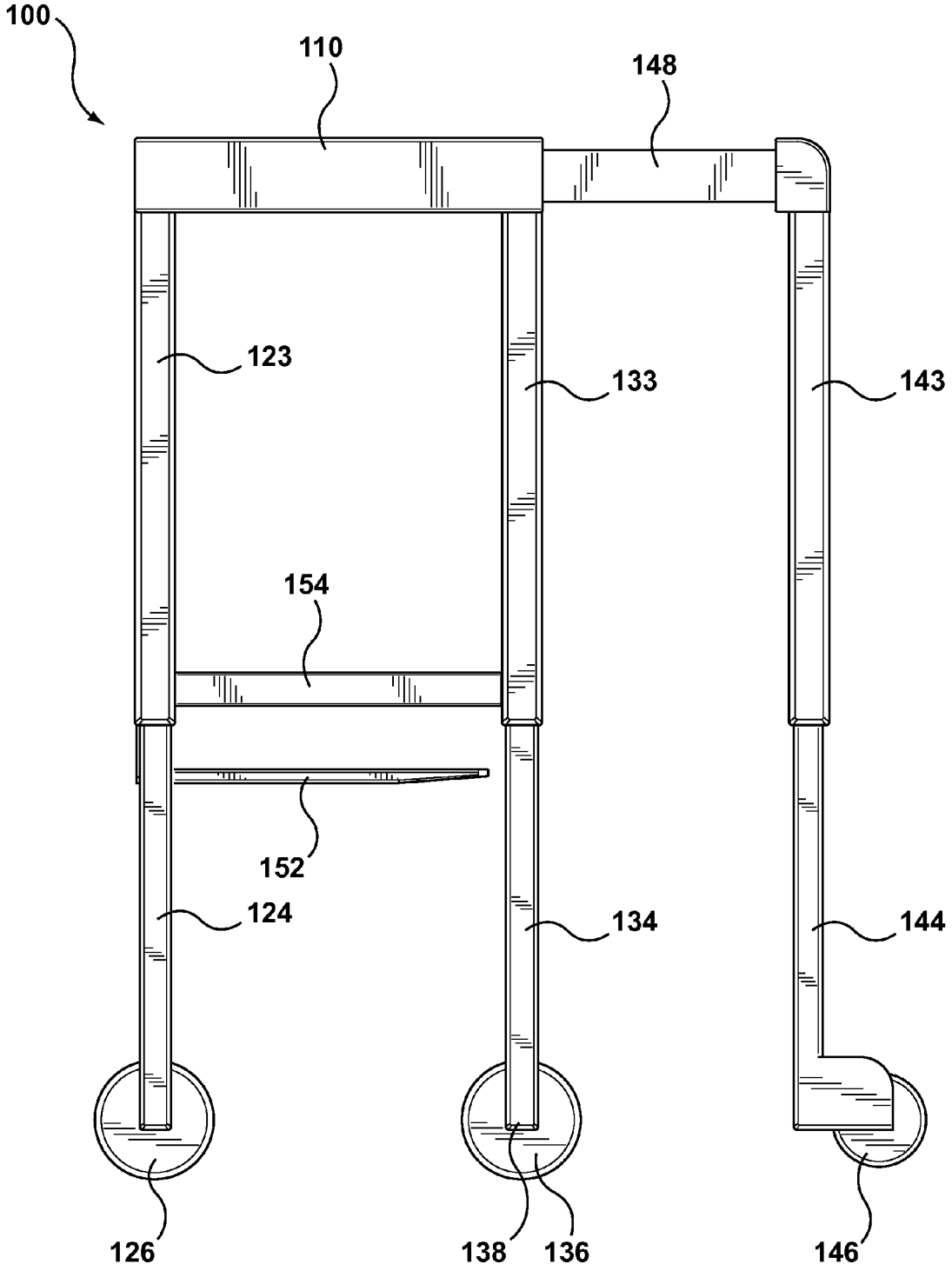
FIG. 7 is a side view of the apparatus of FIG. 1, with the front wheel assembly in an extended position, the load support member in a rearward position, and with the front, middle, and rear wheels in a lowered position.

Rear wheel assembly 120 also includes at least one rear actuator (not shown) configured to raise and lower the rear wheels 126*a-b*. As shown in FIGS. 6 and 7, rear leg 122*a* includes an upper rear leg 123*a* and a lower rear leg 124*a*, and rear leg 122*b* includes an upper rear leg 123*b* and a lower rear leg 124*b*. Each upper rear leg 123*a-b* has an upper end coupled to the frame, and each lower rear leg 124*a-b* has an upper end coupled to its respective upper rear leg 123*a-b*. Rear wheels 126*a-b* are coupled to a lower end of each lower rear leg 124*a-b*. In operation, the rear actuator (e.g. a worm drive driven by an electric motor, a hydraulic drive system, a pneumatic drive system) is operable to displace lower rear legs 124*a-b* relative to their respective upper rear leg 123*a-b*, causing the rear wheels 126*a-b* to be raised (see e.g. FIG. 1) and lowered (see e.g. FIG. 6) relative to the frame 110.

As shown, the upper rear legs 123*a-b* are hollow members, and the lower rear legs 124*a-b* are configured for telescoping movement within the hollow upper rear legs. It will be appreciated that other configurations of upper and lower rear legs may be possible (e.g. a scissor mechanism). Also, while an upper rear leg 123 and a lower rear leg 124 are shown, it will be appreciated that a rear leg may include additional leg members, e.g. to provide multi-stage telescopic extension of the rear leg.

Middle wheel assembly 130 is coupled to the frame 110 and includes middle legs 132*a* and 132*b*. A first middle wheel 136*a* is coupled to the end of first middle leg 132*a*, and a second middle wheel 136*b* is coupled to the end of second middle leg 132*b*. Middle wheels 136*a-b* support the frame 110 via middle legs 132*a-b* so that apparatus 100 can rollingly traverse a surface. Also, middle wheels 136*a-b* define a middle axis 138 (see e.g. FIG. 1).

While a pair of middle legs 132*a-b* are shown, it will be appreciated that more (or fewer) middle legs may be provided as part of middle wheel assembly 130. Also, while each middle leg is shown as having one middle wheel 136*a-b*, it will be appreciated that each middle leg may have more than one middle wheel coupled thereto. The number of middle legs and/or the number of middle wheels may be selected based on, for example, the expected mass of a load to be transported by apparatus 100, the type of surface apparatus 100 is expected to traverse (e.g. asphalt, concrete, gravel, etc.), and/or the rated power output of a motor used to drive the middle wheels (where provided).

Middle wheel assembly 130 also includes at least one middle actuator (not shown) configured to raise and lower the middle wheels 136*a-b*. As shown in FIGS. 6 and 7, middle leg 132*a* includes an upper middle leg 133*a* and a lower middle leg 134*a*, and middle leg 132*b* includes an upper middle leg 133*b* and a lower middle leg 134*b*. Each upper middle leg 133*a-b* has an upper end coupled to the frame, and each lower middle leg 134*a-b* has an upper end coupled to its respective upper middle leg 133*a-b*. Middle wheels 136*a-b* are coupled to a lower end of each lower middle leg 134*a-b*. In operation, the middle actuator (e.g. a worm drive driven by an electric motor, a hydraulic drive system, a pneumatic drive system) is operable to displace lower middle legs 134*a-b* relative to their respective upper middle leg 133*a-b*, causing the middle wheels 136*a-b* to be raised (see e.g. FIG. 1) and lowered (see e.g. FIG. 6) relative to the frame 110.

As shown, the upper middle legs 133*a-b* are hollow members, and the lower middle legs 134*a-b* are configured for telescoping movement within the hollow upper middle legs. It will be appreciated that other configurations of upper and lower middle legs may be possible (e.g. a scissor mechanism). Also, while an upper middle leg 133 and a lower middle leg 134 are shown, it will be appreciated that a middle leg may include additional leg members, e.g. to provide multi-stage telescopic extension of the middle leg.

Front wheel assembly 140 is coupled to the frame 110 and includes front legs 142*a* and 142*b*. A first front wheel 146*a* is coupled to the end of a first front leg 142*a*, and a second front wheel 146*b* is coupled to the end of a second front leg 142*b*. Front wheels 146*a-b* support the frame 110 via front legs 142*a-b* so that apparatus 100 can roll on a surface.

While a pair of front legs 142*a-b* are shown, it will be appreciated that more (or fewer) front legs may be provided as part of front wheel assembly 140. Also, while each front leg is shown as having one front wheel 146*a-b*, it will be appreciated that each front leg may have more than one front wheel coupled thereto. The number of front legs and/or the number of front wheels may be selected based on, for example, the expected mass of a load to be transported by apparatus 100, the type of surface apparatus 100 is expected to traverse (e.g. asphalt, concrete, gravel, etc.), and/or the rated power output of a motor used to drive the front wheels (where provided).

Front wheel assembly 140 also includes at least one front actuator (not shown) configured to raise and lower the front wheels 146*a-b*. As shown in FIGS. 6 and 7, front leg 142*a* includes an upper front leg 143*a* and a lower front leg 144*a*, and front leg 142*b* includes an upper front leg 143*b* and a lower front leg 144*b*. Each upper front leg 143*a-b* has an upper end coupled to the frame, and each lower front leg 144*a-b* has an upper end coupled to its respective upper front leg 143*a-b*. Front wheels 146*a-b* are coupled to a lower end of each lower front leg 144*a-b*. In operation, the front actuator (e.g. a worm drive driven by an electric motor, a hydraulic drive system, a pneumatic drive system) is operable to displace lower front legs 144*a-b* relative to their respective upper front leg 143*a-b*, causing the front wheels 146*a-b* to be raised (see e.g. FIG. 1) and lowered (see e.g. FIG. 6) relative to the frame 110.

As shown, the upper front legs 143*a-b* are hollow members, and the lower front legs 144*a-b* are configured for telescoping movement within the hollow upper front legs. It will be appreciated that other configurations of upper and lower front legs may be possible (e.g. a scissor mechanism). Also, while an upper front leg 143 and a lower front leg 144 are shown, it will be appreciated that a front leg may include additional leg members, e.g. to provide multi-stage telescopic extension of the front leg.

Alternatively, or additionally, front legs 142*a-b* may be pivotally coupled to the frame 110 (e.g. via a tilt bracket and/or a turning wheel mechanism) so that front legs 142*a-b* may be pivoted towards a horizontal position (forwardly and/or rearwardly), which will also have the effect of raising front wheels 146*a-b* (assuming front legs 142*a-b* to not telescope or otherwise lengthen as they are pivoted).

As shown in FIGS. 6 and 7, front wheel assembly 140 may be coupled to frame 110 via one or more extension members 148*a-b*. Extension members 148*a-b* are configured to selectively extend and retract relative to frame 110, so that the front legs 142*a-b* are able to extend forwardly from (and retract rearwardly towards) the frame 110. The extension and retraction of extension members 148*a-b* may be controlled by the same front actuator(s) that is(are) configured to raise and lower the front wheels 146*a-b*, or one or more additional extension actuators (not shown) may be provided to control the extension and retraction of the front wheel assembly relative to the frame 110.

Alternatively, or additionally, extension members 148*a-b* may be pivotally coupled to the frame 110 (e.g. via a tilt bracket and/or a turning wheel mechanism) so that front legs 142*a-b* may be pivoted towards a horizontal position (forwardly and/or rearwardly). Alternatively, or additionally, front legs 142*a-b* may be pivotally coupled to extension members 148*a-b* to achieve a substantially equivalent ability to pivot front legs 142*a-b* towards a horizontal position to raise the front wheels. Alternatively, or additionally, front wheels 146*a-b* may be pivotally coupled to the front legs 142*a-b* (e.g. via a tilt bracket and/or a turning wheel mechanism) so that front wheels 146*a-b* may be pivoted towards a horizontal position (forwardly and/or rearwardly) to achieve a substantially equivalent ability to raise the front wheels.

In order to assist in transporting the load using apparatus 100, one or more of rear wheels 126*a-b*, middle wheels 136*a-b*, and/or front wheels 146*a-b* may be driven by one or more motors (not shown) coupled to apparatus 100, so that apparatus 100 may be able to propel itself across a surface. For example, one or more motors may be provided at a lower portion of one or more of the legs to drive one or more of the front, middle, and/or rear wheels directly. Alternatively or additionally, one or more motors may be provided at an upper portion of one or more of the legs (or at the frame 110) and transfer power to one or more of the front, middle, and/or rear wheels through e.g. a splined shaft located inside a leg. Alternatively or additionally, wheel hub motors may be coupled to one or more of the wheels. Any suitable motor type may be used (e.g. hydraulic motors, electric motors, internal combustion engines, and the like) to propel the apparatus.

Alternatively, or additionally, in some embodiments one or more of rear wheels 126*a-b*, middle wheels 136*a-b*, and/or front wheels 146*a-b* may be selectively rotatable by one or more motors (not shown) coupled to apparatus 100, so that apparatus 100 may be able to steer itself as it is being propelled. Alternatively or additionally, the speed of the motors driving the wheels to propel the apparatus may be independently adjustable to assist in steering. For example, the rear wheels 126*a-b* and/or middle wheels 136*a-b* may be selectively driven at different speeds (and/or in different directions) to assist in turning.

Alternatively, or additionally, in some embodiments, one or more of rear wheels 126*a-b*, middle wheels 136*a-b*, and/or front wheels 146*a-b* may be freely rotatable (e.g. configured as swivel casters), for example where another of the rear wheels 126*a-b*, middle wheels 136*a-b*, and/or front wheels 146*a-b* are configured to propel and steer the apparatus.

Returning to FIG. 1, load support member 150 is configured to engage and/or support a load to be transported using apparatus 100. For example, load support member 150 may be provided with one or more forks 152 which may be configured to engage a pallet. As can be seen in FIG. 1, apparatus 100 has four forks 152*a-d*, but it will be appreciated that more or fewer forks 152 may be provided on load support member 150.

Load support member 150 is preferably located below frame 110, so that a load being transported by apparatus 100 is supported in a position below frame 110. Advantageously, in this arrangement apparatus 100 may have the same overall height, whether or not is it transporting a load.

Also, load support member 150 is preferably dimensioned such that when the load support member is in the first position (e.g. as shown in FIGS. 1 and 2), the load support member—and thus in most instances, the supported load—is located substantially within an area defined by the pair of rear legs 122*a-b*, the pair of middle legs 132*a-b*, and the frame 110. Advantageously, in this arrangement apparatus 100 may have the same overall length and width, whether or not is it transporting a load.

Figure 5:
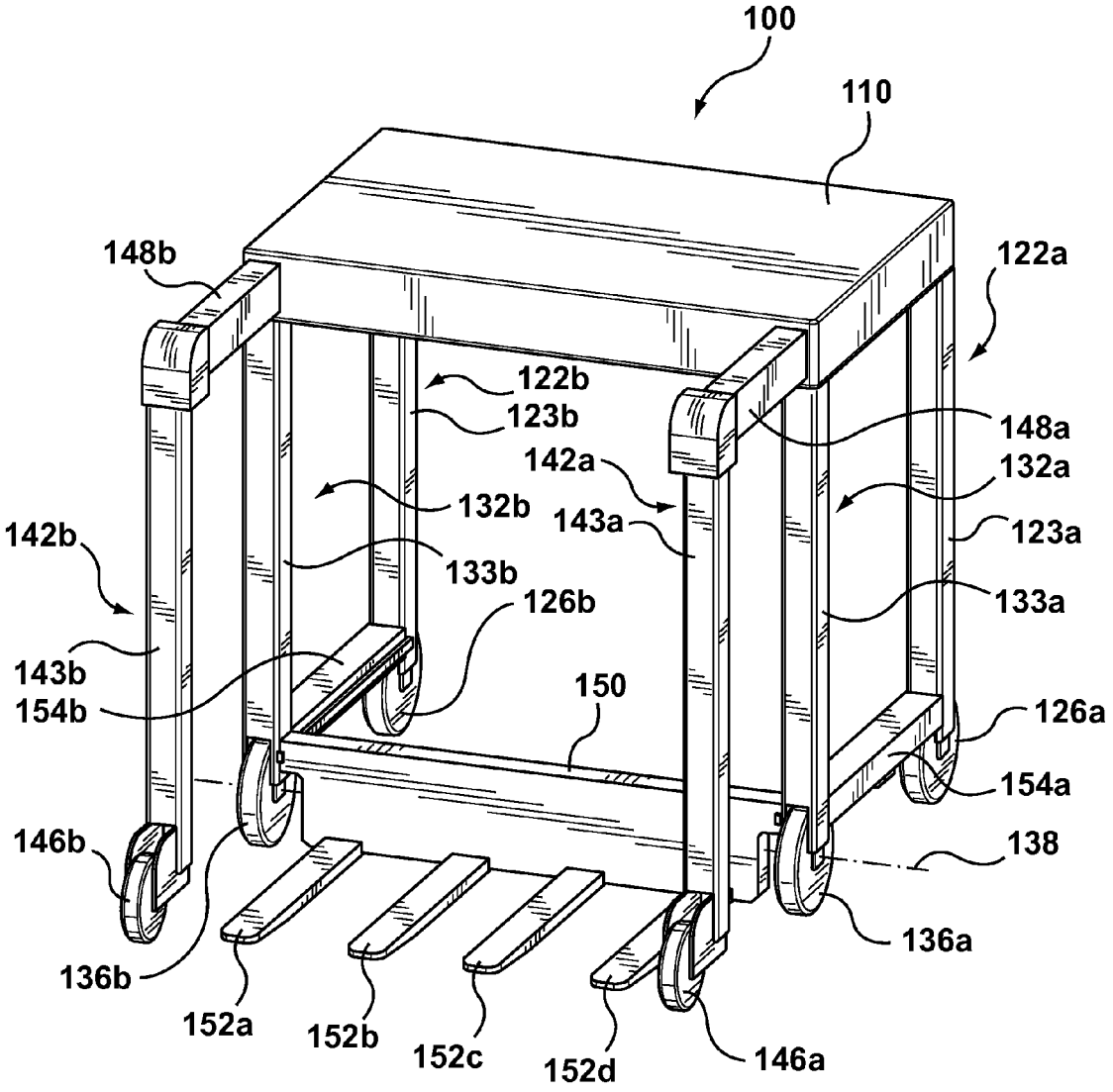
FIG. 5 is a front perspective view of the apparatus of FIG. 1, with the front wheel assembly in an extended position and a load support member in a forward position.

Load support member 150 is also moveable between a first position where the load supporting portion of the load support member—and thus the centre of gravity of a supported load—is located rearward of the middle axis (see e.g. FIG. 1), and a second position where the load supporting portion of the load support member—and thus the centre of gravity of the supported load—is located forward of the middle axis 138 (see e.g. FIG. 5). As discussed further below, the ability to selectively move the centre of gravity of the load being transported between the first position and the second position may facilitate transporting the load onto a raised surface.

In order to facilitate displacement of the load support member 150 between the first and second positions, as shown in FIGS. 1-7 apparatus 100 may also have one or more load support tracks 154, and load support member 150 may be slidingly coupled to the support tracks. In the illustrated embodiment, a pair of load support tracks 154*a-b* are provided on apparatus 100. Load support track 154*a* extends between upper rear leg 123*a* and upper middle leg 133*a*, and load support track 154*b* extends between upper rear leg 123*b* and upper middle leg 133*b*. While preferably, load support track 154 is operatively coupled to the middle wheel assembly, it will be appreciated that other configurations and/or locations for the load support tracks are possible; for example, at load support track may be mounted to and extend between a front portion of the frame and a rear portion of the frame.

Apparatus 100 may also include at load support actuator (not shown) configured to selectively move the load support member between the first position and the second position. In operation, the load support actuator (e.g. a worm drive driven by an electric motor, a hydraulic drive system, a pneumatic drive system) is operable to move the load support member 150 forwardly and rearwardly along the load support tracks 154, causing the load support member (and thus the centre of gravity of a supported load) to move between the first position and the second position.

The operation of apparatus 100 in transporting a load 50 onto (and from) a raised surface will now be described with reference to FIGS. 8A-L and 9A-I. The operation will be described in connection with the apparatus 100 entering and exiting a cargo trailer 300. However, it will be understood that the apparatus 100 may transport a load onto and off of any other raised surface (either enclosed or not) in the same manner.

The operation of the apparatus 100 in connection with transporting a load 50 onto a raised surface will now be described with reference to FIGS. 8A-L.

Figure 8A:
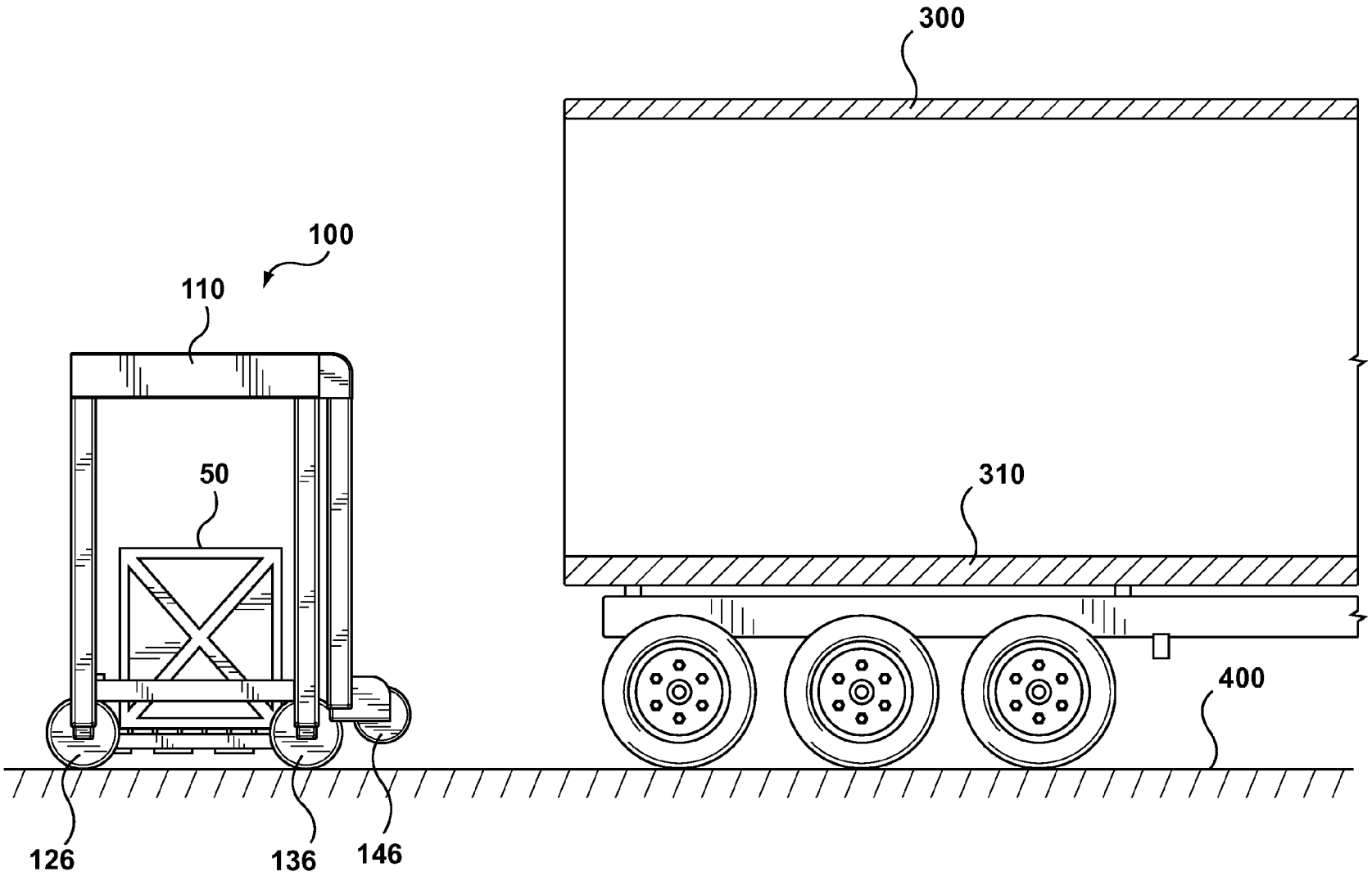

The apparatus 100 typically traverses a surface in the position shown in FIG. 8A. Preferably, the apparatus 100 is rollingly supported by rear wheels 126*a-b* and middle wheels 136*a-b*, with the front wheels 146*a-b* raised slightly so that they do not contact the ground surface. However, it will be appreciated that, in alternative embodiments, front wheels 146*a-b* may also contact the ground surface 400 being traversed by apparatus 100.

When apparatus 100 is to be used to transport the load 50 onto a raised surface, such as the floor 310 of a cargo trailer 300, the apparatus 100 is first positioned in proximity of the raised surface 310.

Figure 8B:
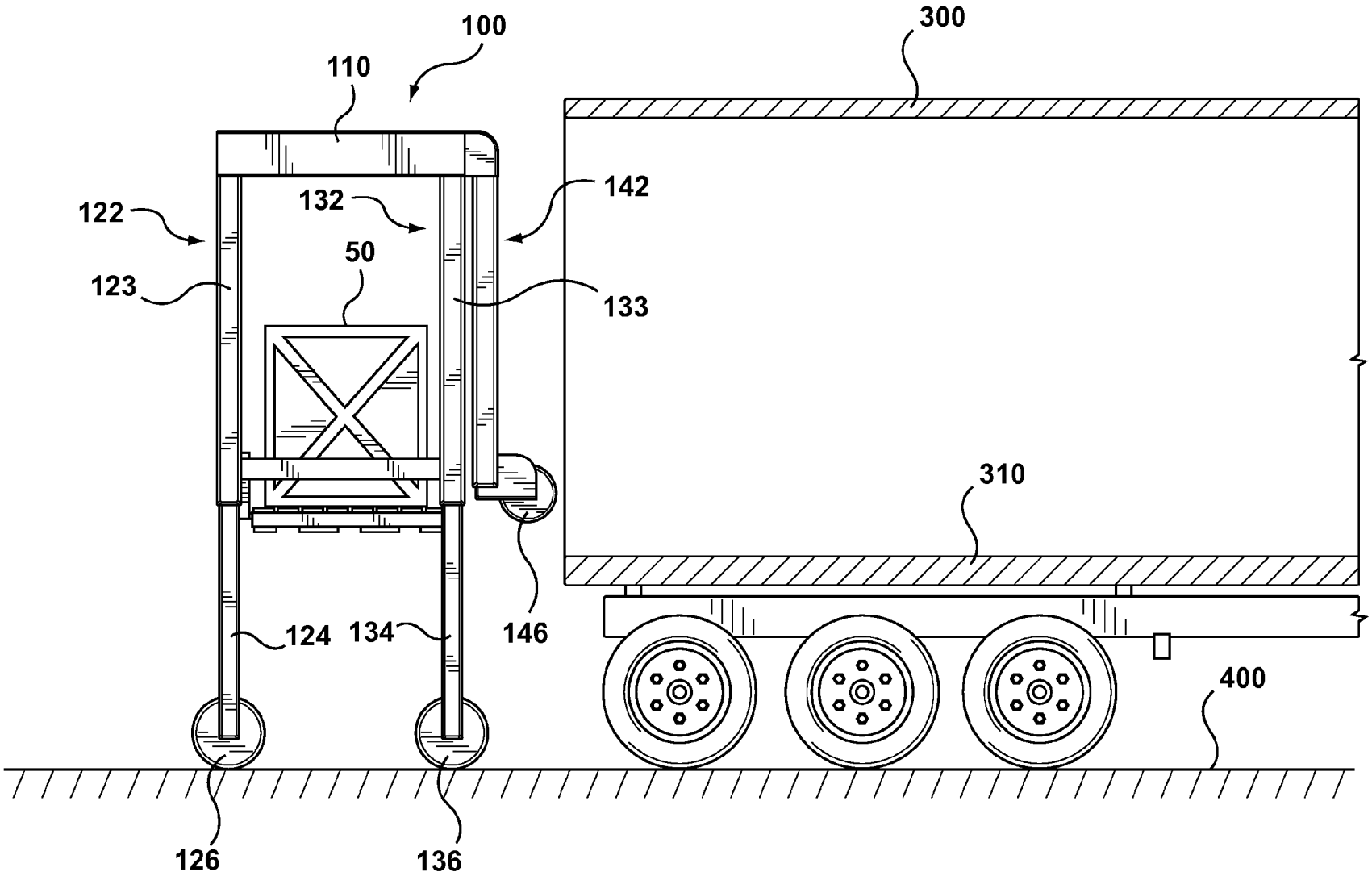

Referring to FIG. 8B, the rear legs 122*a-b* and the middle legs 132*a-b* then extend to raise the apparatus 100 so that front wheels 146*a-b* are at or above the height of the raised surface 310.

Figure 8C:
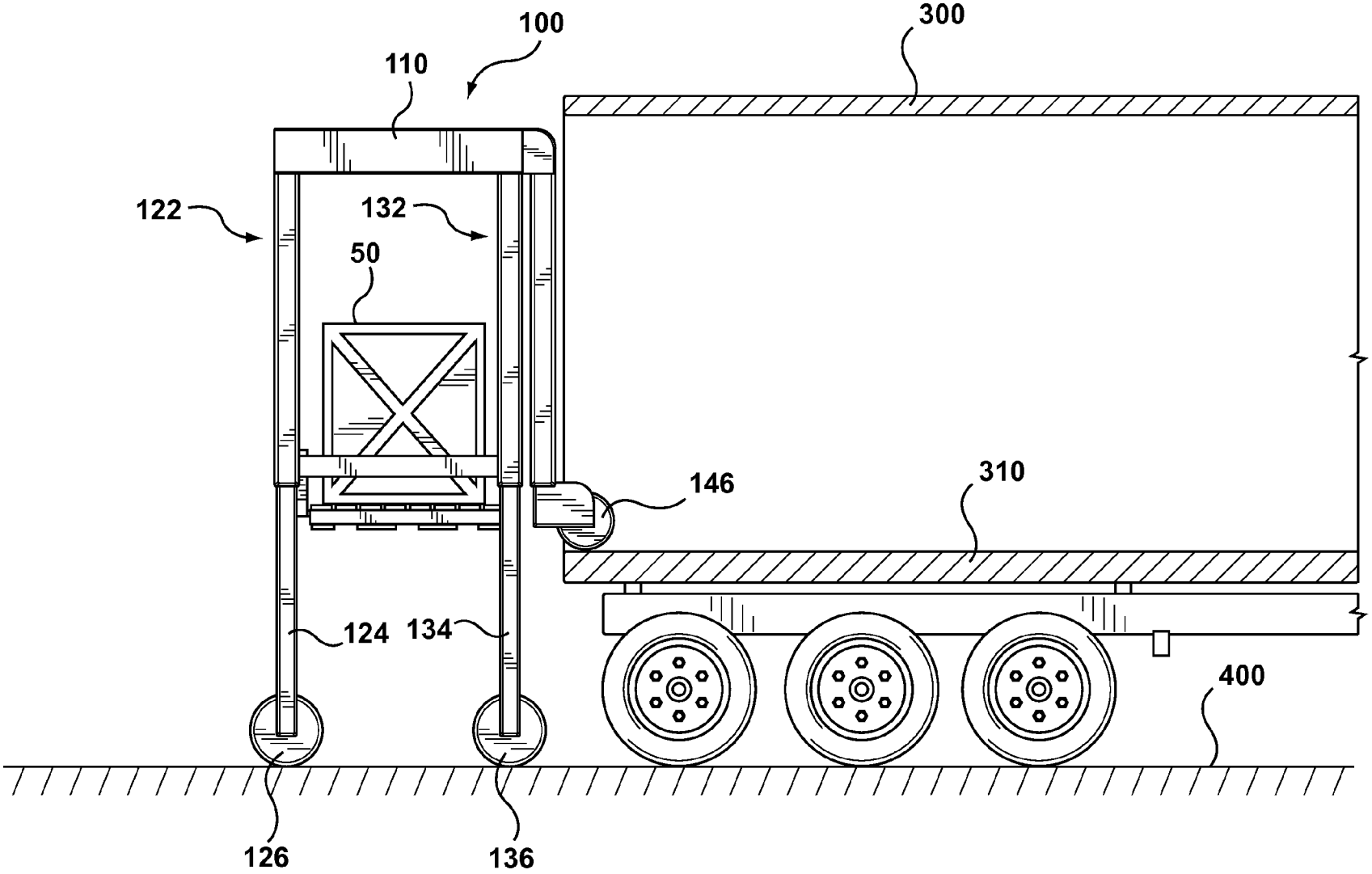

Referring to FIG. 8C, the front wheels 146*a-b* are then brought into contact with the raised surface 310. In the illustrated example, this is achieved by advancing apparatus 100 towards the raised surface 310 and lowering front wheels 146*a-b* onto the raised surface.

Figure 8D:
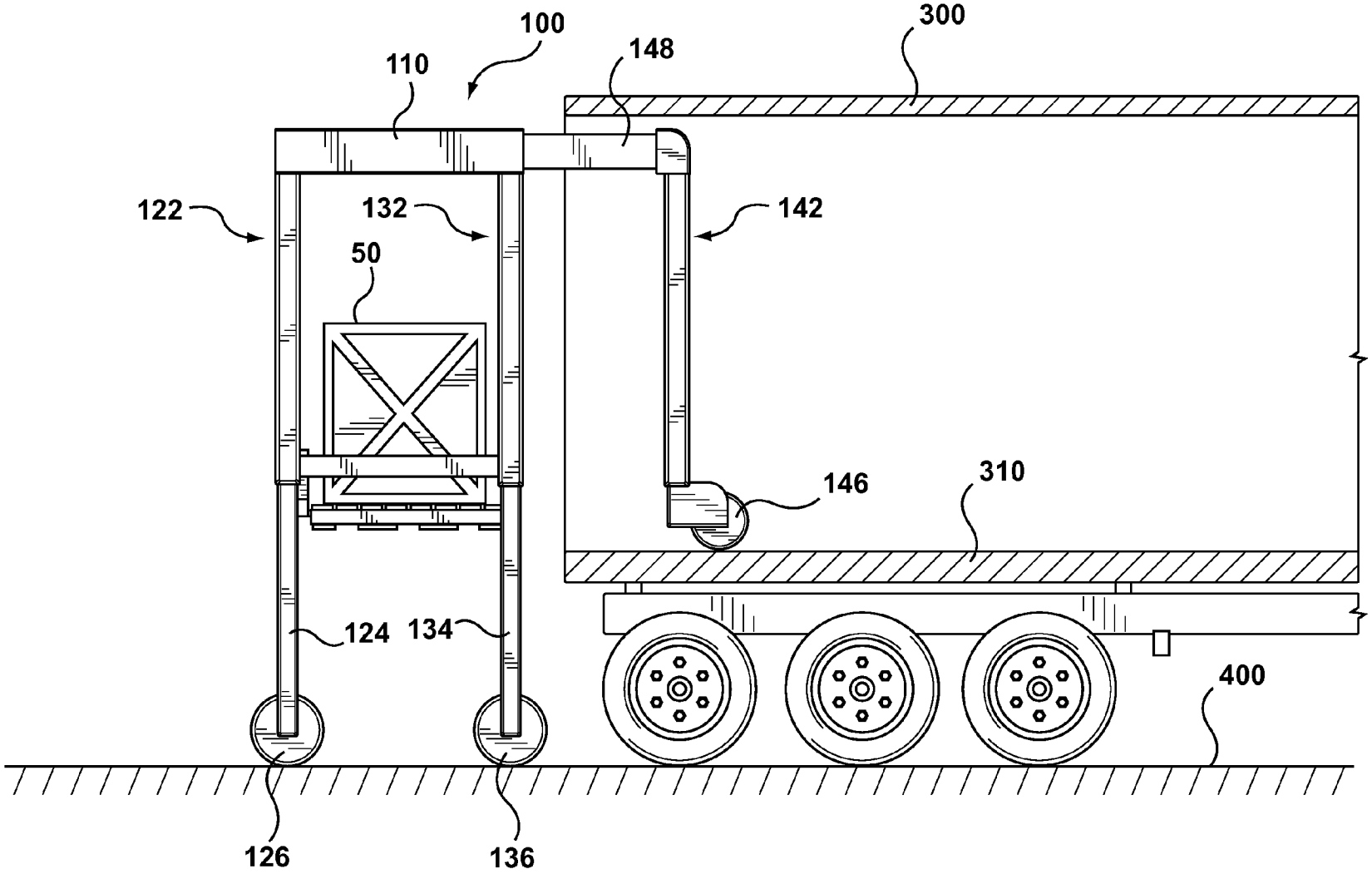

Referring to FIG. 8D, the front wheel assembly 140 is then extended forwardly from the frame 110, while maintaining contact between the front wheels 146*a-b* and the raised surface 310. It will be appreciated that alternatively, front wheel assembly 140 may be extended without the front wheels 146*a-b* being in contact with the raised surface, and then the front wheels 146*a-b* may be lowered to contact the raised surface.

Figure 8E:
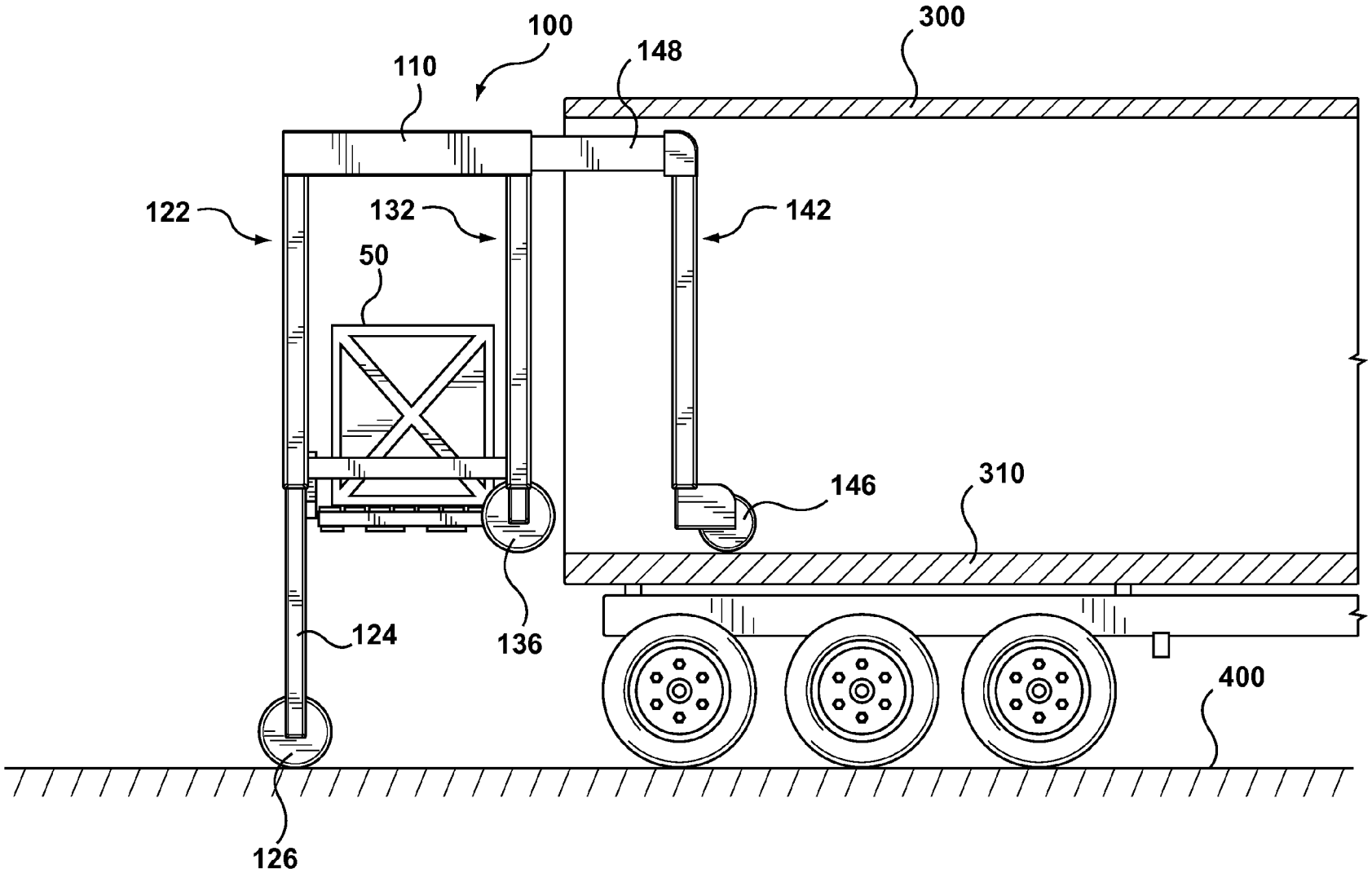

Referring to FIG. 8E, the middle wheels 136*a-b* are then raised towards frame 110 so that middle wheels 136*a-b* are at or above the height of the raised surface 310. Since the rear wheels 126*a-b* are in contact with the ground surface 400 and the front wheels 146*a-b* are in contact with the raised surface 310, apparatus 100 remains stable.

Figure 8F:
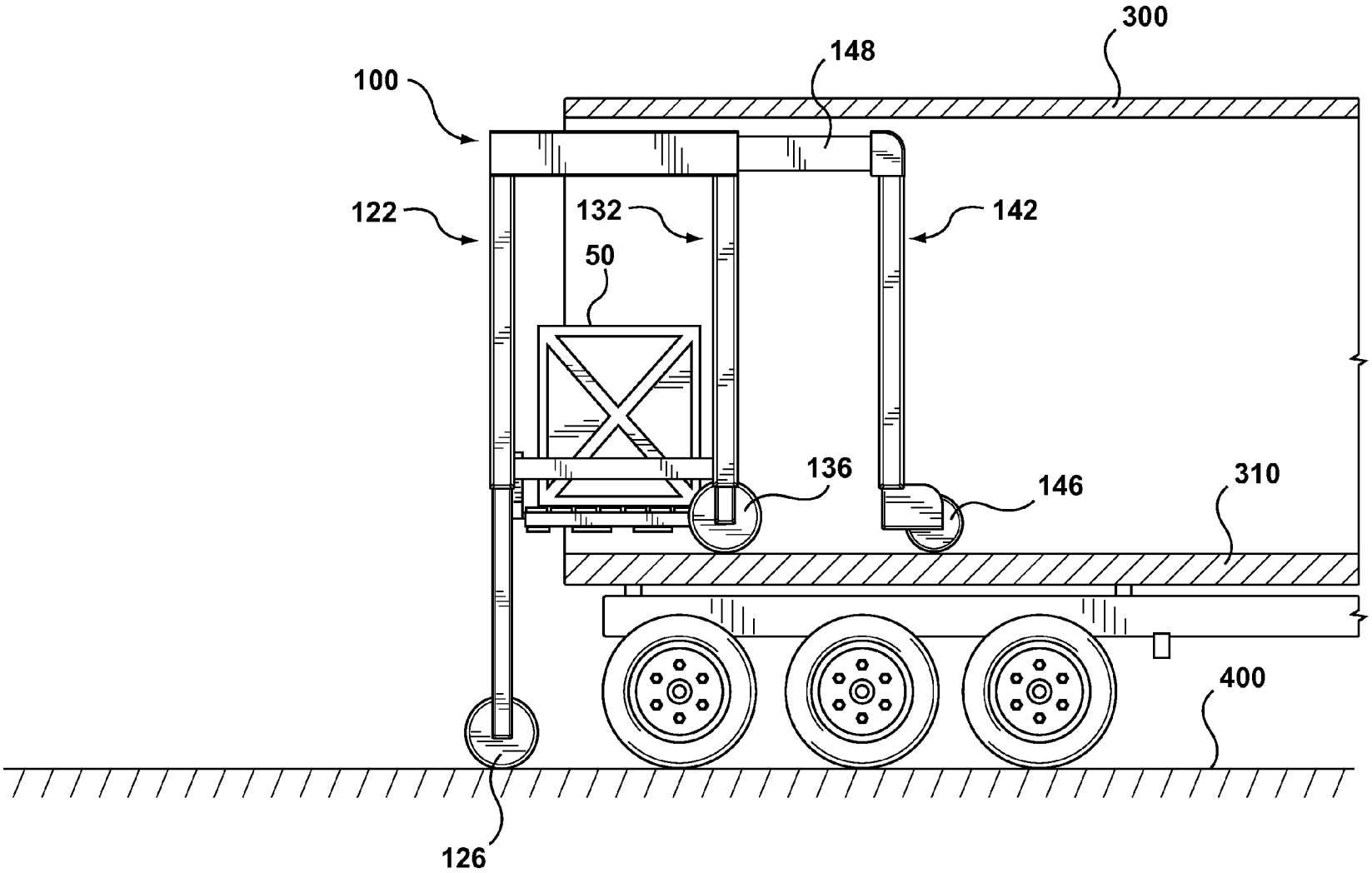

Referring to FIG. 8F, apparatus 100 is then advanced towards raised surface 310, and middle wheels 136*a-b* are lowered (if necessary) onto the raised surface 310.

Figure 8G:
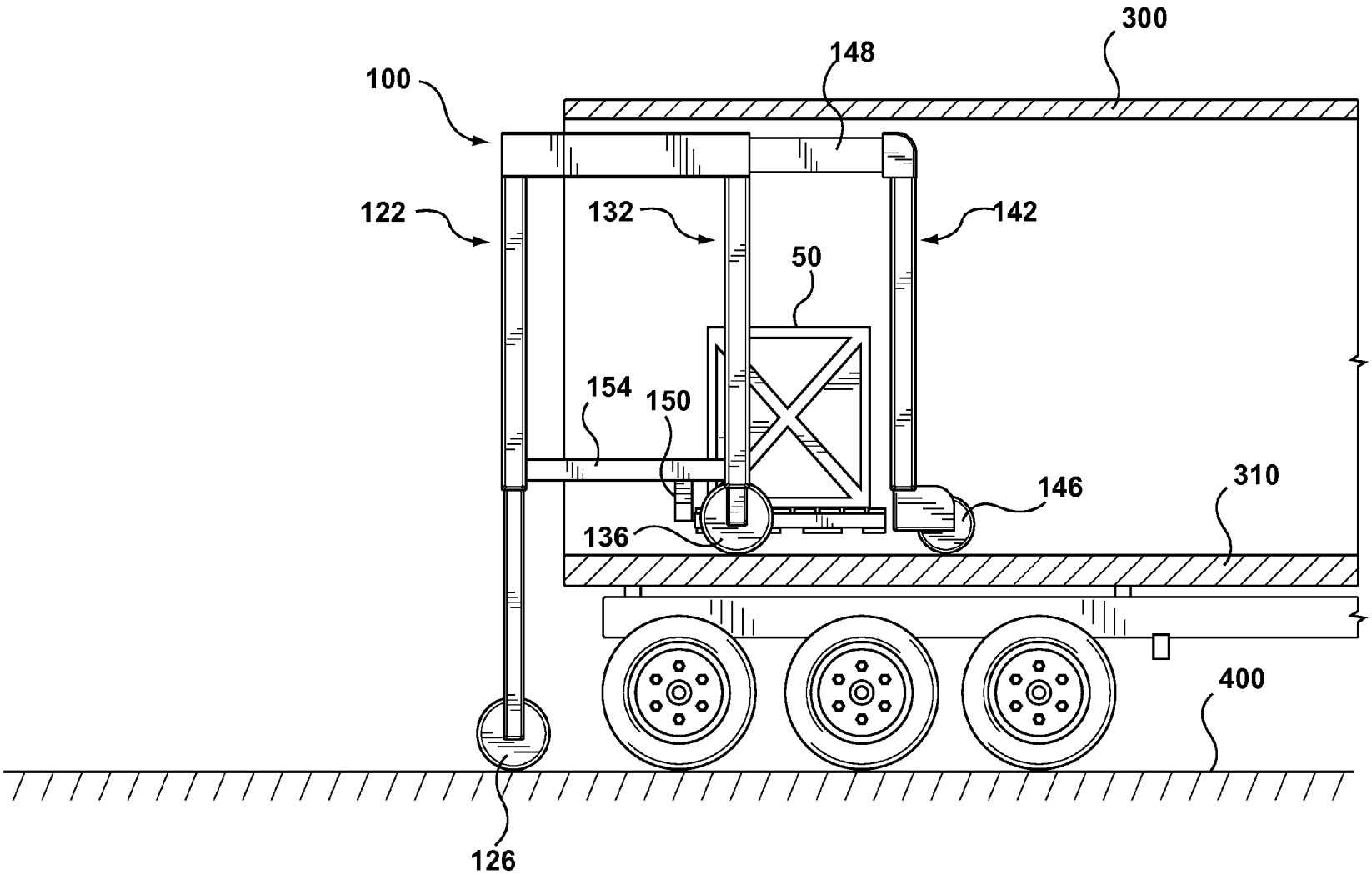

Referring to FIG. 8G, the load support member 150 (and thus load 50) is advanced forwardly, preferably until the center of gravity of load 50 is located forward of the middle axis 138 (see also e.g. FIG. 1).

Figure 8H:
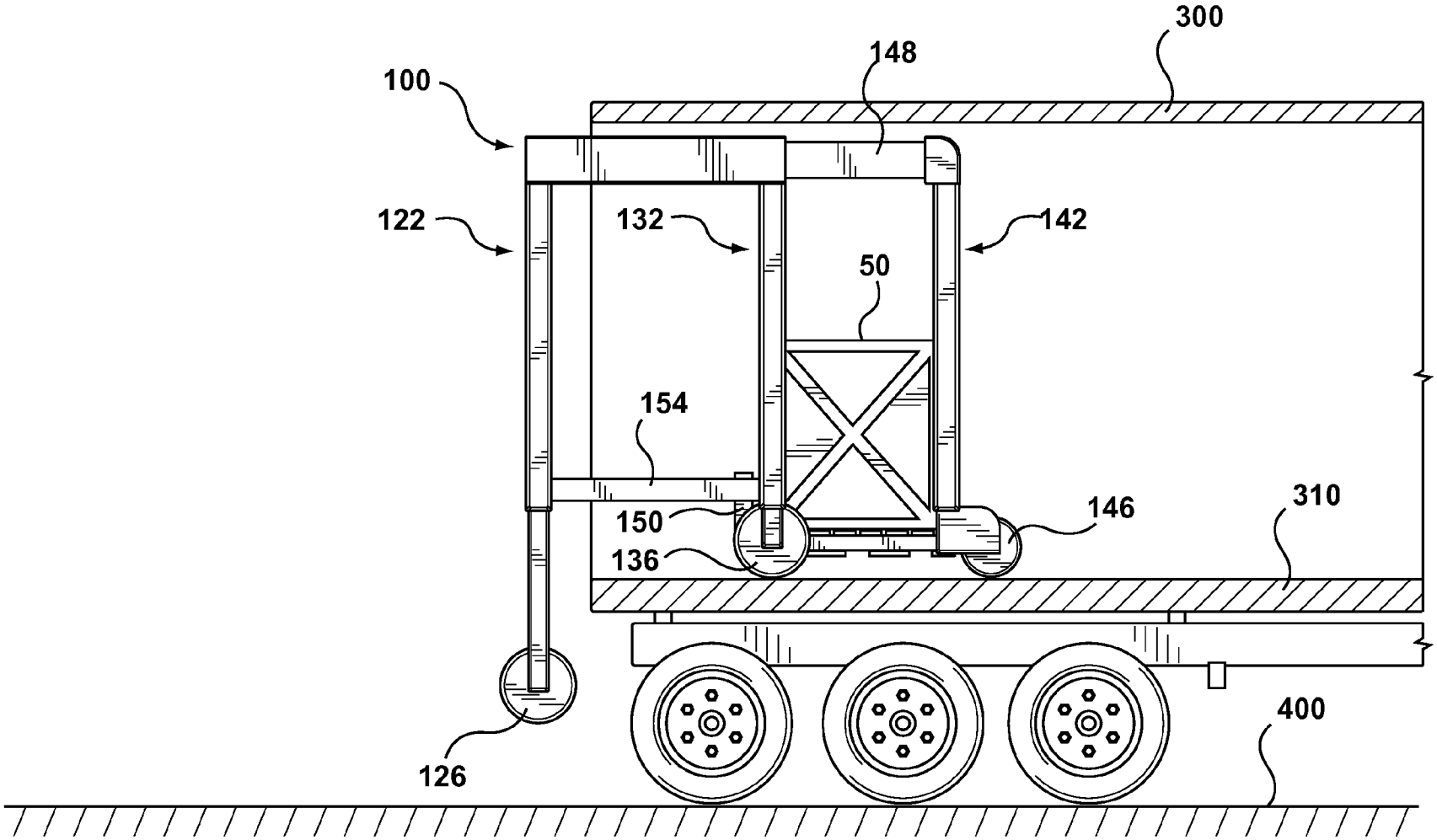
Figure 8I:
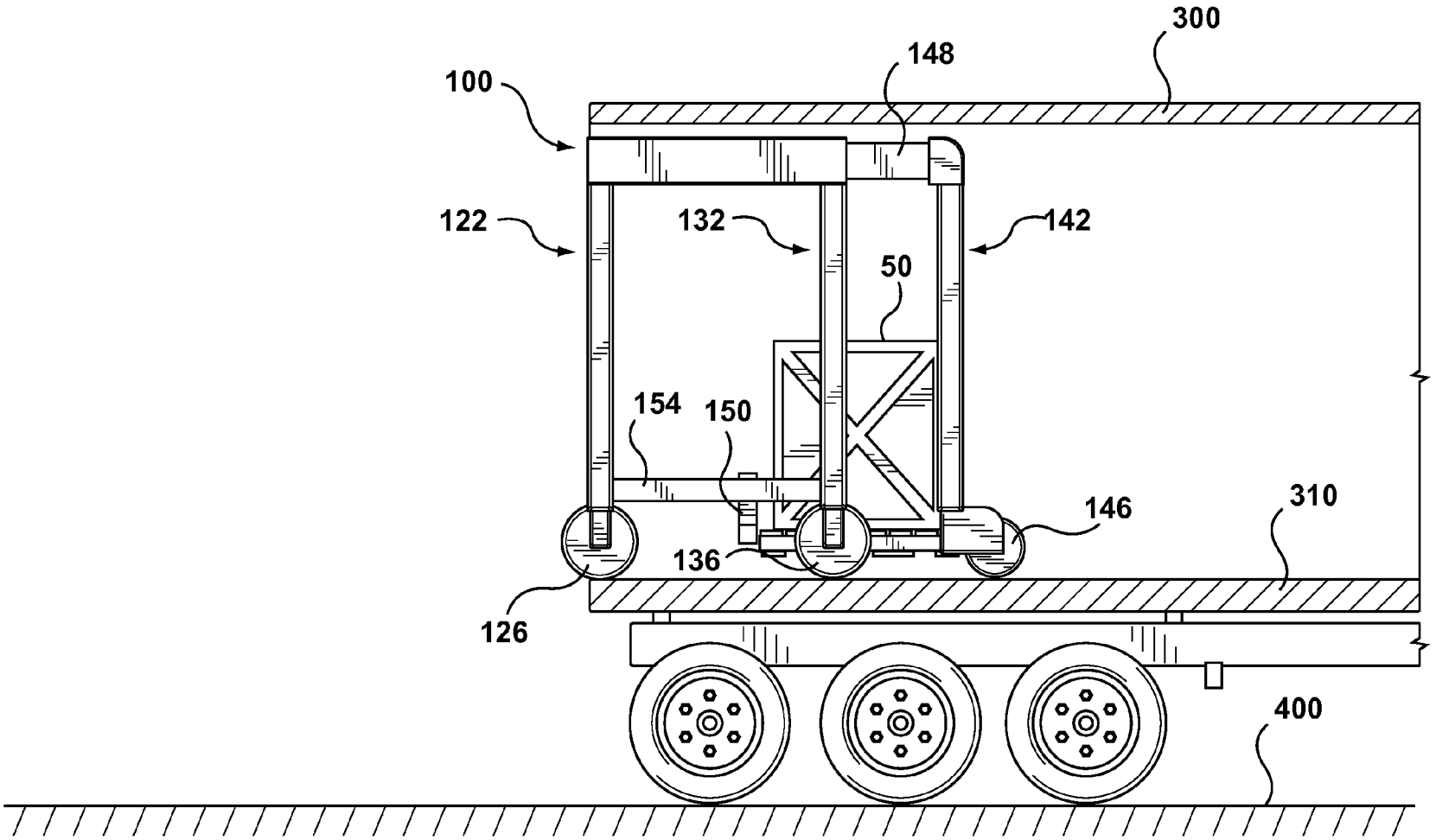

Referring to FIGS. 8H and 8I, the rear wheels 126*a-b* are then raised towards frame 110 so that rear wheels 126*a-b* are at or above the height of the raised surface 310, apparatus 100 is advanced forwardly—e.g. by retracting front wheel assembly 140 towards frame 110 while brakes associated with front wheels 146*a-b* (not shown) are engaged, effectively drawing frame 110 towards front wheel assembly 140—and then the rear wheels 126*a-b* are lowered (if necessary) so that rear wheels 126*a-b* are in contact with raised surface 310.

Figure 8J:
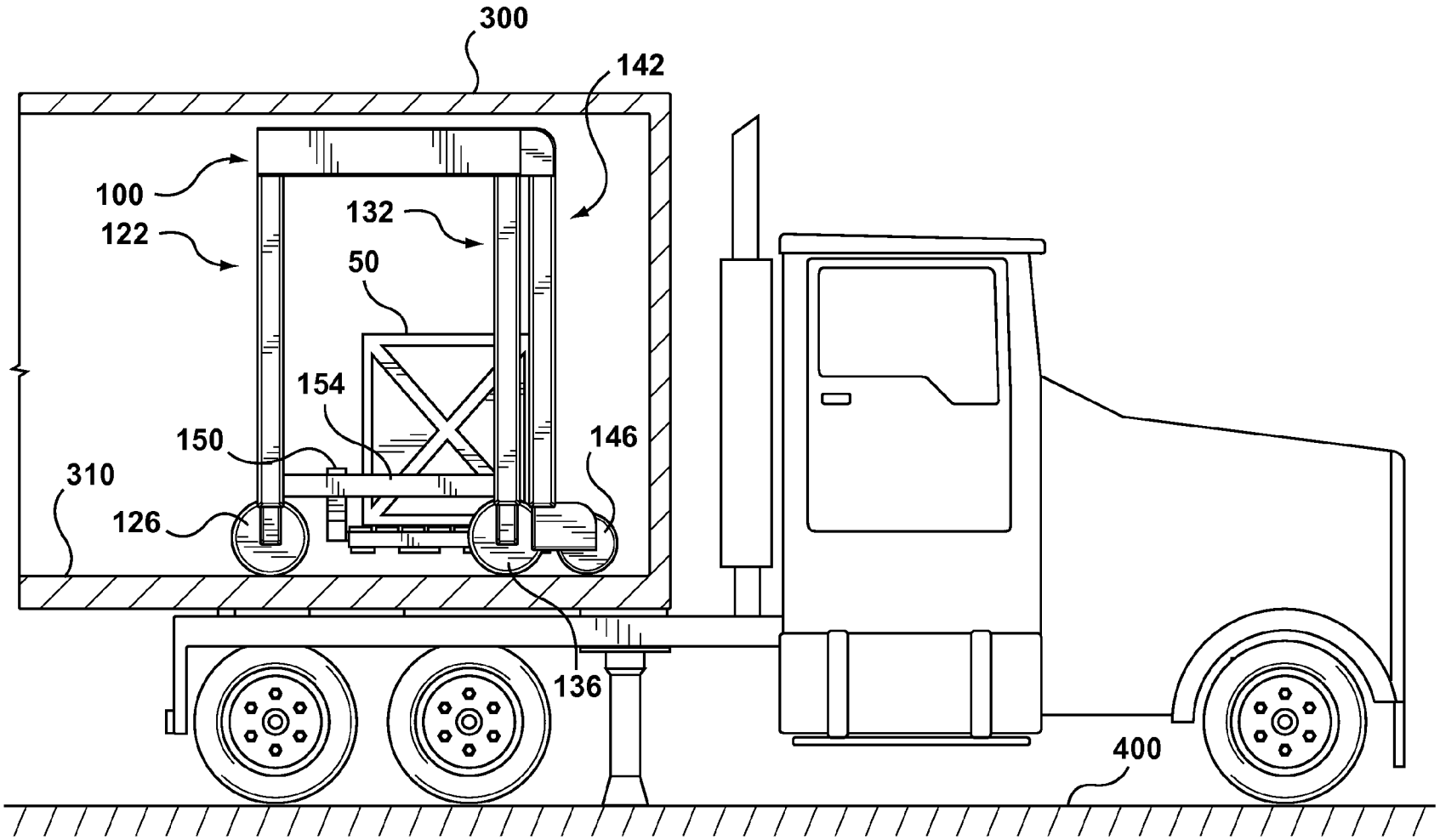
Figure 8K:
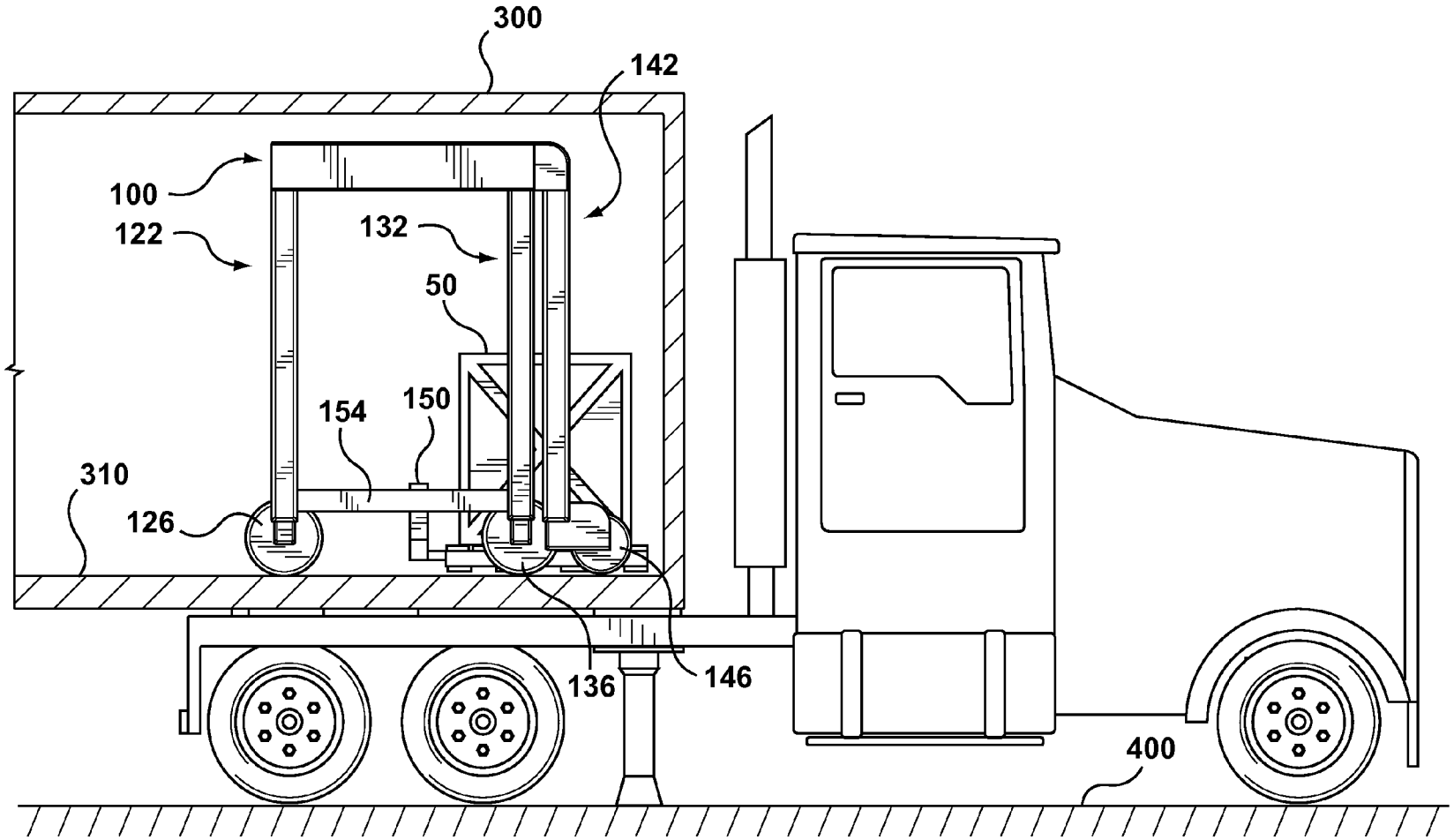
Figure 8L:
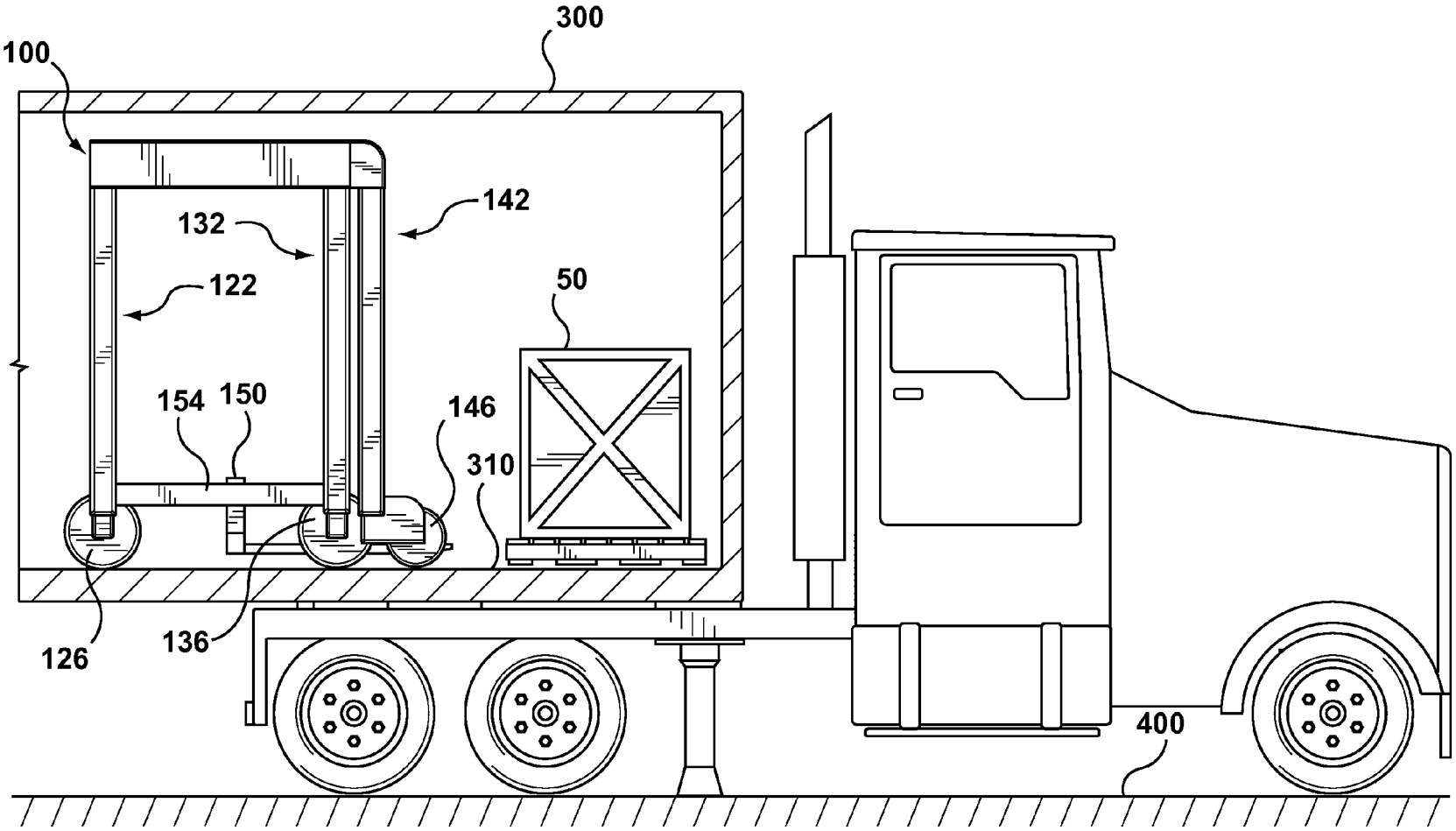

Referring to FIGS. 8J, 8K, and 8L, apparatus 100 may then traverse the raised surface 310, e.g. to the front of the cargo trailer 300, where load 50 may be deposited onto the raised surface 310 by apparatus 100.

The operation of the apparatus 100 in connection with transporting a load 50 from a raised surface will now be described with reference to FIGS. 9A-I.

Figure 9A:
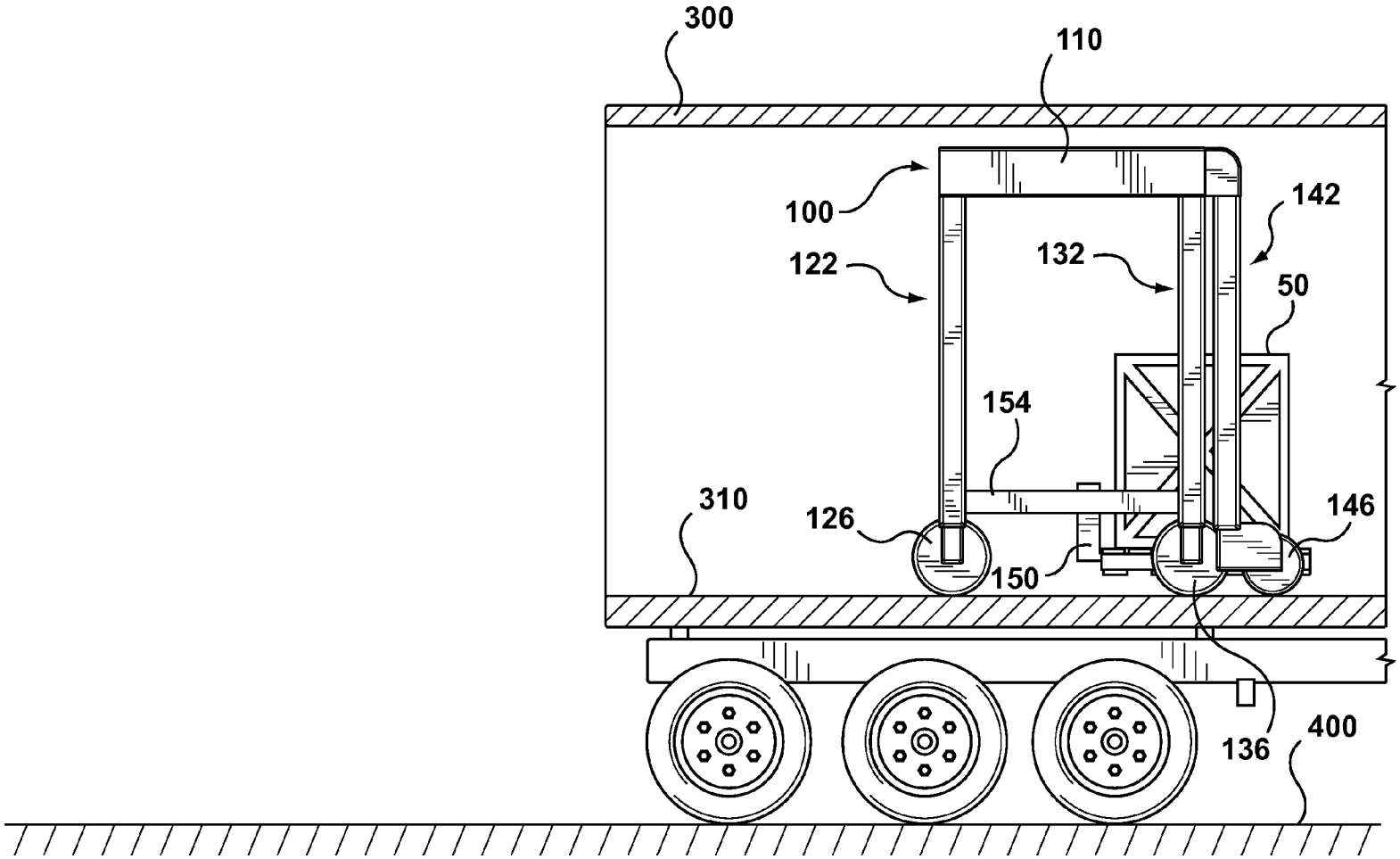

Referring to FIG. 9A, apparatus 100 is shown with the front wheels 146*a-b* raised slightly, and with the load support member 150 positioned such the center of gravity of load 50 is positioned between the rear wheels 126*a-b* and middle wheels 136*a-b*.

Figure 9B:
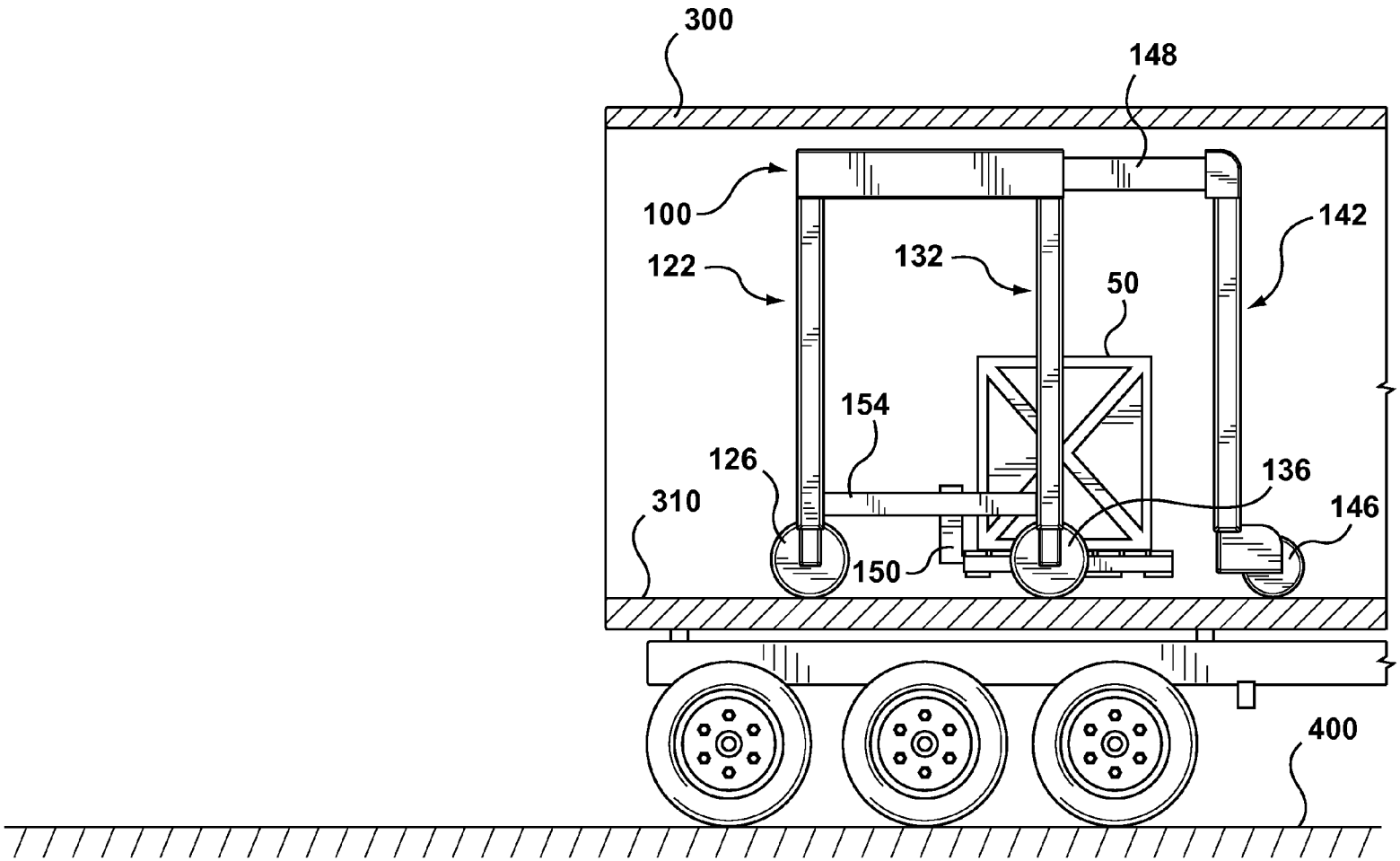

Referring to FIG. 9B, the front wheel assembly 140 is then extended outwardly from the frame 110, and the front wheels 146*a-b* are brought into contact with the raised surface 310. It will be appreciated that the front wheel assembly 140 may be extended with or without the front wheels 146*a-b* being in contact with the raised surface, and then (if necessary) the front wheels 146*a-b* may be lowered to contact the raised surface.

Figure 9C:
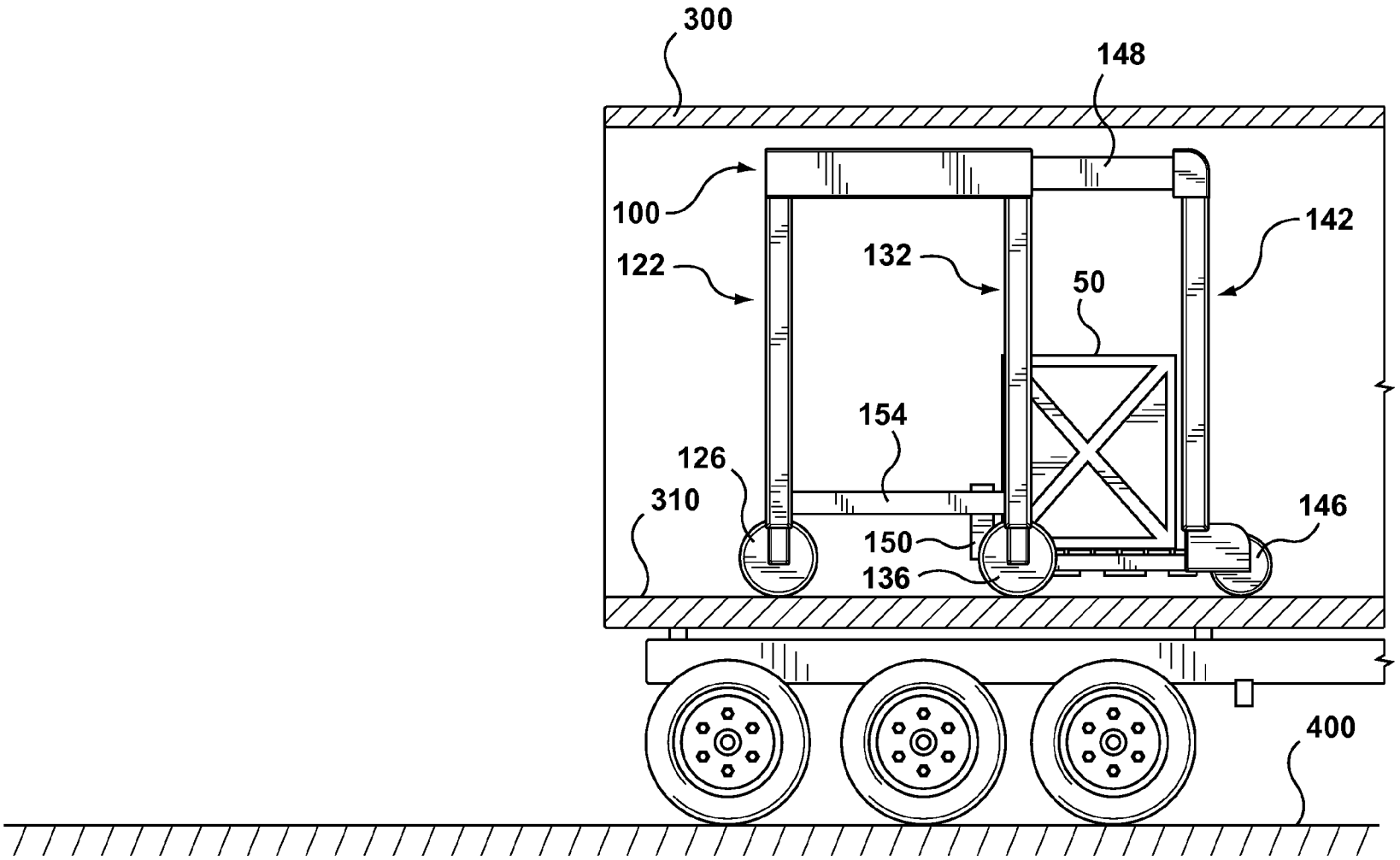

Referring to FIG. 9C, the load support member 150 (and thus load 50) is advanced towards the front wheel assembly 140, preferably until the center of gravity of load 50 is located forward of the middle axis 138.

Figure 9D:
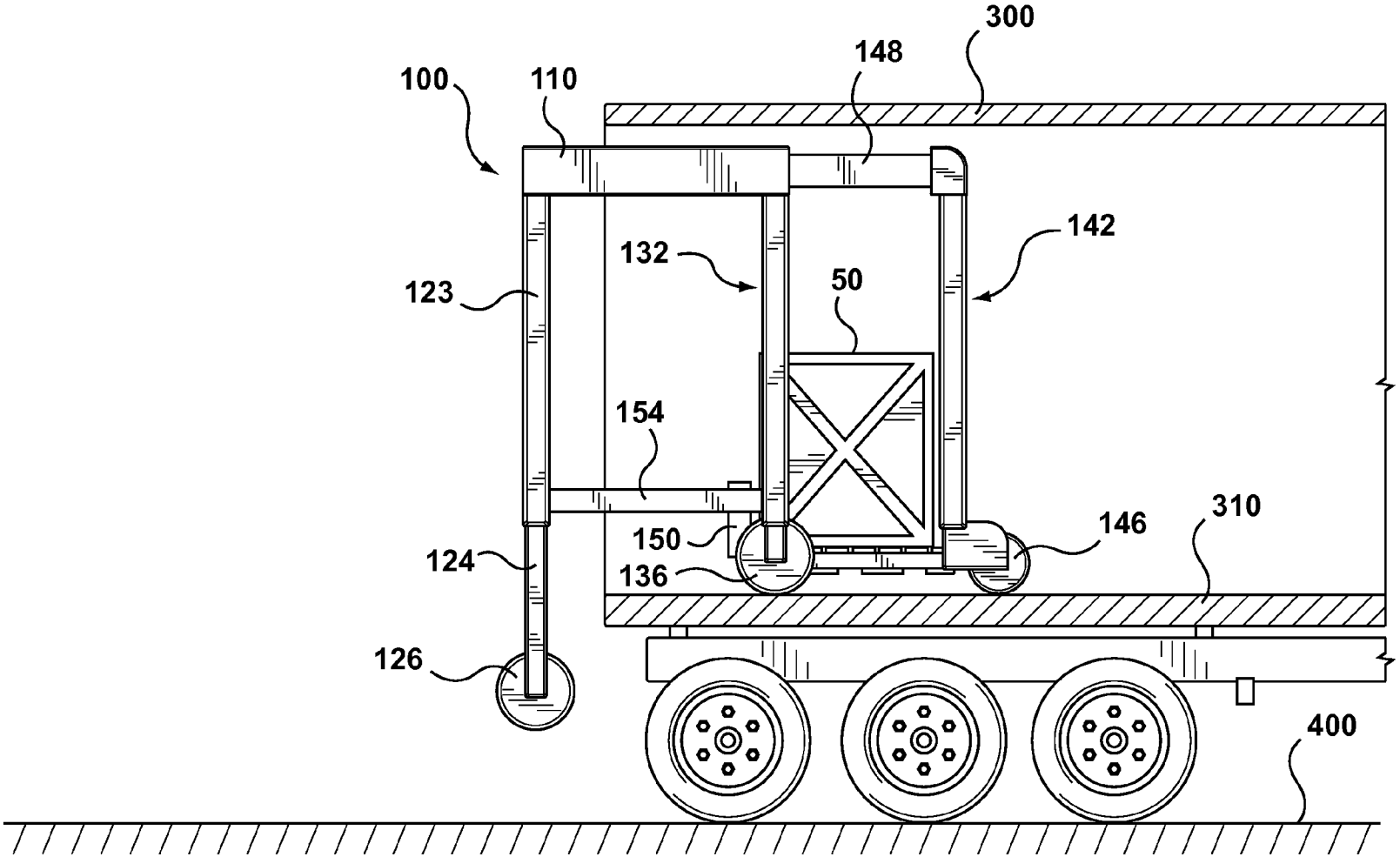

Referring to FIG. 9D, apparatus 100 is then advanced towards the edge of raised surface 310 until the rear wheels 126*a-b* are clear of the raised surface, and then the rear wheels 126*a-b* are lowered onto the ground surface 400.

Figure 9E:
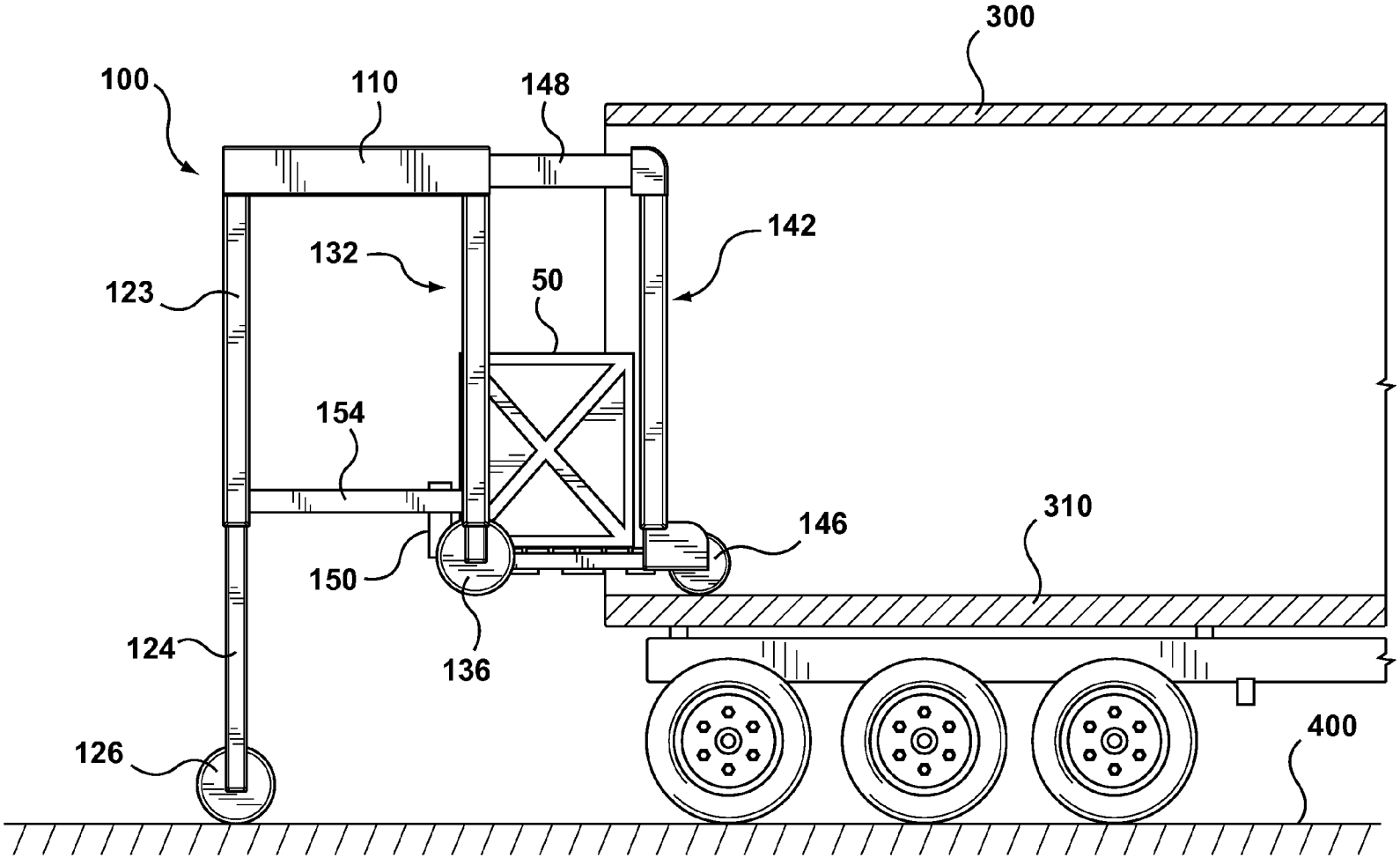
Figure 9F:
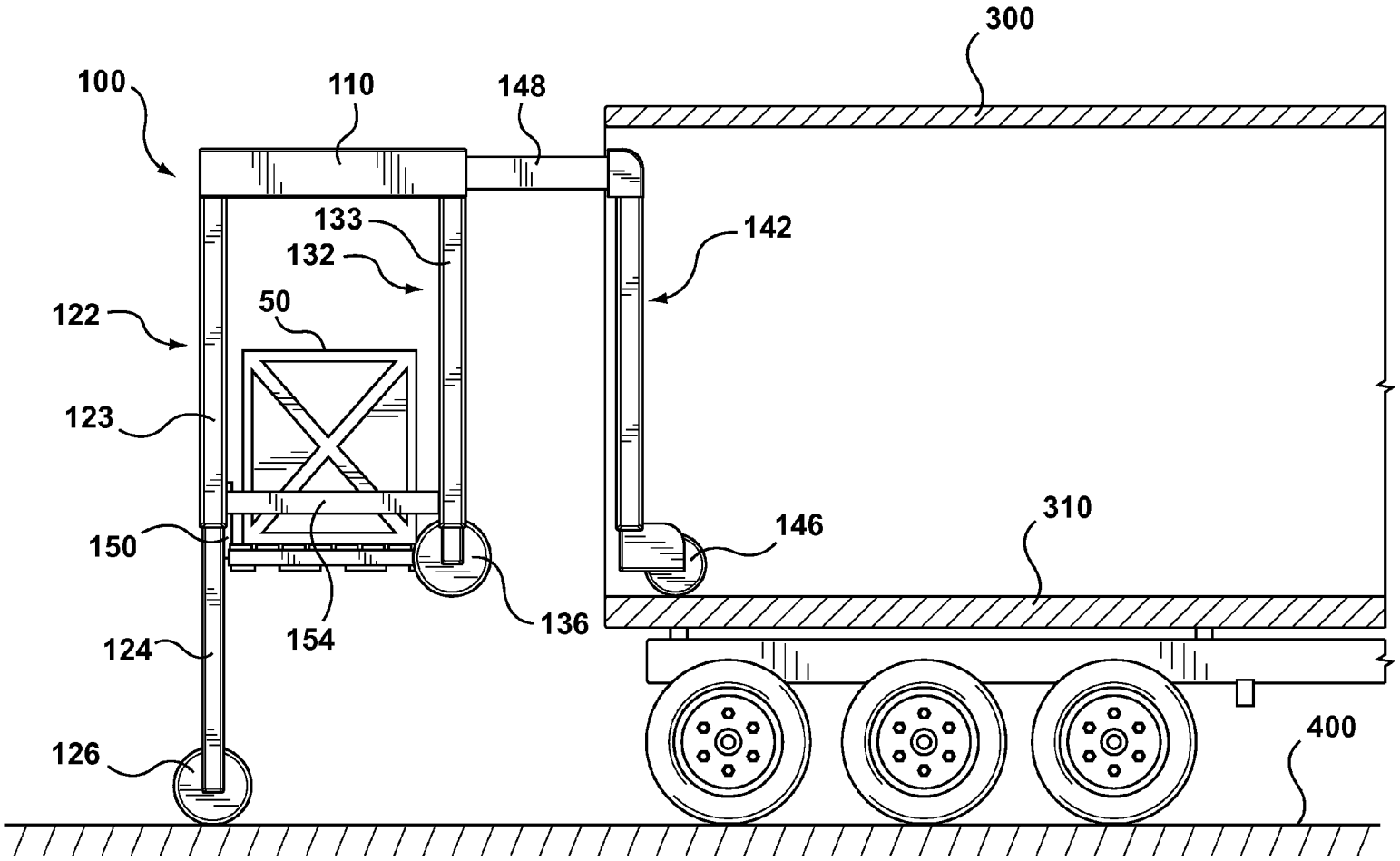
Figure 9G:
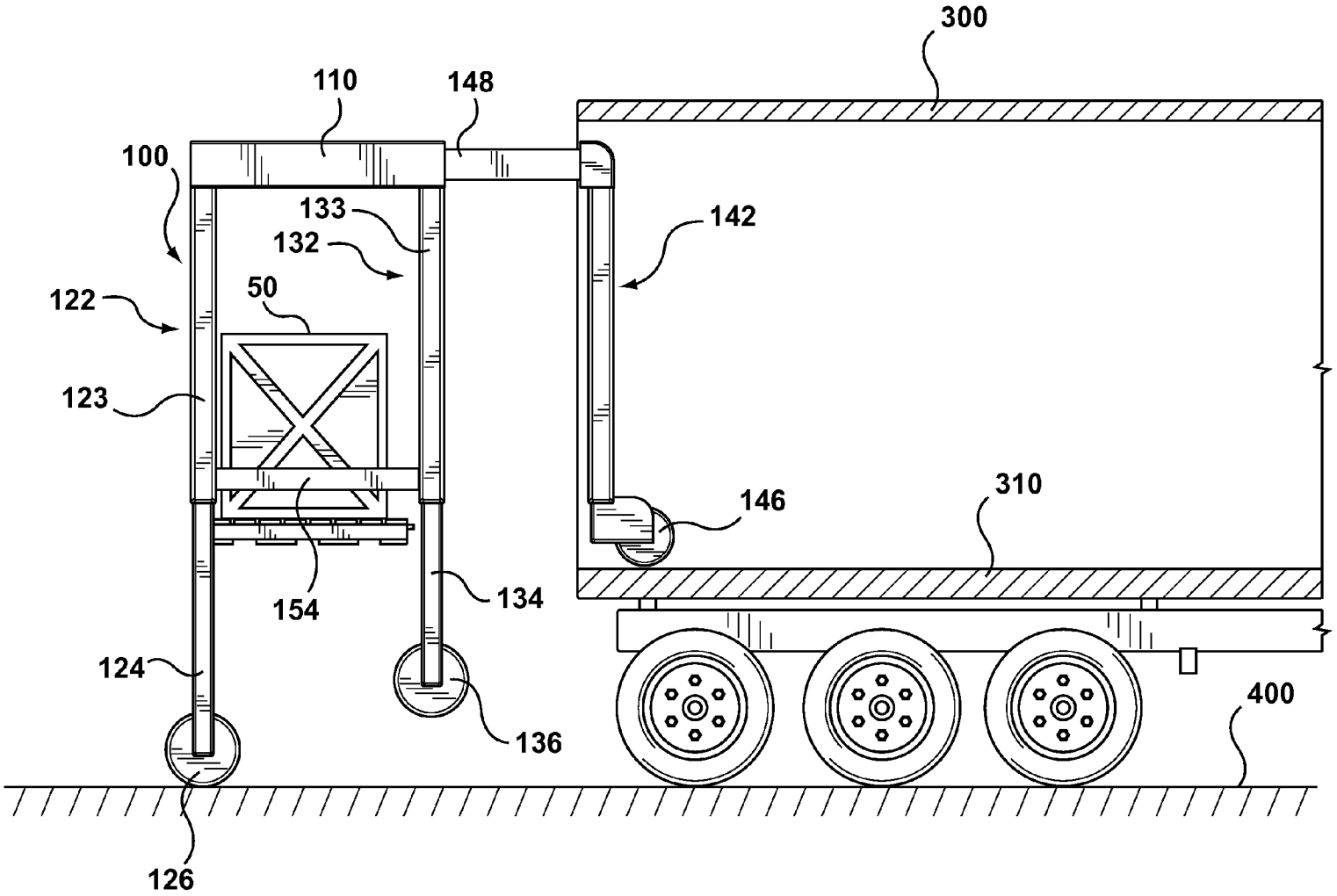

Referring to FIGS. 9E and 9F, apparatus 100 is then advanced until the middle wheels 136*a-b* are clear of the raised surface, then the load support member 150 (and thus load 50) is advanced towards the rear wheel assembly 120, preferably until the center of gravity of load 50 is located rearward of the middle axis 138, and then the middle wheels 136*a-b* are lowered onto the ground surface 400, as shown in FIG. 9G. It will be appreciated that alternatively, the middle wheels 136*a-b* may be lowered onto the ground surface 400 prior to the load support member 150 (and thus load 50) being advanced towards the rear wheel assembly 120.

Figure 9H:
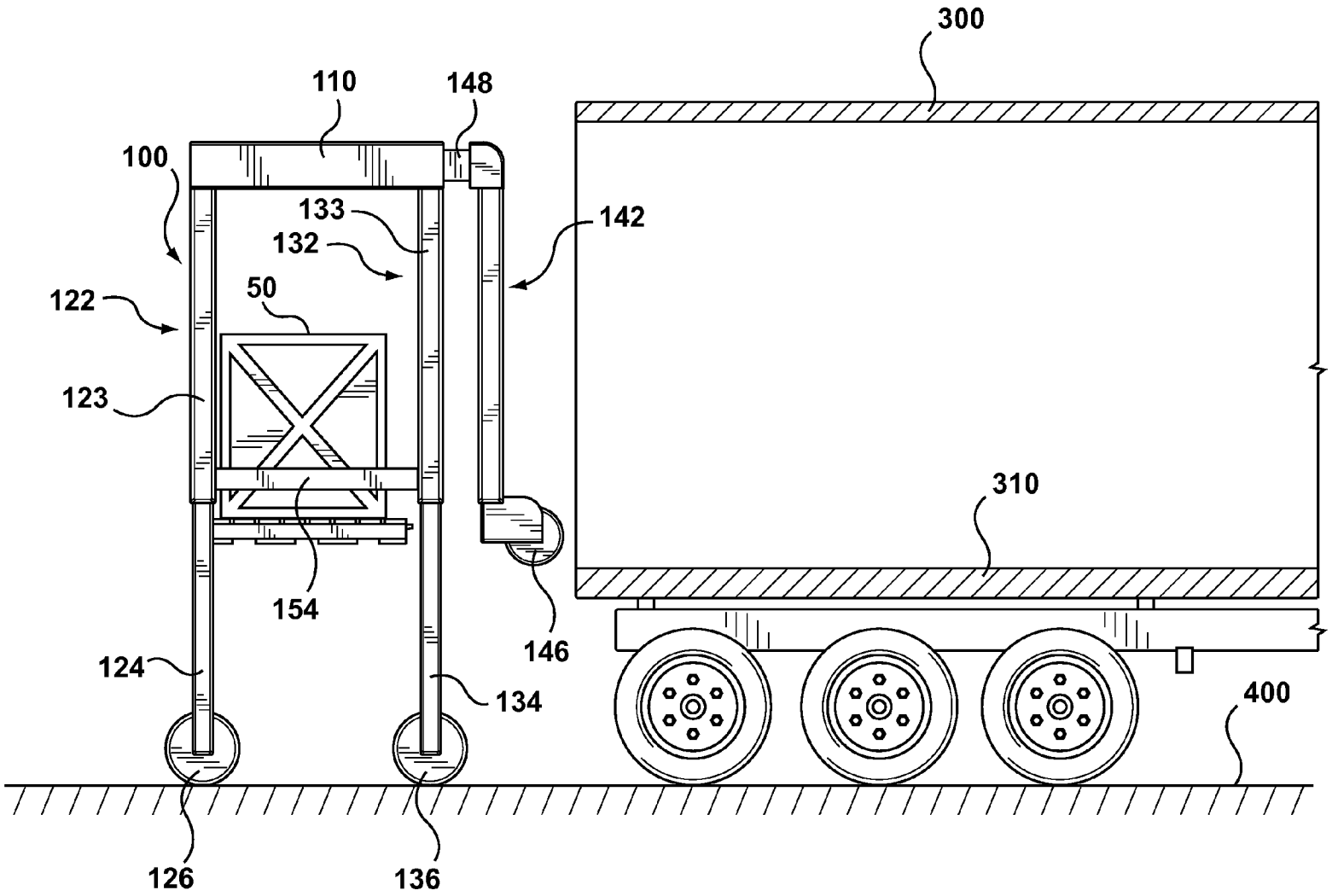
Figure 9I:
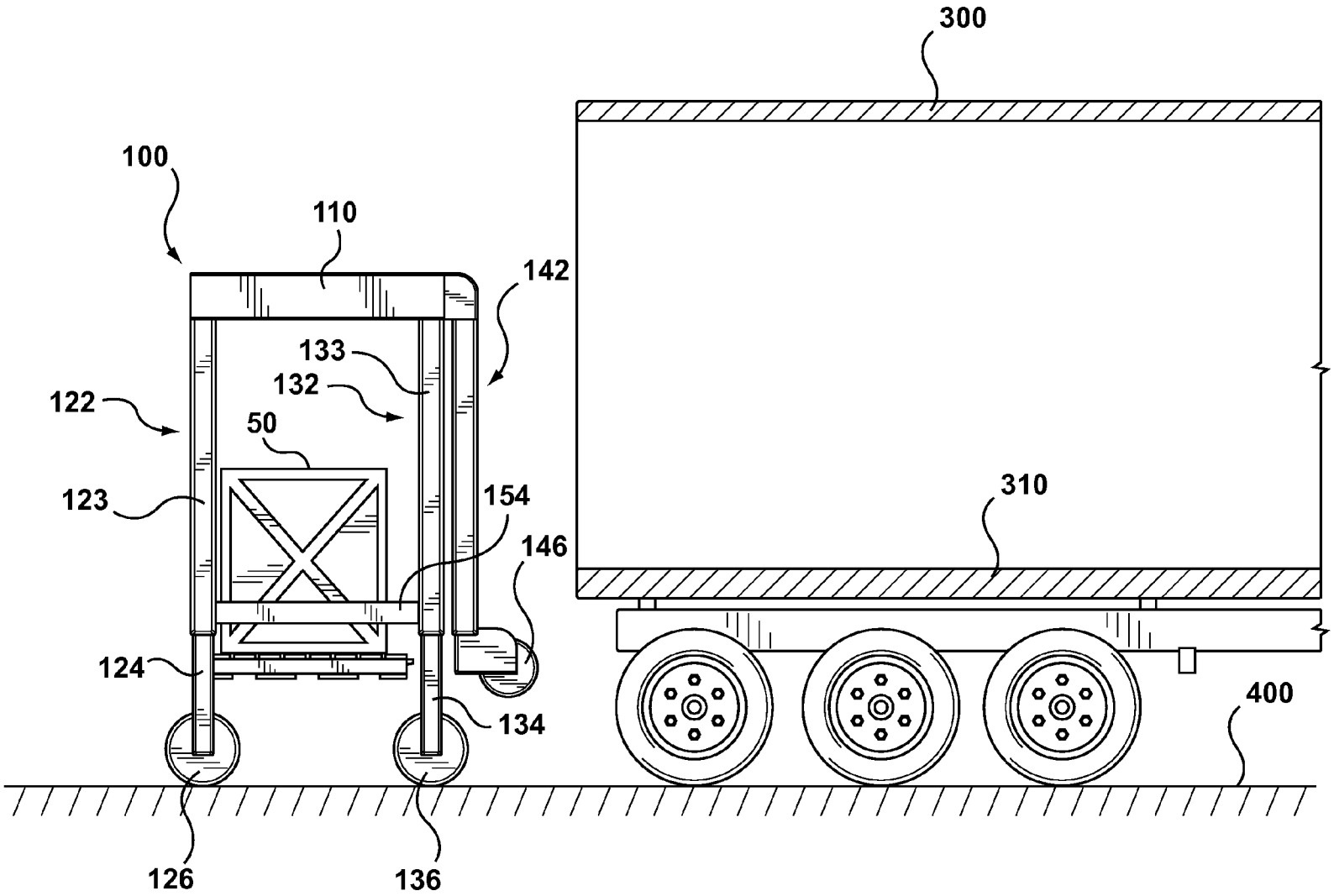

Referring to FIGS. 9H and 9I, once the rear wheels 126*a-b* and the middle wheels 136*a-b* are in contact with the ground surface 400 and the load support member 150 (and thus load 50) has been advanced towards the rear wheel assembly 120 until the center of gravity of load 50 is located rearward of the middle axis 138 (see e.g. FIG. 1), the front wheel assembly 140 may be retracted towards the frame 110, the rear legs 122*a-b* and the middle legs 132*a-b* may then retract, bringing rear wheels 126*a-b* and middle wheels 136*a-b* towards the frame 110, lowering apparatus 100.

FIGS. 10 to 16 show an apparatus 200 according to an alternative embodiment that can be used to transport a load onto a raised surface. Referring to FIGS. 10 to 14, the apparatus 200 includes an upper frame 210, an adjustable rear wheel assembly 220, a support rear wheel assembly 230, an adjustable front wheel assembly 240, and a support front wheel assembly 250 for supporting the frame 210, and a load support member 260 for supporting a load that is to be transported by the apparatus 200.

Adjustable rear wheel assembly 220 (identified by part numbers 220*a* and 220*b*) is coupled to the upper frame 210 and includes adjustable rear legs 222*a* and 222*b*. A rear wheel 226*a* is coupled to the end of adjustable rear leg 222*a*, and a rear wheel 226*b* is coupled to the end of adjustable rear leg 222*b*. When in contact with a surface, rear wheels 226*a-b* support the upper frame 210 via rear legs 222*a-b* so that apparatus 200 can roll on the surface. Also, rear wheels 226*a-b* define a rear axis 228 that passes through the center of rotation of the rear wheels 226*a,b*.

While a pair of adjustable rear legs 222*a-b* are shown, it will be appreciated that more (or fewer) adjustable rear legs may be provided as part of adjustable rear wheel assembly 220. Also, while each adjustable rear leg is shown as having one rear wheel 226*a-b*, it will be appreciated that each adjustable rear leg may have more than one rear wheel coupled thereto. The number of adjustable rear legs and/or the number of rear wheels coupled to each adjustable rear leg may be selected based on, for example, the expected mass of a load to be transported by apparatus 200, the type of surface apparatus 200 is expected to traverse (e.g. asphalt, concrete, gravel, etc.), and/or the rated power output of a motor used to drive these rear wheels (where provided).

Adjustable rear wheel assembly 220 also includes at least one rear actuator configured to raise and lower the rear wheels 226*a-b*. As shown in FIGS. 13-15, adjustable rear leg 222*a* includes an upper adjustable rear leg 223*a* and a lower adjustable rear leg 224*a*, and adjustable rear leg 222*b* includes an upper adjustable rear leg 223*b* and a lower adjustable rear leg 224*b*. Each upper adjustable rear leg 223*a-b* has an upper end coupled to the frame 210, and each lower adjustable rear leg 224*a-b* has an upper end coupled to its respective upper adjustable rear leg 223*a-b*. Rear wheels 226*a-b* are coupled to a lower end of each lower adjustable rear leg 224*a-b*. In operation, the rear actuator (e.g. a worm drive driven by an electric motor, a hydraulic drive system, a pneumatic drive system) is operable to displace lower adjustable rear legs 224*a-b* relative to their respective upper adjustable rear leg 223*a-b*, causing the rear wheels 226*a-b* to be raised (see e.g. FIGS. 10 and 11) and lowered (see e.g. FIGS. 12 and 13) relative to the upper frame 210.

As shown, the upper adjustable rear legs 223*a-b* are hollow members, and the lower adjustable rear legs 224*a-b* are configured for telescoping movement within the hollow upper adjustable rear legs. It will be appreciated that other configurations of upper and lower adjustable rear legs may be possible (e.g. a scissor mechanism). Also, while an upper adjustable rear leg 223 and a lower adjustable rear leg 224 are shown, it will be appreciated that an adjustable rear leg may include additional leg members, e.g. to provide multi-stage telescopic extension of the adjustable rear leg.

FIG. 16 illustrates an example actuator 270 for displacing a lower adjustable rear leg 224 relative to its respective upper adjustable rear leg 223. Actuator 270 is a hydraulically driven actuator, and includes a hydraulic cylinder 271 coupled to upper adjustable rear leg 223, and a hydraulic piston 272 coupled to lower adjustable rear leg 224. Hydraulic fluid is introduced into/removed from the hydraulic cylinder 271 in a conventional manner via one or more control valves 273 in order to extend/retract the hydraulic piston 272 relative to the hydraulic cylinder 271, thereby extending/retracting lower adjustable rear leg 224 relative to upper adjustable rear leg 223. The hydraulic fluid for the actuator 270 may be supplied by a central hydraulic system (including e.g. a central fluid reservoir, fluid pump, fluid filter, control valve, etc.) via one or more fluid ports 274, or alternatively the actuator 270 may be provided with its own hydraulic system. It will be appreciated that other suitable hydraulic system topologies may be used in alternative configurations.

Returning to FIGS. 10-11, adjustable front wheel assembly 240 (identified by part numbers 240*a* and 240*b*) is coupled to the upper frame 210 and includes adjustable front legs 242*a* and 242*b*. A front wheel 246*a* is coupled to the end of adjustable front leg 242*a*, and a front wheel 246*b* is coupled to the end of adjustable front leg 242*b*. When in contact with a surface, front wheels 246*a-b* support the upper frame 210 via adjustable front legs 242*a-b* so that apparatus 200 can rollingly traverse the surface. Also, front wheels 246*a-b* define a front axis 248 that passes through the center of rotation of the front wheels 246*a-b*.

While a pair of adjustable front legs 242*a-b* are shown, it will be appreciated that more (or fewer) adjustable front legs may be provided as part of adjustable front wheel assembly 240. Also, while each adjustable front leg is shown as having one front wheel 246*a-b*, it will be appreciated that each adjustable front leg may have more than one front wheel coupled thereto. The number of adjustable front legs and/or the number of front wheels may be selected based on, for example, the expected mass of a load to be transported by apparatus 200, the type of surface apparatus 200 is expected to traverse (e.g. asphalt, concrete, gravel, etc.), and/or the rated power output of a motor used to drive these front wheels (where provided).

Adjustable front wheel assembly 240 also includes at least one front actuator configured to raise and lower the front wheels 246*a-b*. As shown in FIGS. 13-15, adjustable front leg 242*a* includes an upper adjustable front leg 243*a* and a lower adjustable front leg 244*a*, and adjustable front leg 242*b* includes an upper adjustable front leg 243*b* and a lower adjustable front leg 244*b*. Each upper adjustable front leg 243*a-b* has an upper end coupled to the frame, and each lower adjustable front leg 244*a-b* has an upper end coupled to its respective upper adjustable front leg 243*a-b*. Front wheels 246*a-b* are coupled to a lower end of each lower adjustable front leg 244*a-b*. In operation, the front actuator (e.g. a worm drive driven by an electric motor, a hydraulic drive system, a pneumatic drive system) is operable to displace lower adjustable front legs 244*a-b* relative to their respective upper adjustable front leg 243*a-b*, causing the front wheels 246*a-b* to be raised (see e.g. FIGS. 10 and 11) and lowered (see e.g. FIGS. 12 and 14) relative to the frame 210.

As shown, the upper adjustable front legs 243*a-b* are hollow members, and the lower adjustable front legs 244*a-b* are configured for telescoping movement within the hollow upper adjustable front legs. Actuator 270 shown in FIG. 16 and discussed above with respect to the adjustable rear legs may also be used with the adjustable front legs. It will be appreciated that other configurations of upper and lower adjustable front legs may be possible (e.g. a scissor mechanism). Also, while an upper adjustable front leg 243 and a lower adjustable front leg 244 are shown, it will be appreciated that an adjustable front leg may include additional leg members, e.g. to provide multi-stage telescopic extension of the adjustable front leg.

Apparatus 200 also has one or more lower frame members 254. In the embodiment illustrated in FIGS. 10 to 16, a pair of lower frame members 254*a-b* are provided on apparatus 200. Lower frame member 254*a* extends between upper adjustable rear leg 223*a* and upper adjustable front leg 243*a*, and lower frame member 254*b* extends between upper adjustable rear leg 223*b* and upper adjustable front leg 243*b*. While preferably, lower frame members 254*a-b* are coupled to and extend between the upper adjustable front and rear legs, it will be appreciated that other configurations and/or locations for the lower frame members are possible; for example, a lower frame member may be mounted to and extend between an upper adjustable rear leg and a fixed front wheel assembly 250, as will be discussed further below.

Support rear wheel assembly 230 is coupled to the lower frame members 254 and includes rear support legs 232*a* and 232*b*. A rear support wheel 236*a* is coupled to the end of rear support leg 232*a*, and a rear support wheel 236*b* is coupled to the end of rear support leg 232*b*. When in contact with a surface, rear support wheels 236*a-b* support the frame 210 via rear support legs 232*a-b* so that apparatus 200 can rollingly traverse the surface. Also, rear support wheels 236*a-b* define a rear support axis 238 that passes through the center of rotation of the rear support wheels 236*a-b*.

While a pair of rear support legs 232*a-b* are shown, it will be appreciated that more (or fewer) rear support legs may be provided as part of fixed rear wheel assembly 230. For example, a rear support wheel 236 may be coupled directly to a lower frame member. Also, while each rear support leg is shown as having one rear support wheel 236*a-b*, it will be appreciated that each rear support leg may have more than one rear wheel coupled thereto. The number of rear support legs and/or the number of rear support wheels may be selected based on, for example, the expected mass of a load to be transported by apparatus 200, the type of surface apparatus 200 is expected to traverse (e.g. asphalt, concrete, gravel, etc.), and/or the rated power output of a motor used to drive these rear wheels (where provided).

Apparatus 200 also has a support front wheel assembly 250. In the embodiment illustrated in FIGS. 10 to 16, support front wheel assembly 250 includes includes front support legs 252*a* and 252*b*. A front support wheel 256*a* is coupled to the end of front support leg 252*a*, and a front support wheel 256*b* is coupled to the end of front support leg 252*b*. When in contact with a surface, front support wheels 256*a-b* support the frame 210 via front support legs 252*a-b* so that apparatus 200 can roll on the surface. Also, front support wheels 256*a-b* define a front support axis 258 that passes through the center of rotation of the front support wheels 256*a-b*.

While a pair of front support legs 252*a-b* are shown, it will be appreciated that more (or fewer) front support legs may be provided as part of support front wheel assembly 250. Also, while each front support leg is shown as having one front support wheel 256*a-b*, it will be appreciated that each front support leg may have more than one front support wheel coupled thereto. The number of front support legs and/or the number of front support wheels may be selected based on, for example, the expected mass of a load to be transported by apparatus 200, the type of surface apparatus 200 is expected to traverse (e.g. asphalt, concrete, gravel, etc.), and/or the rated power output of a motor used to drive these front wheels (where provided).

In the illustrated embodiment, front support legs 252*a-b* are coupled to and extend downwardly and forwardly from the upper adjustable front legs. It will be appreciated that other configurations and/or locations for the front support legs are possible; for example, the front support legs may be mounted to and extend from upper frame 210. As another alternative example, a portion of the lower frame members may extend forward of the upper adjustable front legs, and one or more front support legs may extend downwardly from these forward portions.

In order to assist in transporting the load using apparatus 200, one or more of rear wheels 226*a-b*, rear support wheels 236*a-b*, front wheels 246*a-b*, and/or front support wheels 256*a-b* may be driven by one or more motors 280 coupled to apparatus 200, so that apparatus 200 may be able to propel itself across a surface. For example, one or more motors 280 may be provided at an upper portion of one or more of the legs (or at the frame 210) and transfer power to one or more of the front, and/or rear wheels through e.g. a splined shaft located inside a leg. Alternatively or additionally, one or more motors may be provided at a lower portion of one or more of the legs to drive one or more of the front and/or rear wheels directly. Alternatively or additionally, wheel hub motors may be coupled to one or more of the wheels. Any suitable motor type may be used (e.g. hydraulic motors, electric motors, internal combustion engines, and the like) to propel the apparatus.

FIG. 16 illustrates an example motor and transmission arrangement for driving a rear wheel 226. In this example, a hydraulic motor 280 is provided at the upper end of upper adjustable front leg 242. The hydraulic motor 280 is coupled to a telescopic splined shaft 282. Telescopic splined shaft 282 includes an inner splined shaft member 283, and an outer splined shaft member 284. The inner splined shaft member 283 can be displaced axially relative to the outer splined shaft member 284, so that the distance between an upper end of the outer splined shaft member 284 and a lower end of the inner splined shaft member 283 can be increased or decreased, while the splines allow a torque applied to one of the splined shaft members to be transferred to the other splined shaft member.

In the illustrated example, the outer splined shaft member 284 is coupled to the hydraulic motor 280, and the inner splined shaft member 283 is coupled to a worm 287 of a geartrain 286 housed in a gearbox 285. The worm 287 meshes with worm gear 288, which in turn drives rear wheel 226. In this way, when the outer splined shaft member 284 is rotated by the hydraulic motor 280, rear wheel 226 is rotated, providing propulsion to the apparatus 200. It will be appreciated that other motor and transmission arrangements may be used in alternative configurations.

Returning to FIGS. 10-11, in some embodiments one or more of rear wheels 226*a-b*, rear support wheels 236*a-b*, front wheels 246*a-b*, and/or front support wheels 256*a-b* may be selectively rotatable by one or more motors coupled to apparatus 200, so that apparatus 200 may be able to steer itself as it is being propelled. Alternatively or additionally, the speed of the motors driving the wheels to propel the apparatus may be independently adjustable to assist in steering. For example, the rear wheels 226*a-b* and/or front wheels 246*a-b* may be selectively driven at different speeds (and/or in different directions) to assist in turning.

Alternatively, or additionally, in some embodiments, one or more of rear wheels 226*a-b*, rear support wheels 236*a-b*, front wheels 246*a-b*, and/or front support wheels 256*a-b* may be freely rotatable (e.g. configured as swivel casters), for example where another of the rear wheels 226*a-b*, rear support wheels 236*a-b*, front wheels 246*a-b*, and/or front support wheels 256*a-b* are configured to propel and steer the apparatus.

With particular reference to FIGS. 10 and 15, load support member 260 is configured to engage and/or support a load to be transported using apparatus 200. For example, load support member 260 may include a backplate member 268, with one or more forks 262 extending forwardly therefrom which may be configured to engage a pallet. As can be seen in FIG. 10, apparatus 200 has four forks 262*a-d*, but it will be appreciated that more or fewer forks 262 may be provided on load support member 260.

Load support member 260 is preferably located below frame 210, so that a load being transported by apparatus 200 is supported in a position below frame 210. Advantageously, in this arrangement apparatus 200 may have the same overall height, whether or not is it transporting a load.

Also, load support member 260 is preferably dimensioned such that the load support member—and thus in most instances, the supported load—is located substantially within an area defined by the pair of rear adjustable legs 222*a-b*, the pair of front adjustable legs 242*a-b*, and the frame 210. Advantageously, in this arrangement apparatus 200 may have the same overall length and width, whether or not is it transporting a load.

In order to facilitate displacement of the load support member 260 between a raised and a lowered position, as shown in FIG. 15 load support member 260 may include one or more slide rails 264, and load support member 260 may be slidingly coupled to the slide rails. In the illustrated embodiment, a pair of load support slide rails 264*a-b* are coupled to the lateral ends of the backplate member 268 and to the upper rear legs 223. It will be appreciated that other configurations and/or locations for the load support tracks are possible; for example, load support slide rails may be additionally or alternatively coupled to one or more other parts of apparatus 200 (e.g. to a rear frame member (not shown) extending downwardly from the upper frame 210).

Load support member 260 may also include one or more load support actuators 266 configured to selectively move the load support member between a raised position and a lowered position. In operation, the load support actuator (e.g. a worm drive driven by an electric motor, a hydraulic drive system, a pneumatic drive system) is operable to move the backplate member 268 along the load support slide rails 264, causing the load support member to move between the raised position and the lowered position.

Returning to FIG. 10, components of a central hydraulic system 290 are positioned within the upper frame 210. It will be appreciated that any suitable hydraulic system topology may be used to actuate the various components of the apparatus as described herein, and that the components of central hydraulic system 290 may be positioned in any suitable location on apparatus 200. In the illustrated embodiment, the hydraulic system 290 comprises a hydraulic valve manifold 291 with a plurality of hydraulic valves 292, a hydraulic oil reservoir 293, and a hydraulic pump 294 driven by an electric motor 295. Alternatively, or additionally, a central pneumatic system may be provided to actuate the various components of the apparatus as described herein. For example, a central pneumatic system may comprise a pneumatic valve manifold, a pressurized air reservoir, and an air compressor driven by an electric motor.

In the illustrated embodiment, components of a central electrical control system 296 and an electrical power source 298 (e.g. a battery) are also positioned within the upper frame 210. It will be appreciated that any suitable electrical and/or control electronic systems may be used to power and/or control the apparatus as described herein, and that the components of central electrical control system 296 may be positioned in any suitable location on apparatus 200. Preferably, central electrical control system 296 comprises an electronic controller for selectively activating and/or deactivating one or more electrical components of apparatus 200, such as electric motors, solenoids, converters, etc. For example, the electronic controller may control the rotation speed and/or direction of the motor(s) that drive the wheels (e.g. rear wheels 226*a-b*, front wheels 246*a-b*, etc.) in order to control the motion of the apparatus across a surface. The electronic controller may communicate with the electrical components of apparatus 200 using any suitable wired or wireless protocol.

In some embodiments, central electrical control system 296 may comprise a communications module configured to establish a communication channel between the apparatus and remote device, e.g., a computing device, such as a laptop computer, tablet computing device, mobile communication device, remote server, etc. The communication channel may be established by the communication module using any suitable wired or wireless protocol, and may be configured as a personal area network (PAN), a point-to-point network, or any other suitable network topology. Wired communication may be conducted in accordance with Universal Serial Bus (USB) standards, and apparatus may be provided with a Standard, Mini, or Micro USB port (not shown). Examples of wireless communication include standards developed by the Infrared Data Association (IrDA), Near Field Communication (NFC), and the 803.11 family of standards developed by the Institute of Electrical and Electronics Engineers (IEEE). In some embodiments, a relatively short-range wireless communications protocol such as Bluetooth® or Wireless USB may be used.

The operation of the apparatus 200 in connection with transporting a load 50 onto a raised surface will now be described with reference to FIGS. 17A-J. The operation will be described in connection with the apparatus 200 entering a cargo trailer 300. However, it will be understood that the apparatus 200 may transport a load onto and from any other raised surface (either enclosed or not) in the same manner.

Figure 17A:
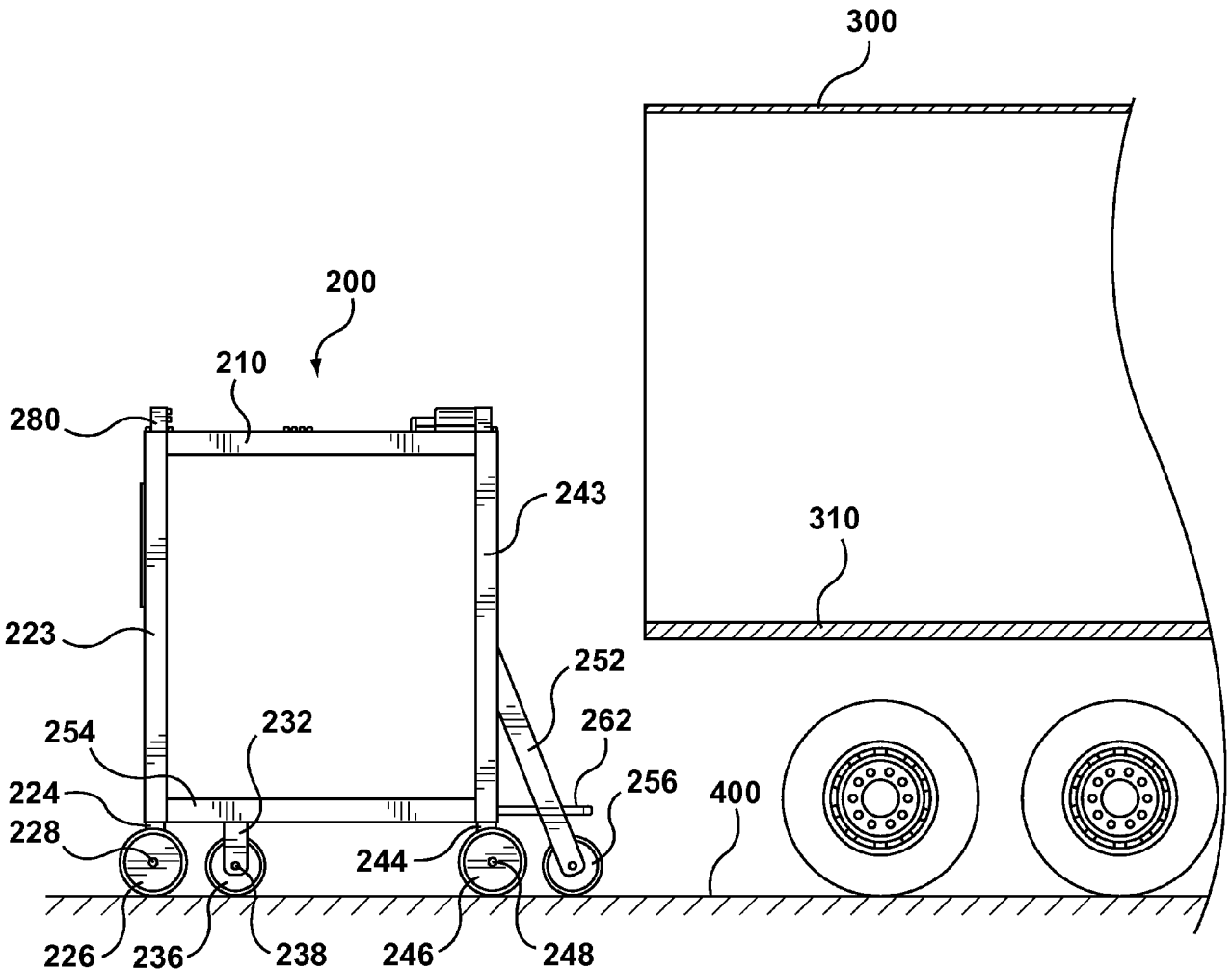

The apparatus 200 typically traverses a surface in the position shown in FIG. 17A. Preferably, the apparatus 200 is rollingly supported by rear wheels 226*a-b*, rear support wheels 236*a-b*, front wheels 246*a-b*, and front support wheels 256*a-b*, with at least the rear wheels 226*a-b* and front wheels 246*a-b* being driven by one or more motors so that apparatus 200 may be able to propel itself across a surface. Alternatively, the apparatus 200 may be rollingly supported by rear wheels 226*a-b* and front wheels 246*a-b*, with rear support wheels 236*a-b* and front support wheels 256*a-b* raised slightly so that they do not contact the ground surface. However, it will be appreciated that, in alternative embodiments, rear support wheels 236*a-b* and front support wheels 256*a-b* may also contact the ground surface 400 being traversed by apparatus 200.

When apparatus 200 is to be used to transport the load 50 onto a raised surface, such as the floor 310 of a cargo trailer 300, the apparatus 200 is first positioned in proximity of the raised surface 310.

Figure 17B:
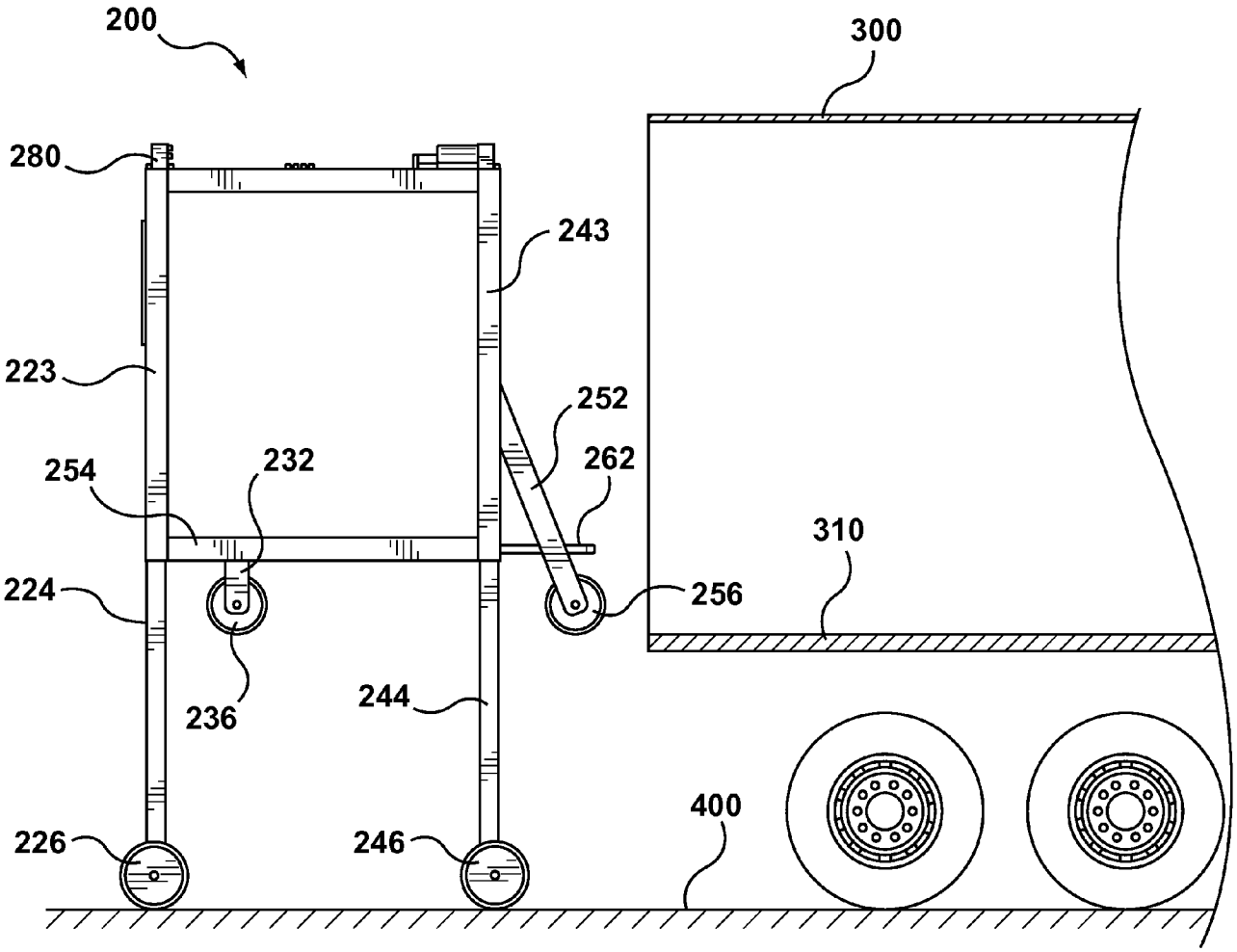

Referring to FIG. 17B, the adjustable rear legs 222*a-b* and the adjustable front legs 242*a-b* then extend to raise the apparatus 200 so that front support wheels 256*a-b* are at or above the height of the raised surface 310.

Figure 17C:
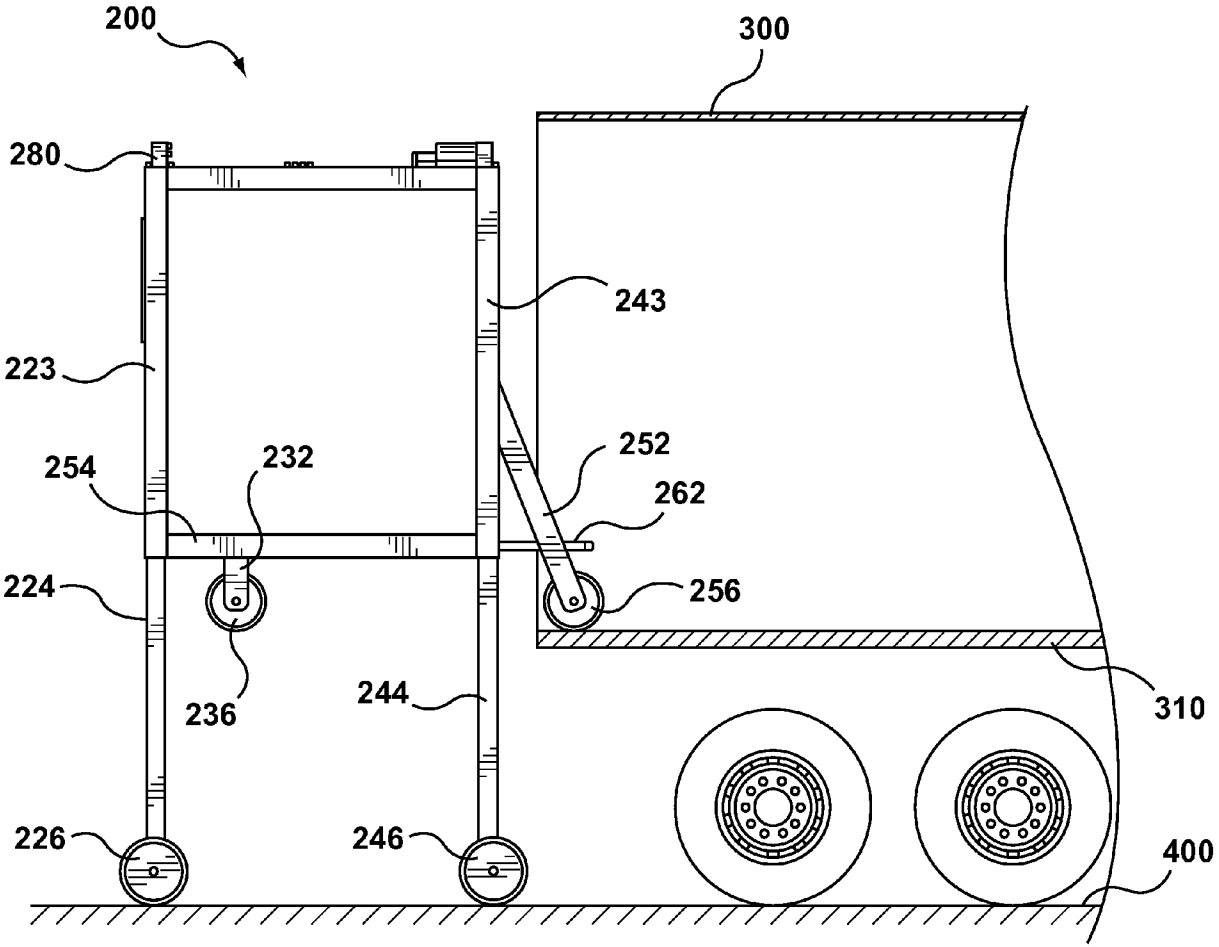

Referring to FIG. 17C, the front support wheels 256*a-b* are then brought into contact with the raised surface 310. In the illustrated example, this is achieved by advancing apparatus 200 towards the raised surface 310 and lowering front support wheels 256*a-b* onto the raised surface.

Figure 17D:
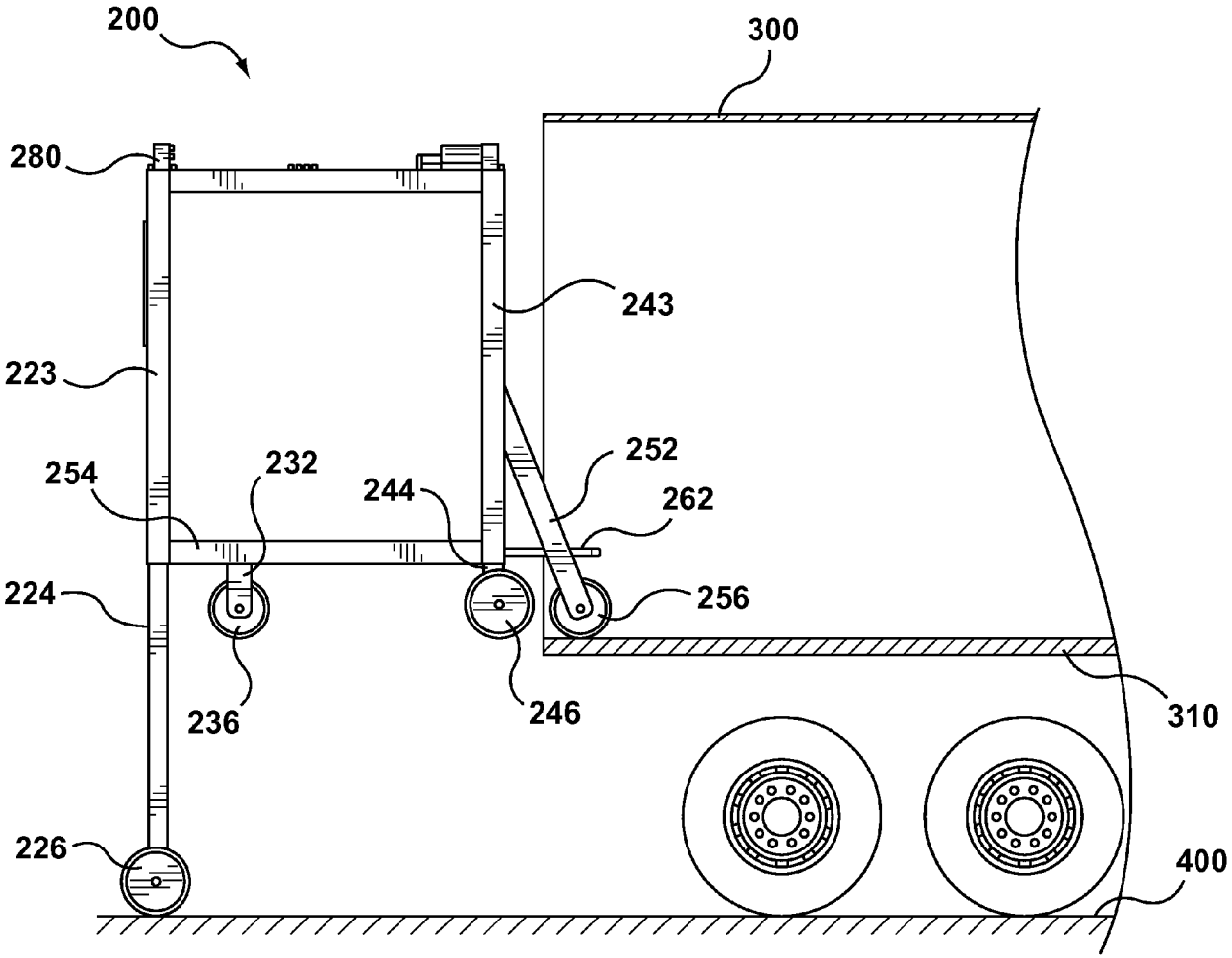

Referring to FIG. 17D, the front wheels 246*a-b* are then raised towards frame 210 so that front wheels 246*a-b* are at or above the height of the raised surface 310. Since the rear wheels 226*a-b* are in contact with the ground surface 400 and the front support wheels 256*a-b* are in contact with the raised surface 310, apparatus 200 remains stable.

Figure 17E:
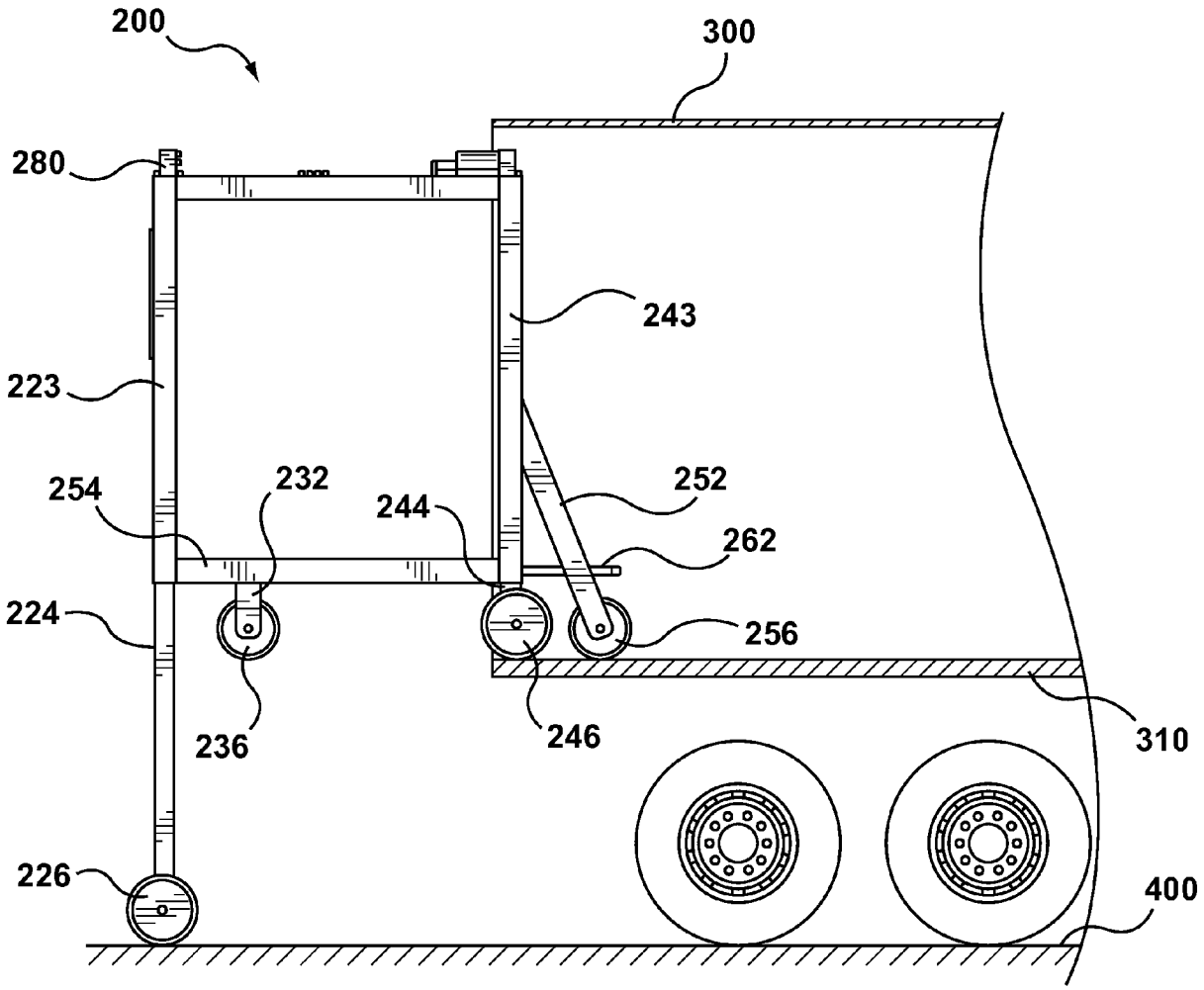

Referring to FIG. 17E, apparatus 200 is then advanced towards raised surface 310, and front wheels 246*a-b* are lowered (if necessary) onto the raised surface 310.

Figure 17F:
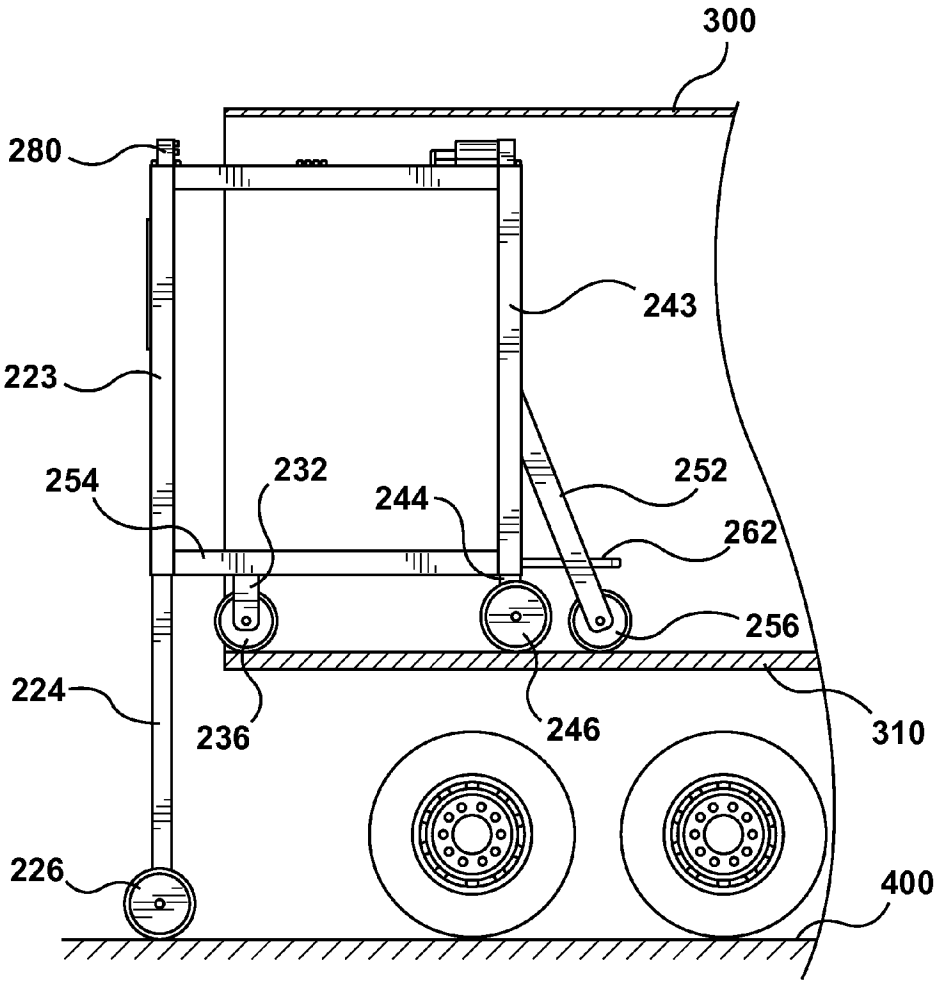

Referring to FIG. 17F, apparatus 200 is advanced forwardly (e.g. propelled by the rear wheels 226*a-b* and/or front wheels 246*a-b*) until the rear support wheels 236*a-b* are in contact with the raised surface 310. In this position, it will be appreciated that the center of gravity of apparatus 200 (and load 50) is located between the rear support wheels 236*a-b* and the front wheels 256*a-b*.

Figure 17G:
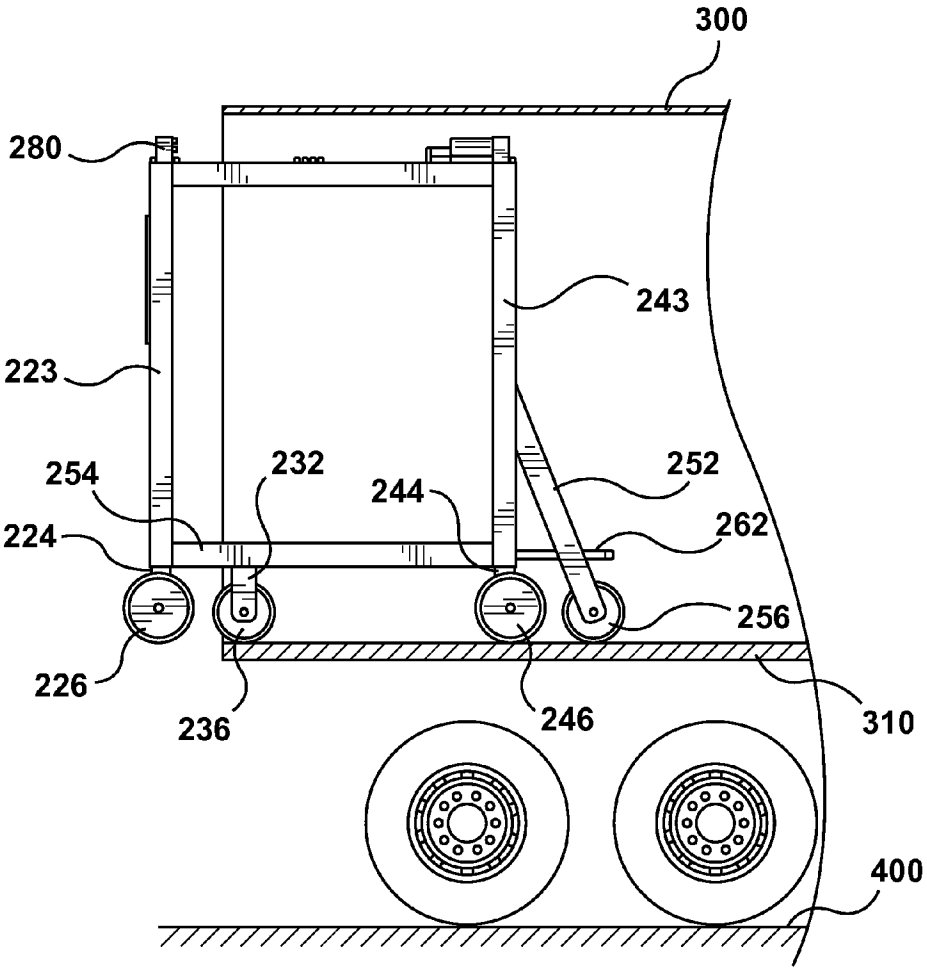
Figure 17H:
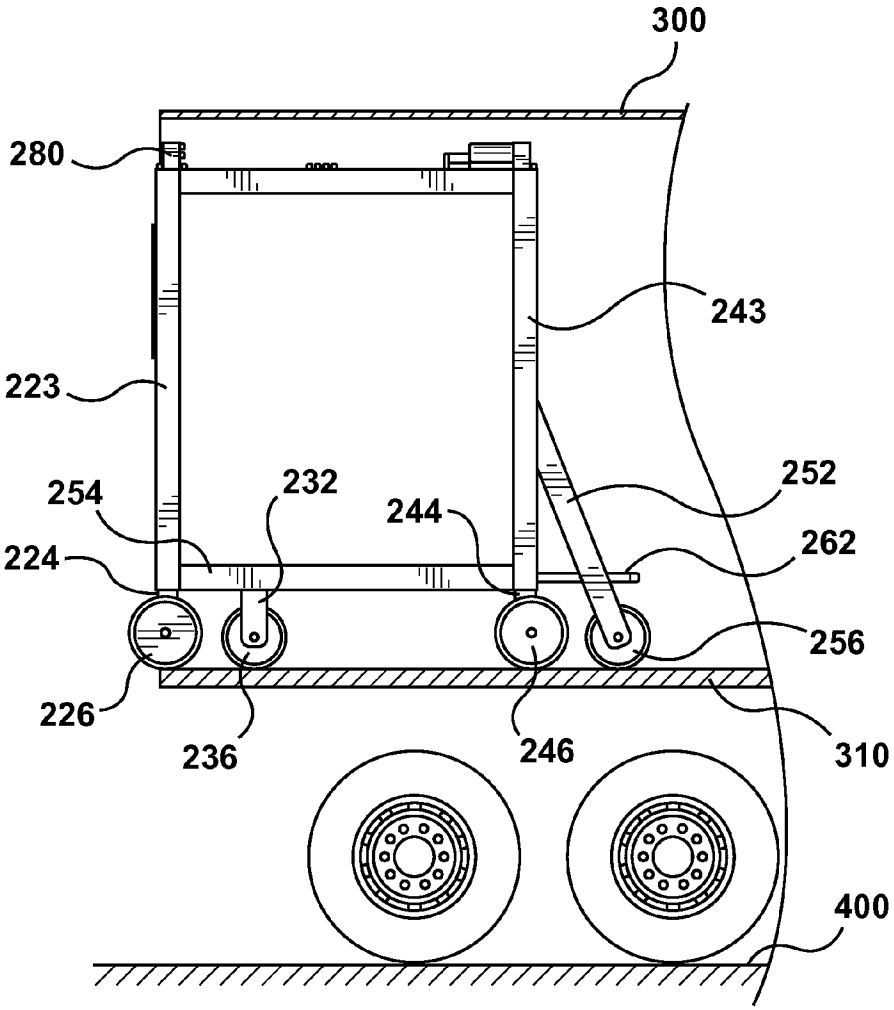

Referring to FIGS. 17G and 17H, the rear wheels 226*a-b* are then raised towards frame 210 so that rear wheels 226*a-b* are at or above the height of the raised surface 310, apparatus 200 is advanced forwardly—e.g. propelled by the front wheels 246*a-b*—and then the rear wheels 226*a-b* are lowered (if necessary) so that rear wheels 226*a-b* are in contact with raised surface 310.

Figure 17I:
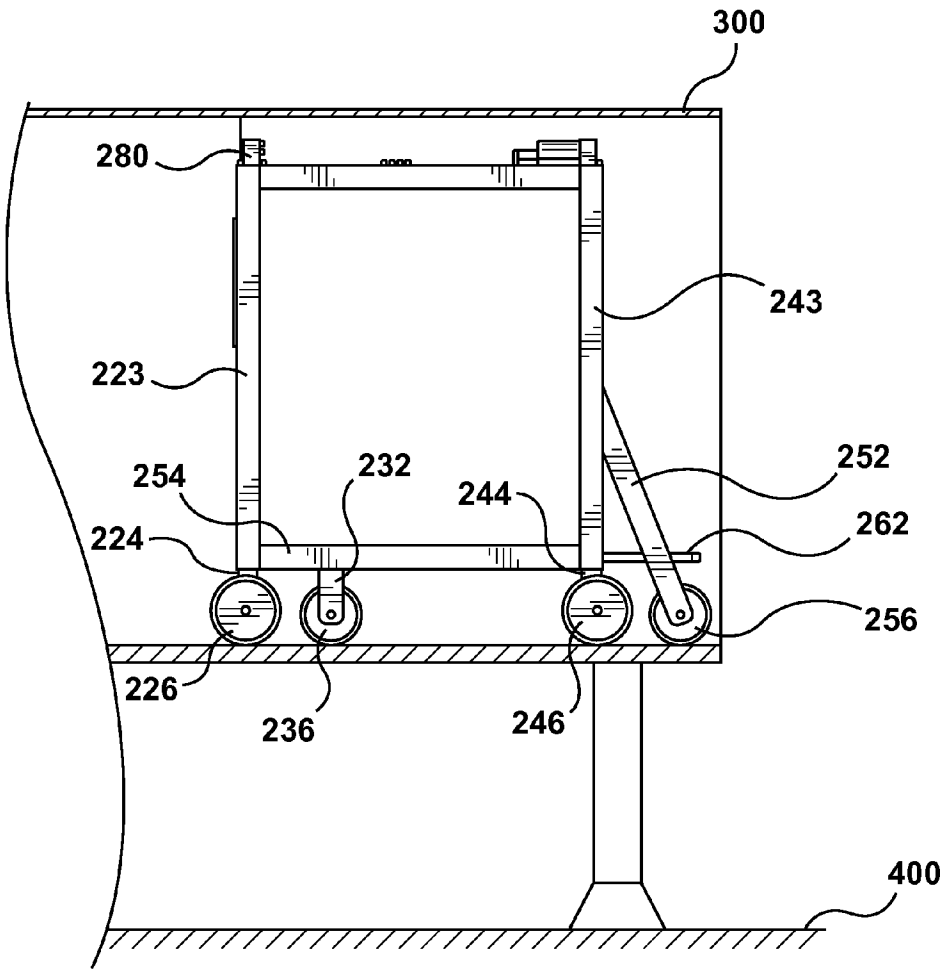
Figure 17J:
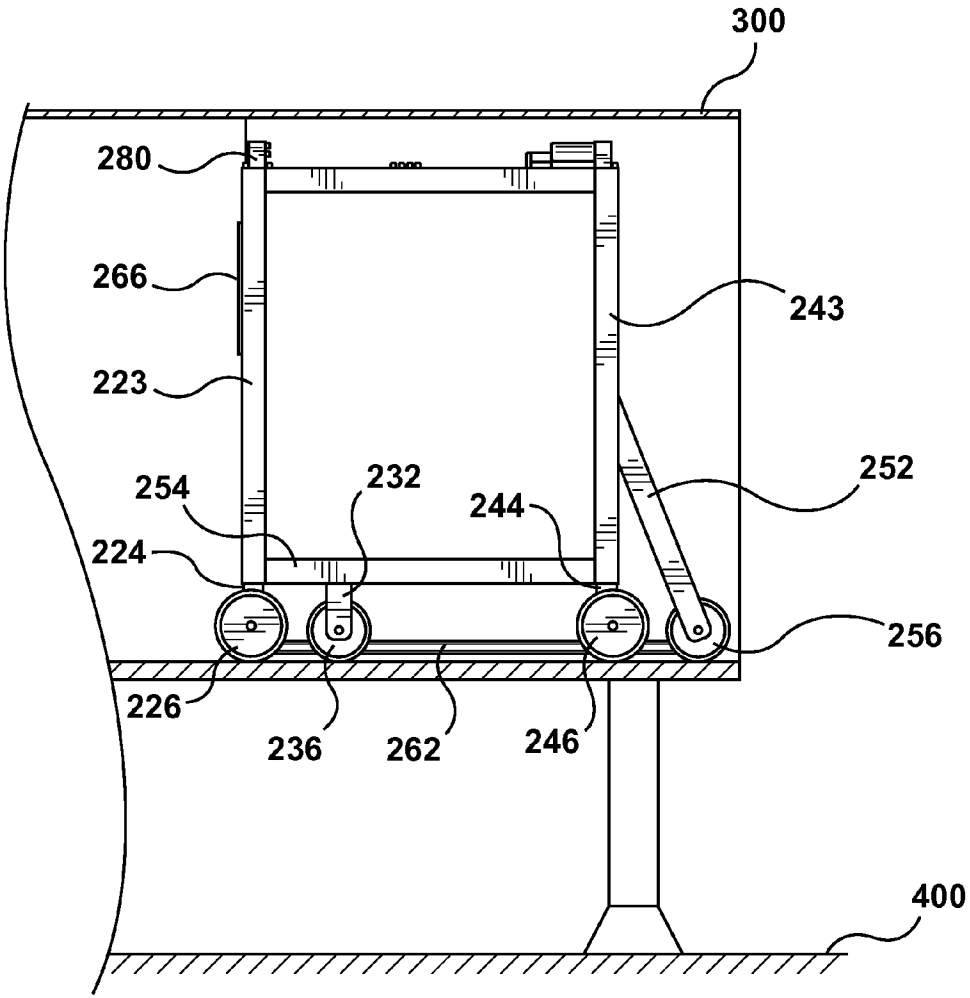

Referring to FIGS. 17I and 17J, apparatus 200 may then traverse the raised surface 310, e.g. to the front of the cargo trailer 300, where load 50 may be deposited onto the raised surface 310 by apparatus 200, e.g. by lowering load support member 260 until a pallet being supported by forks 262 is in contact with raised surface 310, as shown in FIG. 17J.

It will be appreciated that the apparatus 200 may be operated in connection with transporting a load 50 from a raised surface (e.g. unloading a load 50 from a cargo trailer 300) by following the method described with reference to FIGS. 17A-J in reverse sequence.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. Accordingly, what has been described above is intended to be illustrative of the claimed concept and non-limiting. It will be understood by persons skilled in the art that variations are possible and modifications may be made without departing from the scope of the invention as defined in the claims appended hereto.

The invention claimed is:

1. An apparatus for transporting a load onto a raised surface, the load having a centre of gravity, the apparatus comprising:

a) a frame;

b) an adjustable rear wheel assembly coupled to the frame, the adjustable rear wheel assembly comprising:
   (i) at least one adjustable rear leg,
   (ii) at least one rear wheel rotatingly coupled to a distal end of the at least one adjustable rear leg for rollingly supporting the frame, and
   (iii) at least one rear actuator operatively coupled to the at least one adjustable rear leg and configured to raise and lower the at least one rear wheel;

c) a support rear wheel assembly coupled to the frame, the support rear wheel assembly comprising at least one rear support wheel for rollingly supporting the frame, the at least one rear support wheel positioned forward of the at least one rear wheel, the at least one rear support wheel defining a rear support axis;

d) an adjustable front wheel assembly coupled to the frame, the adjustable front wheel assembly comprising:
   (i) at least one adjustable front leg,
   (ii) at least one front wheel rotatingly coupled to a distal end of the at least one adjustable front leg for rollingly supporting the frame, the at least one front wheel positioned forward of the at least one rear support wheel, the at least one front wheel defining a front axis, and (iii) at least one front actuator operatively coupled to the at least one adjustable front leg and configured to raise and lower the at least one front wheel;

e) a support front wheel assembly coupled to the frame, the support front wheel assembly comprising:

(i) at least one front support leg, and (ii) at least one front support wheel rotatingly coupled to a distal end of the at least one front support leg for rollingly supporting the frame, the at least one front support wheel positioned forward of the at least one front wheel; and e) a load support member for supporting the load, the load support member operatively coupled to the frame and moveable between an upper and a lower load support position, the load support member located below the frame and positioned so that the centre of gravity of the load being supported is located forward of the rear support axis and rearward of the front axis.

2. The apparatus of claim 1, wherein the at least one adjustable rear leg comprises a pair of adjustable rear legs extending downwardly from the frame, each adjustable rear leg of the pair of adjustable rear legs comprising an upper adjustable rear leg and a lower adjustable rear leg, the upper adjustable rear leg having an upper end coupled to the frame, the lower adjustable rear leg having an upper end coupled to the upper adjustable rear leg, and the lower adjustable rear leg having a lower end coupled to the rear wheel.

3. The apparatus of claim 2, wherein each upper adjustable rear leg comprises an elongate hollow member and each lower adjustable rear leg comprises an elongate member configured for telescoping movement within the hollow member, and wherein the at least one rear actuator is configured to move the lower adjustable rear leg relative to the upper adjustable rear leg.

4. The apparatus of claim 3, wherein each of the at least one rear actuator comprises a worm drive driven by an electric motor.

5. The apparatus of claim 3, wherein each of the at least one rear actuator comprises a hydraulic or pneumatic piston.

6. The apparatus of claim 3, wherein the at least one adjustable front leg comprises a pair of adjustable front legs extending downwardly from the frame, wherein each adjustable front leg in the pair of adjustable front legs comprises an upper adjustable front leg and a lower adjustable front leg, the upper adjustable front leg having an upper end coupled to the frame, the lower adjustable front leg having an upper end coupled to the upper adjustable front leg, and the lower adjustable front leg having a lower end coupled to the front wheel.

7. The apparatus of claim 6, wherein each upper adjustable front leg comprises an elongate hollow member and each lower adjustable front leg comprises an elongate member configured for telescoping movement within the hollow member, and wherein the at least one front actuator is configured to move the lower adjustable front leg relative to the upper adjustable front leg.

8. The apparatus of claim 7, wherein each of the at least one front actuator comprises a worm drive driven by an electric motor.

9. The apparatus of claim 7, wherein each of the at least one front actuator comprises a hydraulic or pneumatic piston.

10. The apparatus of claim 7, further comprising at least one load support track, wherein the load support member is slidingly coupled to the at least one load support track, and further comprising at least one load support actuator configured to selectively move the load support member between the upper load support position and the lower load support position.

11. The apparatus of claim 1, wherein the load support member is configured to support a pallet.

12. The apparatus of claim 11, wherein the load support member comprises at least two forks.

13. The apparatus of claim 1, wherein the apparatus is self-propelled.

14. The apparatus of claim 1, wherein when the load support member is in the upper load support position, the load is located substantially within an area defined by the pair of adjustable rear legs, the pair of adjustable front legs, and the frame.

* * * * *